US011022391B2

(12) United States Patent
Shipley et al.

(10) Patent No.: US 11,022,391 B2
(45) Date of Patent: Jun. 1, 2021

(54) CARTRIDGE EXTRACTION WITH DUMMY EXTRACTOR FOR A CASED TELESCOPED AMMUNITION FIREARM

(71) Applicant: Textron Systems Corporation, Hunt Valley, MD (US)

(72) Inventors: Paul Andrew Shipley, Millers, MD (US); Cameron Mehdi Brand, Towson, MD (US); Kevin Michael Ayotte, Baltimore, MD (US); Joshua Stephen Ruck, Baltimore, MD (US); Benjamin Tyler Cole, Baltimore, MD (US); William Henry Engel, IV, Cockeysville, MD (US)

(73) Assignee: Textron Systems Corporation, Hunt Valley, MD (US)

( * ) Notice: Subject to any disclaimer, the term of this patent is extended or adjusted under 35 U.S.C. 154(b) by 0 days.

(21) Appl. No.: 16/809,683

(22) Filed: Mar. 5, 2020

(65) Prior Publication Data

US 2020/0378707 A1 Dec. 3, 2020

Related U.S. Application Data

(63) Continuation-in-part of application No. 16/044,035, filed on Jul. 24, 2018, now Pat. No. 10,619,954.
(Continued)

(51) Int. Cl.
*F41A 15/14* (2006.01)
*F41A 3/26* (2006.01)
*F42B 5/045* (2006.01)

(52) U.S. Cl.
CPC ..... *F41A 15/14* (2013.01); *F41A 3/26* (2013.01); *F42B 5/045* (2013.01)

(58) Field of Classification Search
CPC .. F42B 5/184; F42B 5/045; F42B 5/16; F42B 7/00; F42B 7/02; F41A 3/34; F41A 3/14;
(Continued)

(56) References Cited

U.S. PATENT DOCUMENTS 2,397,963 A * 4/1946 Harvey ..... F41A 15/14 89/179
3,114,290 A * 12/1963 Harvey ..... F41A 3/74 89/26

(Continued)

FOREIGN PATENT DOCUMENTS

WO 2017197415 11/2017

OTHER PUBLICATIONS

"ARES-Olin AIWS", Gun Wiki, RANDOM powered by Wikia, Year designed: 1987, article accessed Jul. 31, 2018, 4 pages.

(Continued)

*Primary Examiner* — John Cooper
(74) *Attorney, Agent, or Firm* — BainwoodHuang

(57) ABSTRACT

A firearm for firing cased telescoped (CT) ammunition cartridges that includes a split chamber configured to fully support a CT cartridge when it is fired, and that includes i) a dynamic rear chamber portion defining a pocket in a face of a bolt, and ii) a static front chamber portion that is integral to the barrel and separate from the bolt. A cartridge extraction mechanism engages the CT cartridge prior to the CT cartridge being fired, and holds the CT cartridge in the pocket in the bolt face as the bolt moves rearward to pull the CT cartridge out of the static front chamber portion and into an ejection position. An ejector is operable to eject the CT cartridge from the pocket in the face of the bolt when the CT cartridge reaches the ejection position.

11 Claims, 43 Drawing Sheets

Related U.S. Application Data

(60) Provisional application No. 62/536,445, filed on Jul. 24, 2017, provisional application No. 62/536,448, filed on Jul. 24, 2017, provisional application No. 62/536,451, filed on Jul. 24, 2017.

(58) Field of Classification Search
CPC ..... F41A 3/32; F41A 3/36; F41A 3/38; F41A 3/40; F41A 3/46; F41A 5/18; F41A 9/66; F41B 5/045
USPC ..... 42/46, 47, 69.02, 25; 89/26
See application file for complete search history.

(56) References Cited

U.S. PATENT DOCUMENTS 3,345,770 A * 10/1967 Scanlon, Jr. ..... F41A 9/65 42/18
3,494,216 A * 2/1970 Haskins ..... F41A 15/14 42/16
3,738,223 A * 6/1973 Post ..... F41A 3/74 89/26
3,738,224 A * 6/1973 Post ..... F41A 15/14 89/26
3,890,731 A 6/1975 Aldrin
4,265,043 A * 5/1981 Rowlands ..... F41A 15/14 42/25
4,440,062 A * 4/1984 McQueen ..... F41A 15/14 89/128
4,487,103 A 12/1984 Atchisson
4,653,210 A 3/1987 Poff, Jr.
4,872,391 A 10/1989 Stoner
4,895,064 A * 1/1990 Marzocco ..... F41A 19/26 89/196
5,117,735 A 6/1992 Flashkes
6,637,310 B2 10/2003 Borgwarth
7,886,470 B1 * 2/2011 Doiron ..... F41A 3/46 42/69.02
8,776,419 B2 7/2014 Obermeit
8,807,039 B2 8/2014 Carpenter et al.
8,869,672 B2 10/2014 Smith
9,267,772 B2 2/2016 Carpenter et al.
9,638,484 B1 5/2017 Friend
2003/0056639 A1 * 3/2003 Giza ..... F41A 5/16 89/1.701
2014/0259843 A1 9/2014 Matteson
2015/0308759 A1 * 10/2015 Fellows ..... F41A 19/27 42/16
2016/0116240 A1 4/2016 Gomez
2017/0328689 A1 11/2017 Dindl
2017/0328690 A1 * 11/2017 Dindl ..... F41A 15/12
2018/0066925 A1 3/2018 Skowron et al.

OTHER PUBLICATIONS

Notification of Transmittal of the International Search Report and the Written Opinion of the International Searching Authority, or the Declaration dated Dec. 5, 2018 by the International Searching Authority of European Patent Office for International Application No. PCT/US2018/043488, International Filing Date: Jul. 24, 2018; 13 pages.

* cited by examiner

CARTRIDGE EXTRACTION WITH DUMMY EXTRACTOR FOR A CASED TELESCOPED AMMUNITION FIREARM

CROSS REFERENCE TO RELATED APPLICATIONS

The present application claims priority to the following United States Provisional Patent Applications filed on Jul. 24, 2017, the disclosures of which are hereby included by reference herein:

a) U.S. Provisional Patent Application No. 62/536,445, b) U.S. Provisional Patent Application No. 62/536,448, and c) U.S. Provisional Patent Application No. 62/536,451.

The present application is a Continuation in Part of U.S. patent application Ser. No. 16/044,035 filed Jul. 24, 2018, all disclosures of which are hereby included by reference herein.

STATEMENT REGARDING FEDERALLY SPONSORED RESEARCH OR DEVELOPMENT

This invention was made with government support under W15QKN-12-9-0001/DOTC-14-01-INIT524 MOD11 awarded by the US Army. The government has certain rights in the invention.

TECHNICAL FIELD

The present disclosure relates generally to semi-automatic and/or fully automatic firearms that are designed to fire cased telescoped ammunition, such as rifles, carbines, machine guns, submachine guns, handguns, etc., and more specifically to techniques and mechanisms for extracting cased telescoped cartridges from a chamber of a firearm that is specifically designed to use such cartridges, in order for the cased telescoped cartridges to be effectively ejected from the firearm.

BACKGROUND

As it is generally known, most traditional firearm ammunition cartridges are constructed using a metal shell casing (e.g. a brass casing). The metal casing of a traditional cartridge typically contains some amount of propellant (e.g. gunpowder, smokeless powder, etc.) in a rearward portion of the cartridge that is sometimes referred to as the cartridge "body". The metal casing of a traditional casing also holds a projectile in a frontward portion of the cartridge that is sometimes referred to as the cartridge "neck". Traditional metal cartridge cases typically have a tapered shape, in which a relatively wider diameter body steps down to a relatively smaller diameter neck. When a traditional metal case cartridge is fired, the propellant contained in the metal casing is ignited. Gases resulting from the burning of the propellant pressurize radially and expand the metal casing against the wall of the chamber, and push against the base of the projectile, causing the projectile to be expelled from the front of the cartridge and through the barrel of the firearm.

In contrast to traditional metal case cartridges, cased telescoped (CT) ammunition cartridges completely encase the propellant and the projectile within a cylindrical shell. Firearms designed to fire CT ammunition provide full support for the cartridge exterior while firing. Because the firearm provides full cartridge exterior support, the case of a CT cartridge may be thinner than in traditional cartridges.

By replacing the relatively thick casing used in traditional ammunition with a thinner, relatively lightweight casing (e.g. a relatively lightweight polymer casing), CT ammunition may provide a significant reduction in ammunition weight, enabling relatively larger numbers of rounds to be carried per unit weight, e.g. by infantry soldiers.

SUMMARY

Designing a firearm specifically for use with cased telescoped ammunition introduces technical challenges during extraction of the CT cartridge from the chamber. The extraction phase of firearm operation involves removing a previously fired cartridge (a "spent" cartridge) or an unfired cartridge (a "misfired" cartridge) from the chamber, so that the spent or misfired cartridge can then be ejected from the firearm, and so that a new cartridge can be loaded into the chamber. Firearms designed to fire traditional metal case cartridges have used extraction mechanisms that rely on specific characteristics of metal case cartridges, and have chambers that are specifically designed for use with typical metal case cartridges. For example, due to the relatively high strength of a traditional metal cartridge case, the chamber of a firearm that is designed to use traditional metal case cartridges need not radially support the cartridge along the entire length of the cartridge at the time the cartridge is fired. Accordingly, the chamber need not extend over the base of the cartridge, since the metal base is sufficiently strong to prevent gasses caused by burning the propellant from flowing in any direction other than frontwards towards the barrel. In traditional metal case cartridge firing firearms, a portion of the metal case cartridge at the base of the metal case cartridge is not radially supported by the wall of the chamber, and may be engaged outside of the chamber by an extraction mechanism, in order to pull the cartridge out of the chamber. In contrast, the chamber of a firearm designed to use CT cartridges should advantageously provide radial support along the entire length of the cartridge at the time of firing, since otherwise when the CT cartridge is fired the relatively thin case material (e.g. polymer case material) may flow outwards at any point(s) where the cartridge is not radially supported, potentially allowing gasses created by the burning of the propellant to be released in an uncontrolled manner. An extraction mechanism in a firearm designed to use CT cartridges should accordingly operate to extract a CT cartridge while also providing a chamber that radially supports the CT cartridge along the entire length of the CT cartridge at the time the CT cartridge is fired.

Another example of the cartridge extraction challenges introduced by the use of CT cartridges arises from the relative strengths of traditional and CT cartridge cases. Specifically, some extraction mechanisms designed to extract traditional metal case cartridges may pull the case cartridge from the chamber using an extraction mechanism that relies on the relatively high strength of the traditional metal case. Such extraction mechanisms cannot be used to extract CT cartridges because the lighter weight cases used in CT cartridges do not have the strength required to withstand the load introduced on the CT cartridge case when the CT cartridge is extracted from the chamber by traditional cartridge extraction mechanisms.

In order to address the above described and other deficiencies of previous firearms with regard to firing cased telescoped (CT) ammunition cartridges, a firearm for firing cased CT cartridges is disclosed herein that includes a split chamber that is configured to radially support a CT cartridge along a full length of the CT cartridge, as well as the front and rear faces of the CT cartridge, when the CT cartridge is fired. The split chamber includes a dynamic rear chamber portion defining a pocket in a bolt face of the firearm's bolt. The bolt operates by moving forward to load the CT cartridge into the split chamber for firing. The split chamber also includes a static front chamber portion that is integral to the barrel of the firearm, and that is mechanically separate from the moving bolt. A cartridge extraction mechanism is configured a) to engage the CT cartridge prior to the CT cartridge being fired, and b) to hold the CT cartridge in the pocket of the bolt face after the CT cartridge is fired, as the bolt moves rearward during recoil, in order to move the CT cartridge rearward out of the static front chamber portion and into an ejection position. An ejector is configured to eject the CT cartridge from the pocket of the bolt face upon the CT cartridge being moved into the ejection position, in order for the cartridge to be ejected from the firearm. The CT cartridge moved rearward out of the static front chamber portion and into the ejection position may be either a spent CT cartridge, or an unfired CT cartridge in the event of a misfire.

The dynamic rear portion of the split chamber is configured to contain, within the pocket defined in the bolt face of the bolt, pressure generated within the split chamber when the CT cartridge is fired. The cartridge extraction mechanism may include a pivoting extractor configured to engage an extractor groove in the CT cartridge, such that moving the bolt to load the CT cartridge into the split chamber causes the pivoting extractor to engage the extractor groove in the CT cartridge prior to firing of the CT cartridge. The bolt may be further configured to move, after the pivoting extractor is engaged with the extractor groove in the CT cartridge and prior to firing of the CT cartridge, to compress the CT cartridge, while the CT cartridge is located within the split chamber, to a length that is less than an initial length of the CT cartridge, where the initial length of the CT cartridge is the length of the CT cartridge at the time the CT cartridge was loaded into the split chamber. The pivoting extractor may be operable to pivot away from the CT cartridge upon the CT cartridge being moved into the ejection position, and pivoting of the pivoting extractor away from the CT cartridge enables the CT cartridge to be ejected from the pocket defined by the bolt face of the bolt by the ejector, so that the cartridge can be ejected from the firearm.

In addition to the pivoting extractor, the cartridge extraction mechanism may also include at least one dummy extractor. The dummy extractor is configured to engage some portion of the extractor groove in the CT cartridge that is not engaged by the pivoting extractor, while the CT cartridge is loaded and during firing, in order to provide additional grip on the CT cartridge during extraction of the CT cartridge into the ejection position after firing. The dummy extractor may advantageously promote symmetric stretching of the polymer case of the CT cartridge during firing, thus providing improved grip on the CT cartridge during extraction.

After firing, as the bolt moves rearward during recoil and the CT cartridge is moved rearward out of the static front chamber portion and towards the ejection position, the dummy extractor is disengaged from the extractor groove of the CT cartridge, allowing the CT cartridge to be ejected from the firearm without interference by the dummy extractor.

The cartridge extraction mechanism may alternatively include a clamping mechanism that is configured to engage with the CT cartridge. In such embodiments, the clamping mechanism may be configured to engage the CT cartridge while the CT cartridge is located in the split chamber, e.g. prior to the CT cartridge being moved into the ejection position. In some embodiments, the clamping mechanism may include a collet gripping mechanism that is operable to grip the CT cartridge. In some embodiments, the clamping mechanism may include a pin that is operable to extend towards and engage with the CT cartridge.

Firearms using embodiments of the disclosed mechanisms may provide significant advantages over previous firearms. For example, a disclosed cartridge extraction mechanism may extract a CT cartridge while also providing a split chamber that radially supports the CT cartridge along the entire length of the CT cartridge at the time the CT cartridge is fired, thus i) preventing the case material from flowing outwards and ii) preventing gasses created by the burning of the propellant from being released in an uncontrolled manner. The disclosed cartridge extraction mechanisms advantageously do not rely on the relatively high strength of a traditional metal cartridge case when extracting the CT cartridge from the chamber after the CT cartridge is fired. In another example, the disclosed cartridge extraction mechanisms take into consideration the relatively lower strength of the lighter weight cases (e.g. polymer cases) that may be used in CT cartridges.

BRIEF DESCRIPTION OF THE DRAWINGS

The foregoing and other objects, features and advantages will be apparent from the following description of particular embodiments of the disclosed technology, as illustrated in the accompanying drawings in which like reference characters refer to the same parts throughout the different views. The drawings are not necessarily to scale, emphasis instead being placed upon illustrating the principles of various embodiments of the disclosed technology.

DETAILED DESCRIPTION

Embodiments of the invention will now be described. It should be understood that such embodiments are provided by way of example to illustrate various features and principles of the invention, and that the invention hereof is broader than the specific examples of embodiments provided herein.

The embodiments described herein include a firearm for firing CT cartridges that may include a split chamber configured to radially support a CT cartridge along a full length of the CT cartridge when the CT cartridge is fired. The disclosed split chamber may include a dynamic rear chamber portion defining a pocket in a bolt face of the firearm's bolt. The bolt may operate by moving forward to load the CT cartridge into the split chamber for firing. The split chamber may also include a static front chamber portion that is integral to the barrel of the firearm, and that is mechanically separate from the bolt. The disclosed cartridge extraction mechanism may be configured a) to engage the CT cartridge prior to the CT cartridge being fired, and b) to hold the CT cartridge in the pocket of the bolt face after the CT cartridge is fired, as the bolt moves rearward (e.g. during recoil) to move the CT cartridge rearward out of the static front chamber portion and into an ejection position. An ejector may be configured to eject the CT cartridge from the pocket of the bolt face upon the CT cartridge being moved into the ejection position. The dynamic rear portion of the split chamber may be configured to contain, within the pocket defined in the bolt face of the bolt, pressure generated within the split chamber when the CT cartridge is fired. The CT cartridge moved rearward out of the static front chamber portion and into the ejection position may be either a spent CT cartridge, or an unfired CT cartridge in the event of a misfire.

Figure 1:
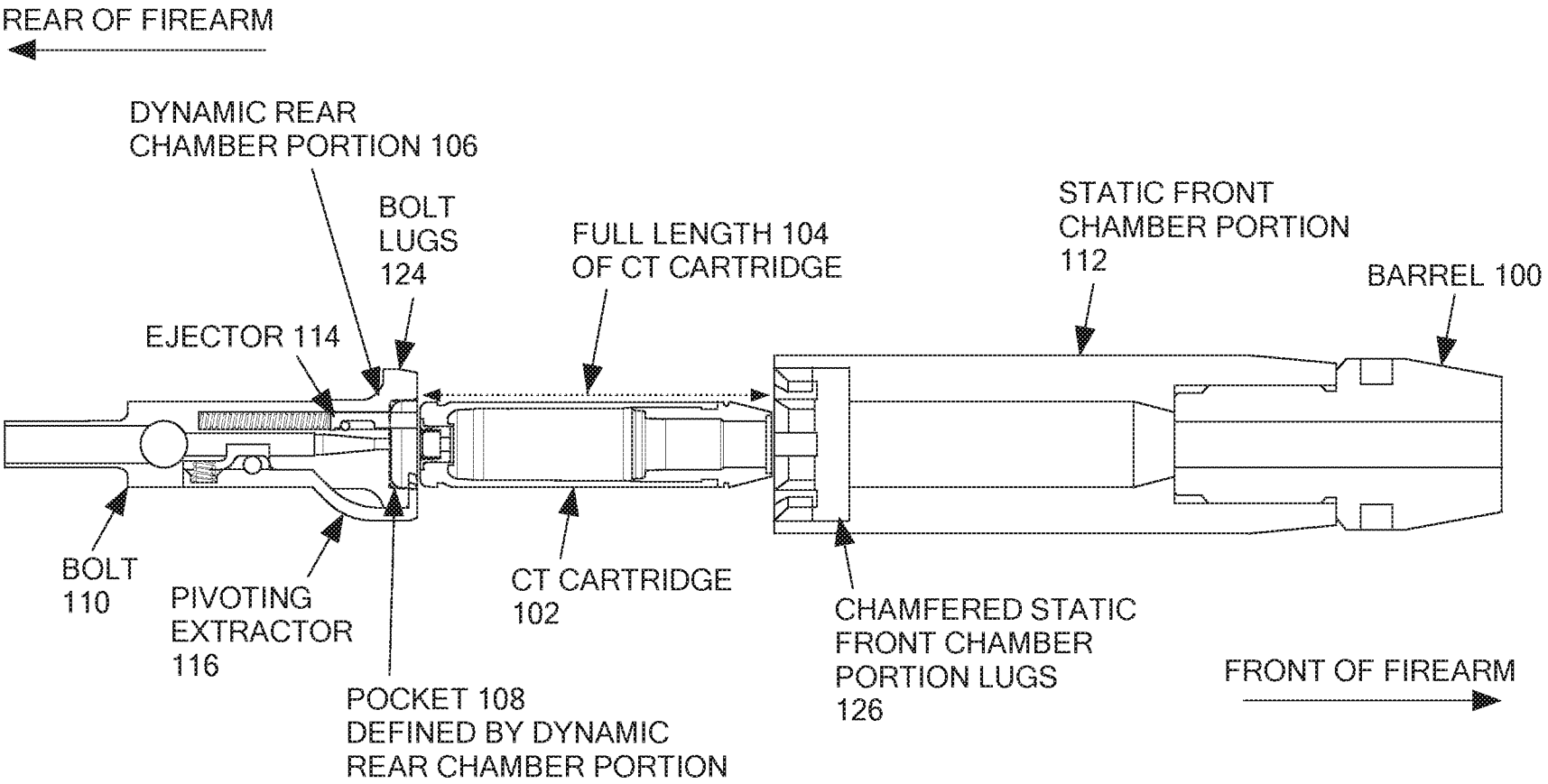
FIG. 1 is a cross-sectional top view of components in a firearm that is configured to fire cased telescoped (CT) ammunition cartridges and having a split chamber, showing a first example of a cartridge extraction mechanism including a pivoting extractor, and showing a CT cartridge that is located in a feed position.

FIG. 1 is a cross-sectional top view of components in a firearm configured to fire cased telescoped (CT) ammunition cartridges. The firearm shown in FIG. 1 has a split chamber, and illustrates a first example of a cartridge extraction mechanism. The first example of a cartridge extraction mechanism shown in FIG. 1 includes a Pivoting Extractor 116. FIG. 1 also shows a CT Cartridge 102 in a feed position. The split chamber shown in FIG. 1 is configured to radially support CT Cartridge 102 along a Full Length 104 of CT Cartridge 102 when CT Cartridge 102 is loaded into the split chamber and fired. The split chamber in the example of FIG. 1 includes a Dynamic Rear Chamber Portion 106 defining a Pocket 108 in a bolt face of the firearm's Bolt 110. The Bolt 110 operates by moving forward in the firearm to load the CT Cartridge 102 into the split chamber for firing, e.g. during counter recoil phase while performing gas-operated automatic reloading of the firearm or the like. As shown in FIG. 1, the Dynamic Rear Chamber Portion 106 may consist of or include some front portion of the Bolt 110, including for example a bolt face of the Bolt 110, such that a Pocket 108 is defined as a concave surface within the bolt face of Bolt 110.

The split chamber in the example of FIG. 1 also includes a Static Front Chamber Portion 112 that is integral to the Barrel 100 of the firearm. The Static Front Chamber Portion 112 is mechanically separate from the Bolt 110, such that the Bolt 110 moves independently from the Static Front Chamber Portion 112 during recoil and counter recoil to perform automatic cartridge loading, e.g. as driven by a conventional gas-operated automatic reloading system based on a piston (not shown) driven by high-pressure gas captured each time a cartridge is fired. The Static Front Chamber Portion 112 may, for example, consist of or include a rear portion of the Barrel 100, and/or a piece that is fixedly attached to the Barrel 100.

As shown in FIG. 1, the first example CT cartridge extraction mechanism may include a Pivoting Extractor 116.

As further shown in FIGS. 2-11 and further described below, Pivoting Extractor 116 may be configured a) to engage the CT Cartridge 102 prior to CT Cartridge 102 being fired, and b) to hold the CT Cartridge 102 in the Pocket 108 of the bolt face of the Bolt 110 after the CT Cartridge 102 is fired, as the Bolt 110 moves rearward (e.g. during recoil), in order to move the CT Cartridge 102 rearward out of the Static Front Chamber Portion 112 and into an ejection position. An Ejector 114 may be configured to eject the CT Cartridge 102 from the Pocket 108 upon the CT Cartridge 102 being moved into the ejection position, so that the CT Cartridge 102 can be ejected from the firearm.

In order to allow the firearm to successfully fire the CT Cartridge 102, the Dynamic Rear Chamber Portion 106 is configured to contain, within the Pocket 108, the pressure generated within the split chamber when the CT Cartridge 102 is fired. The Pocket 108 accordingly prevents the gases generated within the split chamber when CT Cartridge 102 is fired from being released from the Pocket 108, e.g. in a rearward or lateral direction, and the chamber pressure is accordingly directed completely frontwards to effectively and efficiently drive the projectile that is contained in CT Cartridge 102 through Barrel 100. This design of the Pocket 108 in the Dynamic Rear Chamber Portion 106 stands in contrast to the design of previous firearms that were designed to fire traditional metal case cartridges, and which accordingly relied on the metal case of the cartridge to resist the rearward pressure generated when the metal case cartridges were fired.

As further shown in FIGS. 2-11 and further described below, Pivoting Extractor 116 may be configured to engage an extractor groove in the CT Cartridge 102, such that moving the Bolt 110 forward in the firearm to load the CT Cartridge 102 into the split chamber for firing causes the Pivoting Extractor to engage the extractor groove in the CT Cartridge 102 prior to firing of the CT Cartridge.

The Bolt 110 may be further configured to move, after the Pivoting Extractor 116 is engaged with the extractor groove in the CT Cartridge 102, while the CT Cartridge 102 is located within the split chamber, and prior to firing of the CT Cartridge 102, to compress the CT Cartridge 102 to a length that is less than an initial length of the CT Cartridge 102. The initial length of the CT Cartridge 102 is the length of the CT Cartridge 102 at the time the CT Cartridge 102 is initially loaded into the split chamber.

The Pivoting Extractor 116 may be operable to pivot a front portion of the Pivoting Extractor 116 laterally outward from the CT Cartridge 102 upon the CT Cartridge 102 being moved into an ejection position, e.g. when a front portion of the Pivoting Extractor 116 is pushed out of the Pocket 108 by the CT Cartridge 102 when the CT Cartridge 102 is pushed forward out of the Pocket 108 by the Ejector 114.

As further shown in FIG. 1, Bolt Lugs 124 may be provided at the front of Bolt 110 for locking into Chamfered Static Front Chamber Portion Lugs 126 that are located at the back of Static Front Chamber Portion 112, in order to lock the Bolt 110 to the Static Front Chamber Portion 112, and thereby couple the Dynamic Rear Chamber Portion 106 to the Static Front Chamber Portion 112 prior to firing the CT Cartridge 102.

Figure 2:
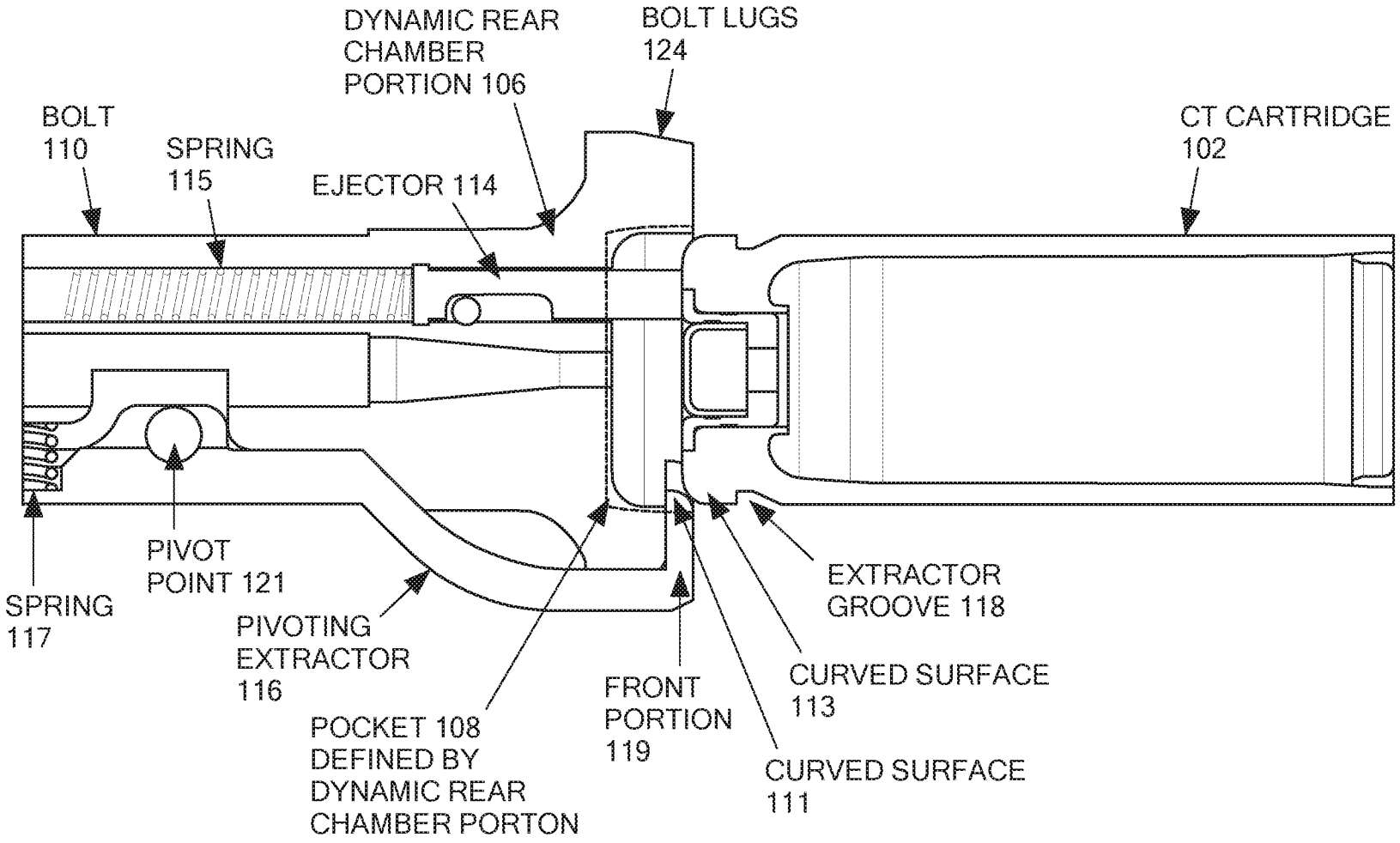
FIG. 2 is a cross-sectional top view of the firearm components of FIG. 1, showing the first example cartridge extraction mechanism, and showing the bolt having begun moving forward to load the CT cartridge into the split chamber, and making initial contact with the rear of the CT cartridge.

FIG. 2 is a cross-sectional top view of the firearm components shown in FIG. 1, showing the first example cartridge extraction mechanism, with the Bolt 110 having begun to move forward in the firearm while loading the CT Cartridge 102, e.g. during counter recoil. In FIG. 2, the Bolt 110 has come into initial contact with the CT Cartridge 102. As shown in FIG. 2, CT Cartridge 102 includes an Extractor Groove 118. The force of the Bolt 110 moving forward in the firearm while loading CT Cartridge 102 is sufficient to overcome Spring 115 that pushes Ejector 114 into Pocket 108, and a Spring 117 that pivots Pivoting Extractor 116 such that Front Portion 119 is pushed into Pocket 108. A Curved Surface 111 of the end of Front Portion 119 of Pivoting Extractor 116 comes into contact with a Curved Surface 113 of the rear portion CT Cartridge 102, and the force of the Bolt 110 moving forward during loading of CT Cartridge 102 causes the end of the Front Portion 119 of Pivoting Extractor 108 to be pushed laterally out of the Pocket 108 by the CT Cartridge 102 (as the Pivoting Extractor 108 pivots about Pivot Point 121), while the Ejector 116 is simultaneously pushed backwards out of the Pocket 108 by the CT Cartridge 102, thus allowing the rearward portion of CT Cartridge 102 to gradually enter the Pocket 108.

Figure 2A:
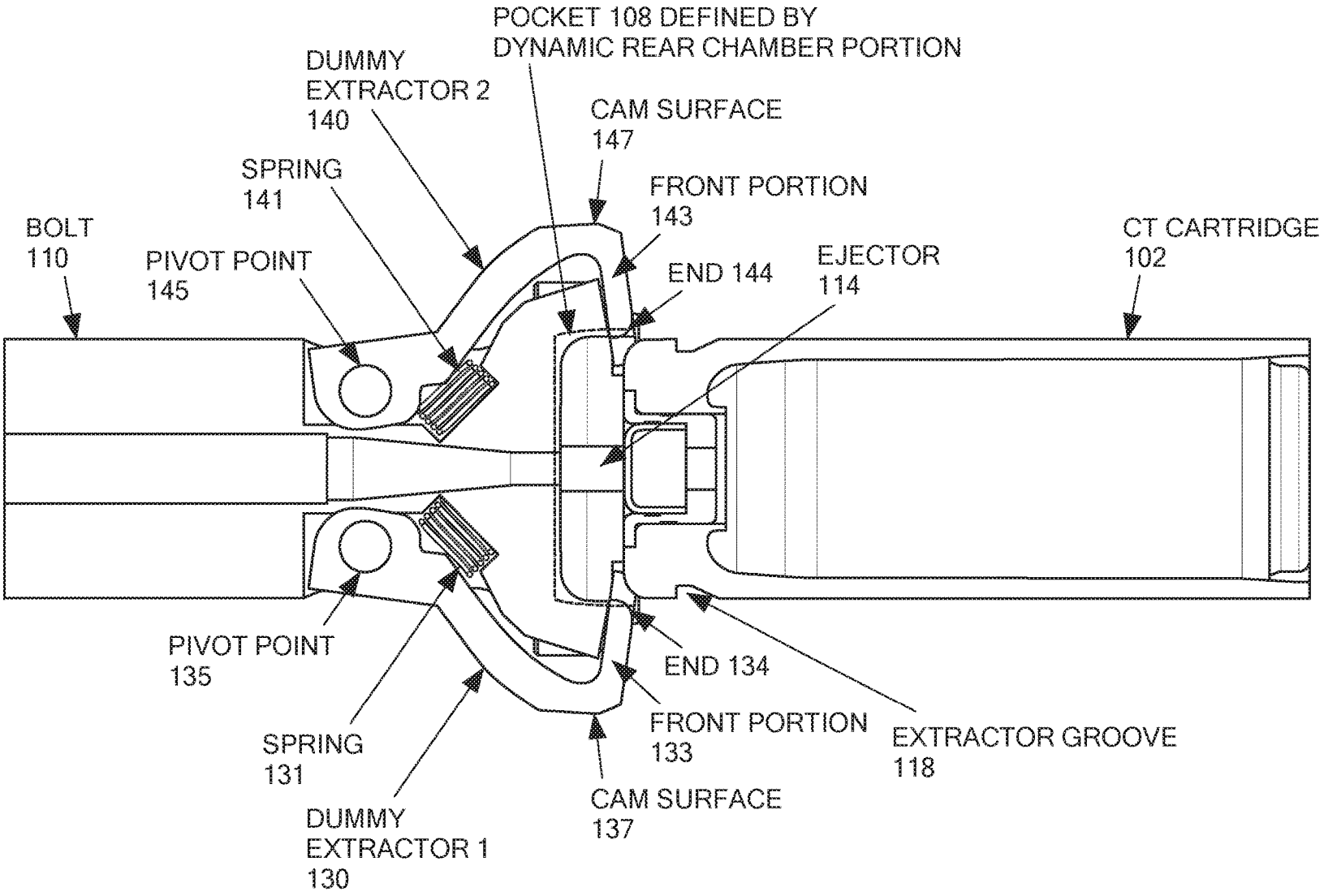
FIG. 2*a* is a cross-sectional view of the firearm components of FIG. 1 rotated laterally 90 degrees from the view shown in FIG. 1, with the bolt in the same point in the process of feeding the CT cartridge as is shown in FIG. 2 (i.e. the bolt having begun moving forward to load the CT cartridge into the split chamber), additionally showing an example of opposing dummy extractors oriented 90 degrees from the pivoting extractor.

FIG. 2*a* is a cross-sectional view of the firearm components of FIG. 1 rotated laterally 90 degrees from the view shown in FIG. 1. In FIG. 2*a*, the Bolt 110 is shown in the same position as in FIG. 2, having begun moving forward to load the CT cartridge into the split chamber. FIG. 2*a* shows an embodiment of the first example CT cartridge extraction mechanism in which the Dynamic Rear Chamber Portion 106 further includes at least one dummy extractor. For example, the embodiment of FIG. 2*a* shows a pair of opposing pivoting dummy extractors, e.g. Dummy Extractor 1 130 and Dummy Extractor 2 140, that are oriented 90 degrees from the Pivoting Extractor 116. While the embodiment of FIG. 2*a* shows two pivoting dummy extractors, the disclosed technology is not limited to embodiments that use two dummy extractors, and other numbers of dummy extractors may be used in the alternative, e.g. a single dummy extractor or more than two dummy extractors.

Figure 5:
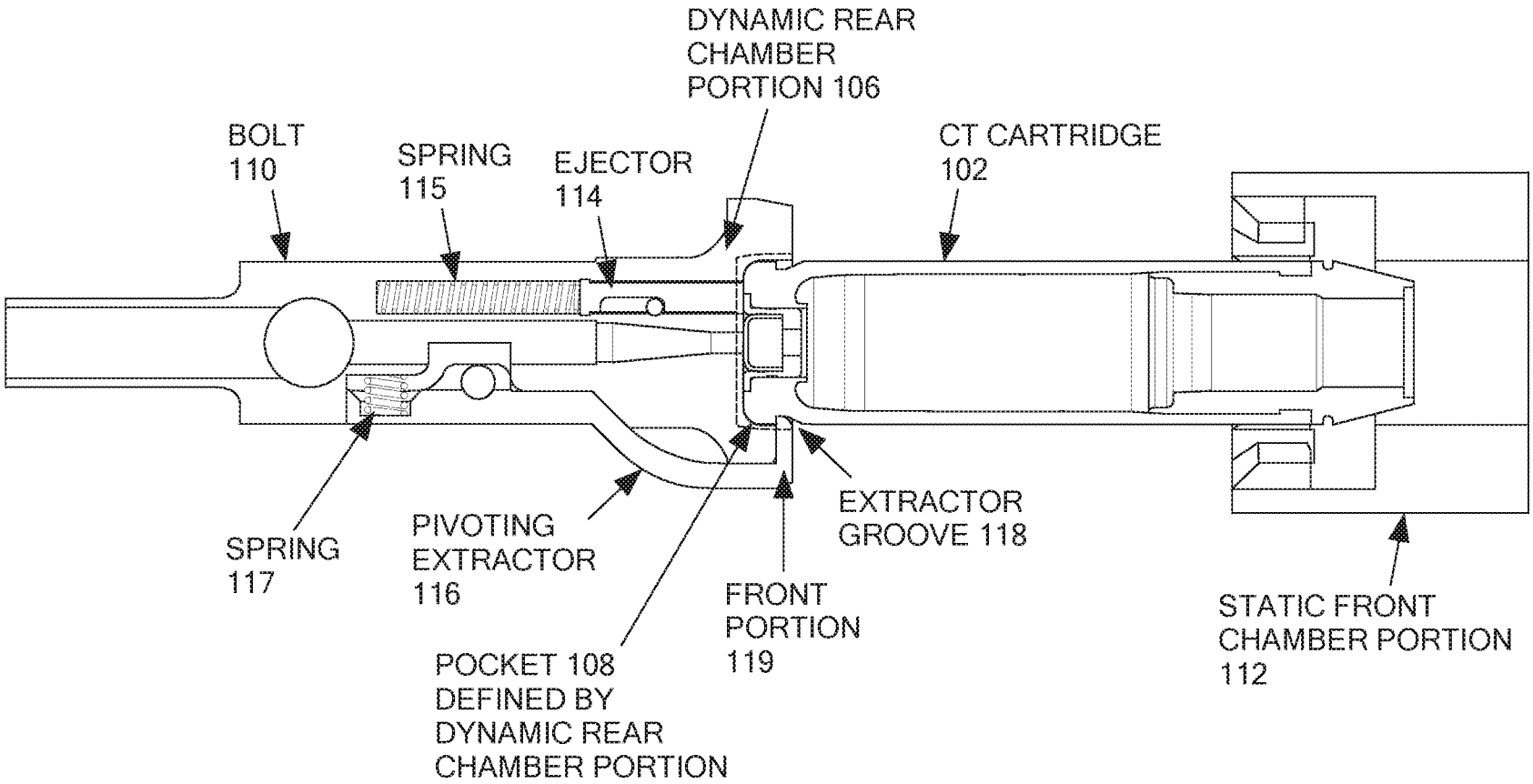
FIG. 5 is a cross-sectional top view of the firearm components of FIG. 1, showing the first example cartridge extraction mechanism, and showing the pivoting extractor engaged with the extractor groove in the CT cartridge, as the bolt continues to move forward to load the CT cartridge.
Figure 5A:
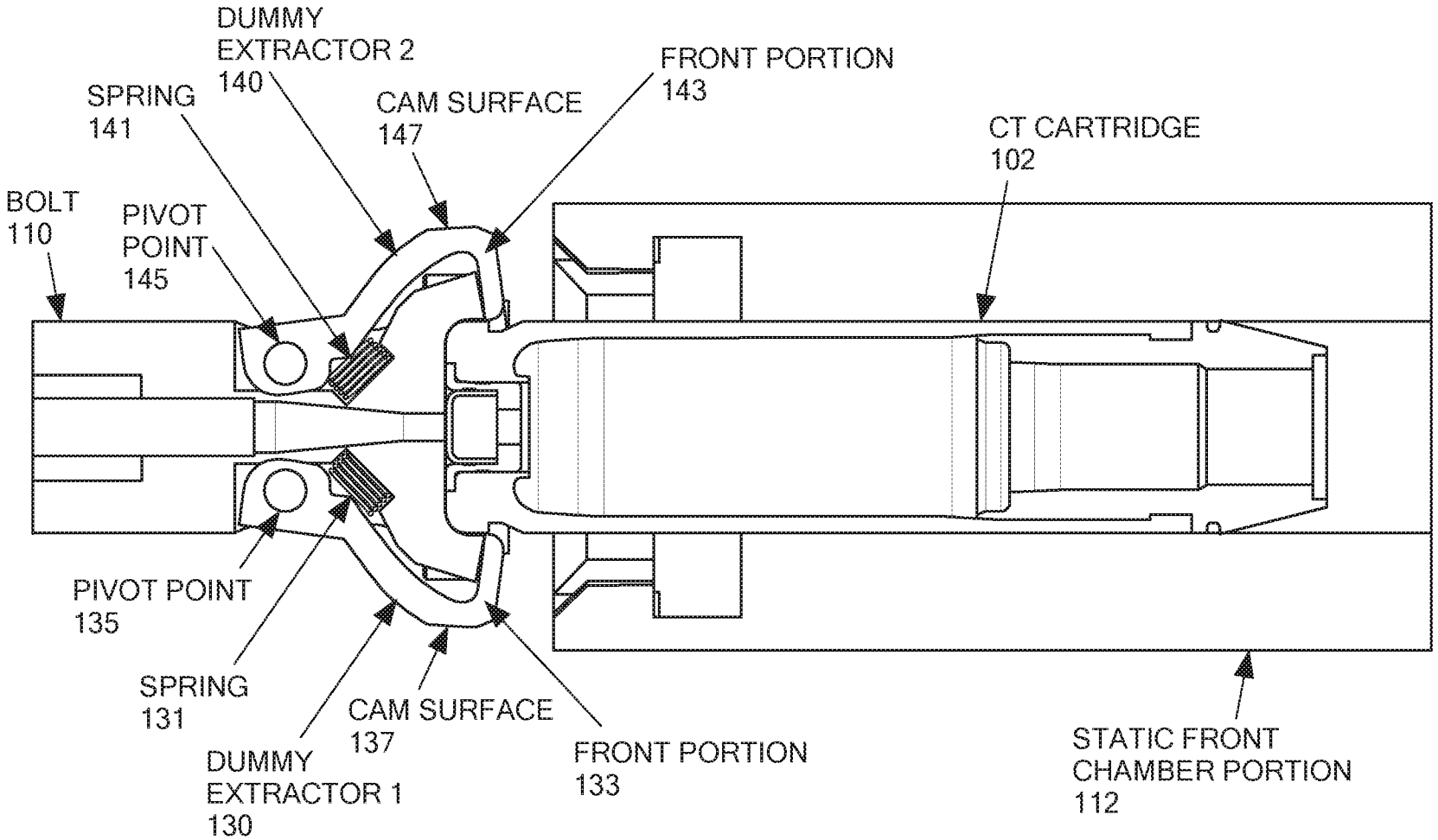
FIG. 5*a* is a cross-sectional view of the firearm components of FIG. 1, rotated laterally 90 degrees from the view in FIG. 1 as in FIG. 2*a*, with the bolt continuing to move forward from the position shown in FIG. 5 to load the CT cartridge, and showing the pair of dummy extractors just prior to engagement of cam surfaces of the dummy extractors with the static front chamber portion.
Figure 6:
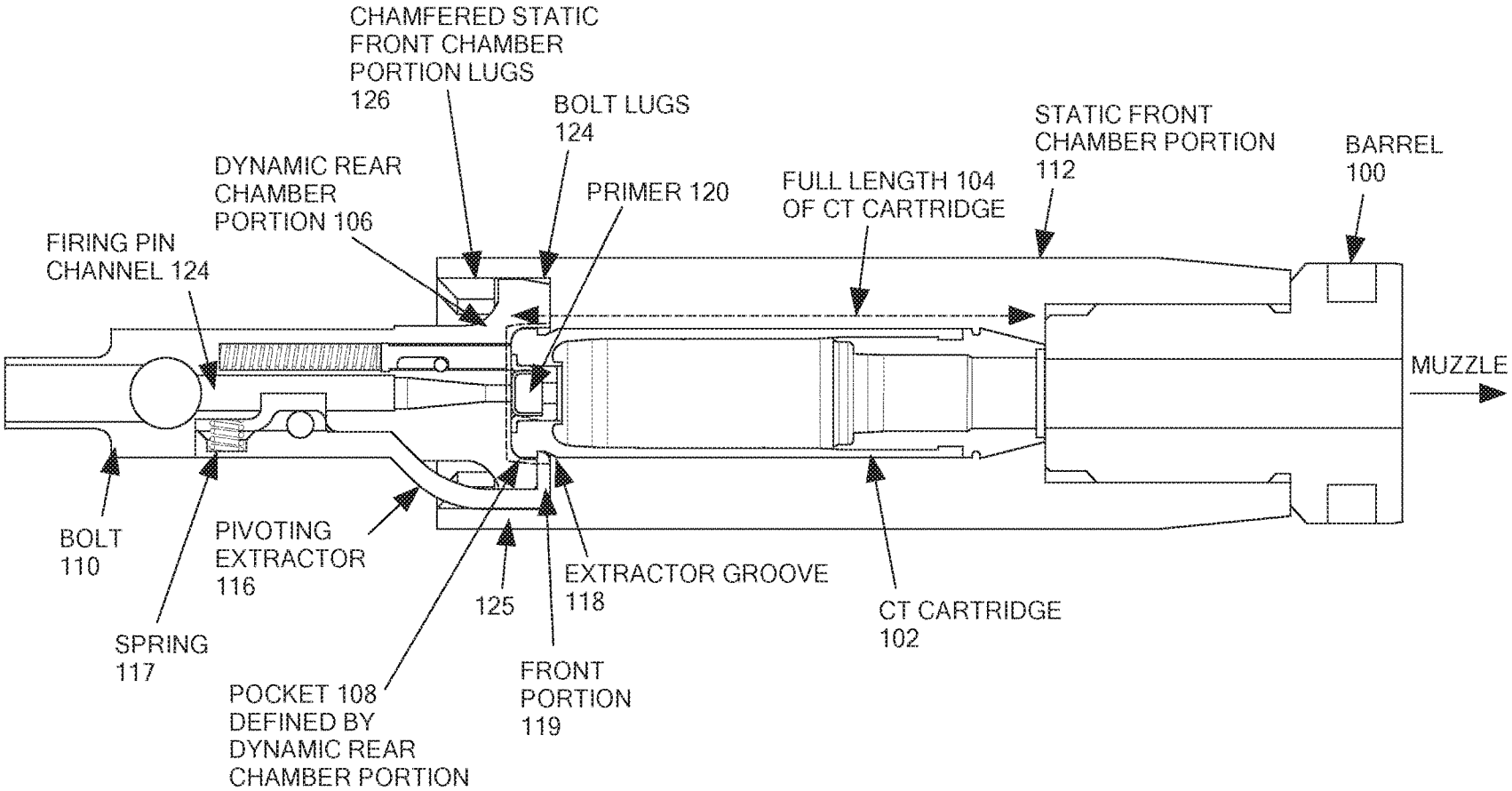
FIG. 6 is a cross-sectional top view of the firearm components of FIG. 1, showing the first example cartridge extraction mechanism, and showing the CT cartridge loaded into a firing position within the split chamber, and also showing the split chamber radially supporting the CT cartridge along a full length of the CT cartridge.
Figure 6A:
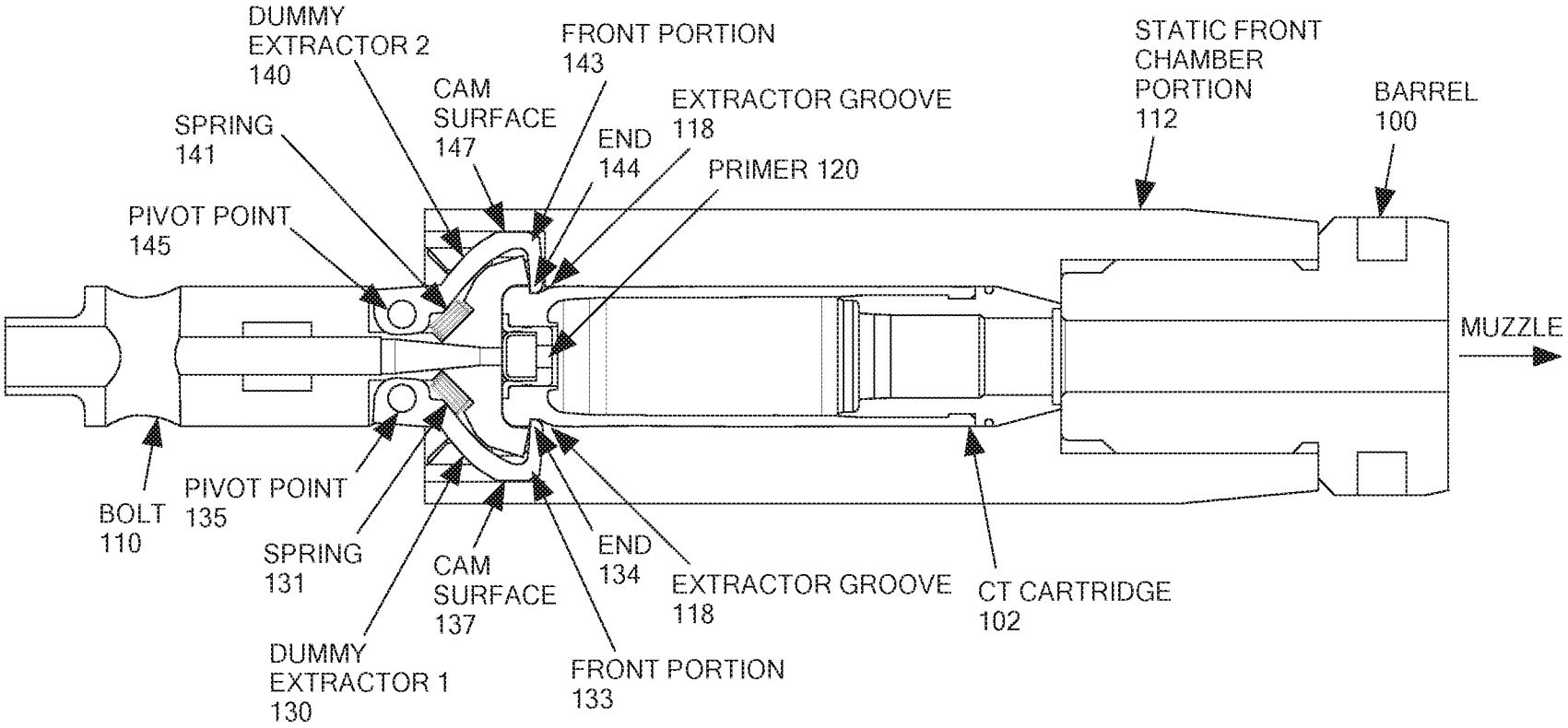
FIG. 6*a* is a cross-sectional view of the firearm components of FIG. 1, rotated laterally 90 degrees from the view shown in FIG. 1 as in FIG. 2*a* and FIG. 5*a*, with the bolt in the same position as shown in FIG. 6, showing the dummy extractors engaged with the CT cartridge in the extractor groove of the CT cartridge when the CT cartridge is loaded into the firing position within the split chamber.

As shown in the example of FIG. 2*a*, and further illustrated in FIG. 5*a* and FIG. 6*a*, Dummy Extractor 1 130 includes a Front Portion 133 and a Cam Surface 137, and Dummy Extractor 2 140 includes a Front Portion 143 and a Cam Surface 147. Like the Pivoting Extractor 119, Dummy Extractor 1 130 and Dummy Extractor 2 140 are engaged with CT Cartridge 102 when CT Cartridge 102 is loaded for firing, i.e. when Cam Surface 137 and Cam Surface 147 are pushed inwards as Bolt 110 is moved forward and locked into Static Front Chamber Portion 112. Unlike the Pivoting Extractor 119, Dummy Extractor 1 130 and Dummy Extractor 2 140 are spring loaded in the open position. Specifically, a Spring 131 pivots Dummy Extractor 1 130 about Pivot Point 131 such that Front Portion 133 is pushed outward from CT Cartridge 102 until Cam Surface 137 is pushed inwards and Spring 131 is overcome as Bolt 110 is moved forward and locked into Static Front Chamber Portion 112, causing End 134 of Front Portion 133 to be pushed into contact with the CT Cartridge 102. Similarly, a Spring 141 pivots Dummy Extractor 2 140 about Pivot Point 145 such that Front Portion 143 is pushed outward from CT Cartridge 102 until Cam Surface 147 is pushed inwards as Spring 141 is overcome as Bolt 110 is moved forward and locked into Static Front Chamber Portion 112, causing End 144 of Front Portion 143 to be pushed into contact with the CT Cartridge 102.

When the CT Cartridge 102 is loaded into the firing position (see FIG. 6*a*), the Front Portion 143 of Dummy Extractor 1 130 and the Front Portion 133 of Dummy Extractor 2 140 are configured to engage with some portion or all of the Extractor Groove 118 in the CT Cartridge 102 that is not engaged by the Front Portion 119 of the Pivoting Extractor 116. Such engagement with some or all of the rest of the Extractor Groove 118 not engaged by Pivoting Extractor 116 by End 134 of Front Portion 133 of Dummy Extractor 1 130 and by End 144 of Front Portion 143 of Dummy Extractor 2 140 while CT Cartridge 102 is loaded in the firing position may advantageously promote symmetric stretching of the polymer case of CT Cartridge 102 during firing, thus significantly preventing the grip of Pivoting Extractor 119 on the CT Cartridge 102 from being compromised prior to extraction of the CT Cartridge 102 by stretching of the polymer case during firing.

When Dummy Extractor 1 130 and Dummy Extractor 2 140 are engaged with the CT Cartridge 102 (see FIG. 6*a*), the End 134 of Front Portion 133 of Dummy Extractor 1 130, and the End 144 of Front Portion 143 of Dummy Extractor 2 140, both contact and provide grip on the Extractor Groove 118 of CT Cartridge 102 that is additional to the grip provided by Pivoting Extractor 116. The grip of Pivoting Extractor 116 and of the dummy extractors on CT Cartridge 102 is used during extraction of CT Cartridge 102 when CT Cartridge 102 is pulled rearward out of the Static Front Chamber Portion 112 when Dynamic Rear Chamber Portion 106 moves rearward after CT Cartridge 102 is fired. Further when Dummy Extractor 1 130 and Dummy Extractor 2 140 are engaged with the CT Cartridge 102 when the CT Cartridge 102 is loaded in the firing position (see FIG. 6*a*), End 134 of Front Portion 133 of Dummy Extractor 1 130 and End 144 of Front Portion 143 of Dummy Extractor 2 140 engage with some portion of the Extractor Groove 118 along a circumference of CT Cartridge 102 that is not engaged by Front Portion 119 of the Pivoting Extractor 116. End 134 of Front Portion 133 of Dummy Extractor 1 130 and/or End 144 of Front Portion 143 of Dummy Extractor 2 140 may be configured to engage with the Extractor Groove 118 in all of the circumference of CT Cartridge 102 in which the Extractor Groove 118 is not engaged by Front Portion 119 of the Pivoting Extractor 116 when the CT Cartridge 102 is in the firing position, or in less than all of the circumference of CT Cartridge 102 in which the Extractor Groove 118 is not engaged by Front Portion 119 of the Pivoting Extractor 116.

Figure 3:
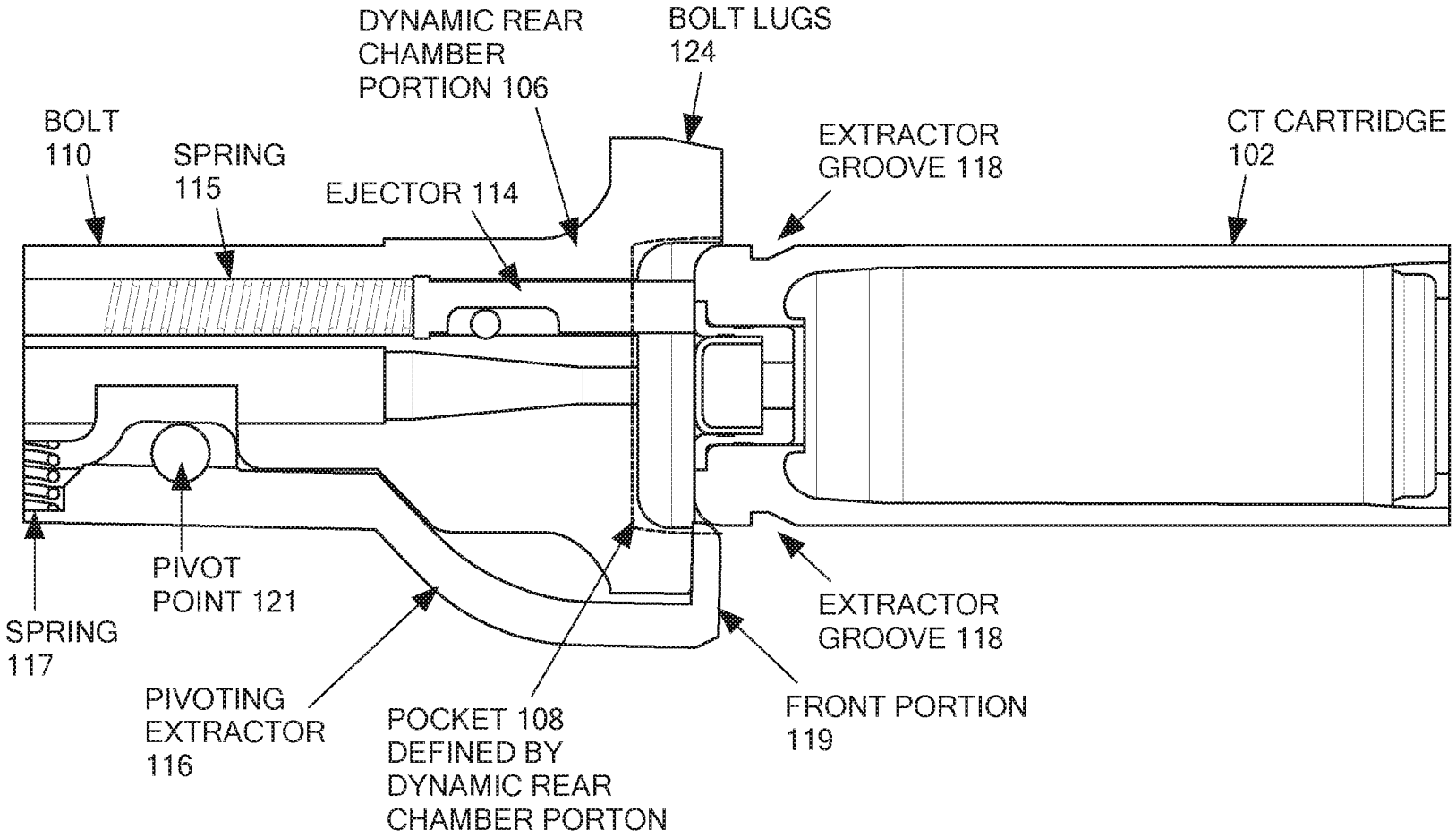
FIG. 3 is a cross-sectional top view of the firearm components of FIG. 1, showing the first example cartridge extraction mechanism, and showing the CT cartridge starting to push the ejector rearward and the pivoting extractor outward, as the bolt continues to move forward to load the CT cartridge.

FIG. 3 is another cross-sectional top view of the firearm components shown in FIG. 1, showing the first example cartridge extraction mechanism, as the Bolt 110 continues to move forward within the firearm while loading CT Cartridge 102. FIG. 3 shows the CT Cartridge 102 continuing to push the Ejector 114 rearward out of the Pocket 108, and continuing to push the Front Portion 119 of Pivoting Extractor 116 laterally out of the Pocket 108.

Figure 4:
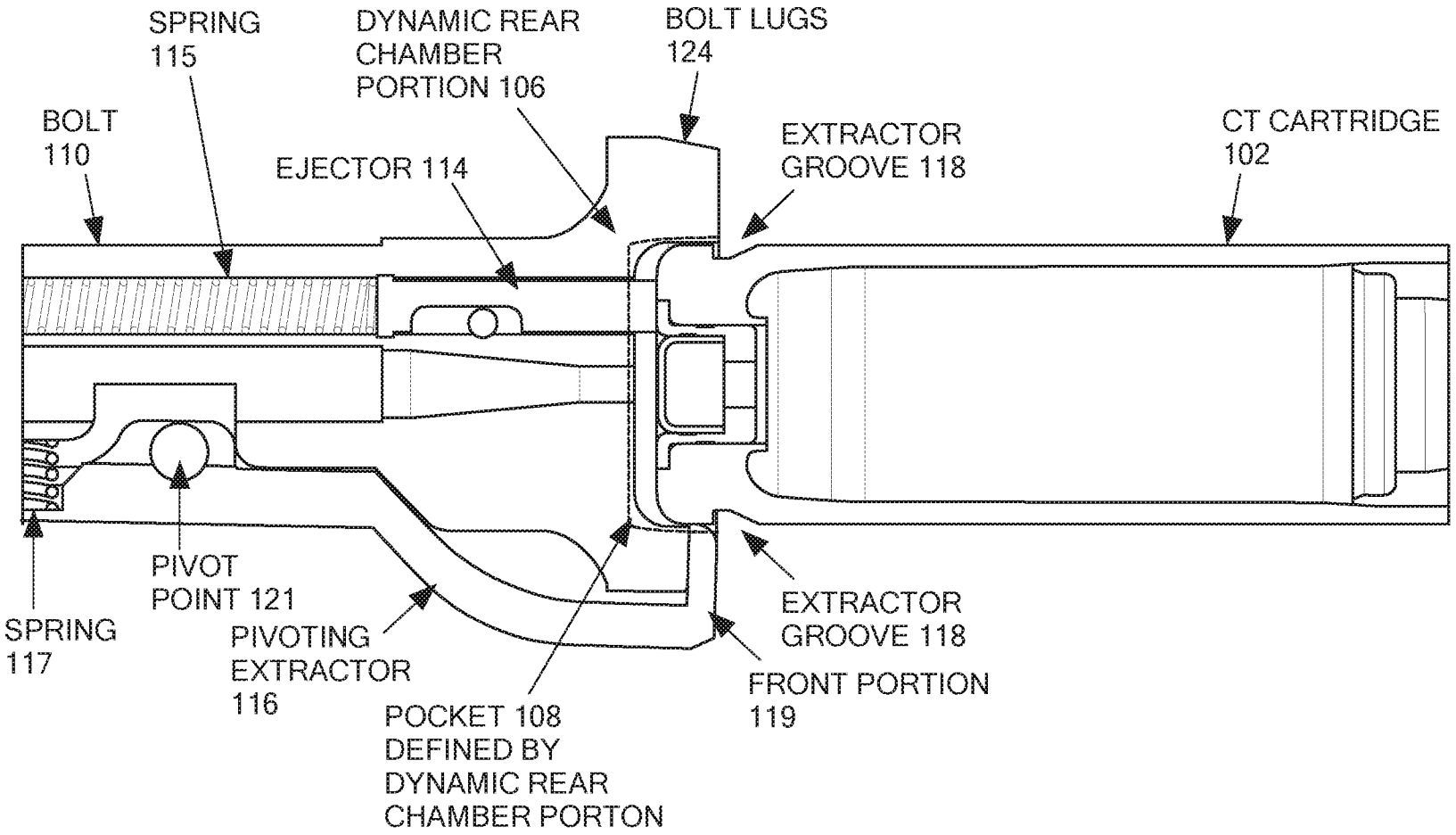
FIG. 4 is a cross-sectional top view of the firearm components of FIG. 1, showing the first example cartridge extraction mechanism, and showing the CT cartridge continuing to push the ejector rearward and the pivoting extractor outward, as the bolt continues to move forward to load the CT cartridge.

FIG. 4 is another cross-sectional top view of the firearm components shown in FIG. 1, showing the first example cartridge extraction mechanism, as the Bolt 110 continues to move forward within the firearm while loading CT Cartridge 102. FIG. 4 shows the CT Cartridge 102 continuing to push the Ejector 114 rearward out of the Pocket 108, and having pushed the Front Portion 119 of the Pivoting Extractor 116 laterally completely out of the Pocket 108.

FIG. 5 is another cross-sectional top view of the firearm components shown in FIG. 1, showing the first example cartridge extraction mechanism, and showing the CT Cartridge 102 pushed deeper into the Pocket 108, such that the CT Cartridge 102 is engaged with the face of the Bolt 110, and with the Spring 117 having caused Pivoting Extractor 116 to pivot causing Front Portion 119 to snap into the Extractor Groove 118 of the CT Cartridge 102, thus engaging the Extractor Groove 118 and beginning to hold CT Cartridge 102 within the Pocket 108.

FIG. 5*a* is a cross-sectional view of the firearm components of FIG. 1, rotated laterally 90 degrees from the view in FIG. 1. In FIG. 5*a*, the Bolt 110 is shown continuing to move forward to load the CT cartridge 102 into Static Front Chamber Portion 112, having moved forward from the position shown in FIG. 5. FIG. 5*a* shows Dummy Extractor 1 130 and Dummy Extractor 2 140 just prior to engagement of Cam Surface 137 and Cam Surface 147 with Static Front Chamber Portion 112. Prior to engagement with the Static Front Portion Chamber Portion 112, no inward pressure is applied to Cam Surface 137 and Cam Surface 147. Accordingly, Spring 131 causes Dummy Extractor 1 130 to pivot about Pivot Point 135 away from engagement with CT Cartridge 102, and Spring 141 causes Dummy Extractor 2 140 to pivot about Pivot Point 145 away from engagement with CT Cartridge 102, prior to engagement of Cam Surface 137 and Cam Surface 147 with Static Front Chamber Portion 112.

FIG. 6 is another cross-sectional top view of the firearm components shown in FIG. 1, showing the first example cartridge extraction mechanism, with the CT Cartridge 102 pushed forward into the firing position within the split chamber, and with the split chamber radially supporting the CT Cartridge 102 along the Full Length 104 of the CT Cartridge 102 prior to firing of CT Cartridge 102. In some embodiments, the Bolt 110 rides forward in a conventional bolt carrier during gas operated auto-loading, and the Bolt Lugs 124 rotate and lock into Chamfered Static Front Chamber Portion Lugs 126. As shown in FIG. 6, Dynamic Rear Chamber Portion 106 and Static Front Chamber Portion 112 meet directly adjacent to the Extractor Groove 118 when the Dynamic Rear Chamber Portion 106 is locked to the Static Front Chamber Portion 112 in firing position. In some embodiments, the width of the polymer case of CT Cartridge 102 may be relatively thicker towards the rear of CT Cartridge 102 than towards the front of CT Cartridge 102, the relatively thicker rearward portion of CT Cartridge 102 including the Extractor Groove 118, in order to reduce polymer case flow when CT Cartridge 102 is fired, to prevent a change in the shape of Extractor Groove 118 that might compromise the engagement of Front Portion 119 with Extractor Groove 118. Front Portion 119 of Pivoting Extractor 116 extends around some portion of a circumference of the radial wall of Pocket 108, and engages with the CT Cartridge 102 entirely within the width of the Extractor Groove 118. In order to prevent the Pivoting Extractor 116 from swinging freely during firing, the Pivoting Extractor 116 may be partially retained by the Static Front Chamber Portion 112 while the CT Cartridge 102 is contained within the split chamber and fired, as shown at reference number 125. In some embodiments, a second pivoting extractor (not shown) may be provided opposite of the Pivoting Extractor 116, in order to further support the CT Cartridge 102 when it is pulled rearwards after firing. In some embodiments, and as shown for example in FIG. 2*a*, FIG. 5*a*, and FIG. 6*a*, the Dynamic Rear Chamber Portion 106 may further include a dummy extractor portion that is configured to engage with some portion or all of the Extractor Groove 118 in the CT Cartridge 102 that is not engaged by the Front Portion 119 of the Pivoting Extractor 116, while the CT Cartridge 102 is in the firing position. Such a dummy extractor filling the rest of the Extractor Groove 118 may advantageously ensure symmetric stretching of the polymer case of CT Cartridge 102 during firing. As also shown in the examples of FIG. 2*a*, FIG. 5*a*, and FIG. 6*a*, the dummy extractor may, for example, be engaged by way of a cam as Bolt 110 moves forward and locks, and may be disengaged from the Extractor Groove 118, e.g. via a spring, once the Dynamic Rear Chamber Portion 106 is withdrawn rearward and clears the Static Front Chamber Portion 112.

When a firing pin strikes the Primer 120 of CT Cartridge 102 (e.g. a firing pin traveling through the Firing Pin Channel 124 of the Bolt 110), and the CT Cartridge 102 is successfully fired, a projectile contained within CT Cartridge 102 is driven forward through Barrel 100 and out a muzzle of Barrel 100. At the time CT Cartridge 102 is fired, a rear portion of CT Cartridge 102 at the base of CT Cartridge 102 is radially (and also in a rearward direction) supported by the Pocket 108 defined by the Dynamic Rear Chamber Portion 106, while the rest of the CT Cartridge 102 is radially supported by the Static Front Chamber Portion 112. In this way, the split chamber radially supports the CT Cartridge 102 along a Full Length 104 of CT Cartridge 102 at the time CT Cartridge 102 is fired, while CT Cartridge 102 is contained in the split chamber.

Prior to firing of CT Cartridge 102, and after CT Cartridge 102 has been loaded into the split chamber, Bolt 110 may advance forward sufficiently to cause the CT Cartridge 102 to be compressed to a compressed length that is less than an initial length of CT Cartridge 102. The initial length of CT Cartridge 102 is a length of CT Cartridge 102 at the time CT Cartridge 102 is initially loaded into the split chamber. In this way, headspace within the split chamber can be controlled and/or eliminated in order to minimize or eliminate extrusion of the cartridge case of CT Cartridge 102 at the base of CT Cartridge 102 and/or of the cartridge endcap of CT Cartridge 102 at the front outer corner of CT Cartridge 102 by eliminating empty volume in the split chamber for material to flow into when CT Cartridge 102 is fired.

In addition, by causing Dynamic Rear Chamber Portion 106 and Static Front Chamber Portion 112 to be tightly coupled together at a point that is directly adjacent to the Extractor Groove 118, gaps in the split chamber are reduced and only allowed where the polymer case material of CT Cartridge 102 is relatively thick. As a result, extrusion of flowing case material from the split chamber when CT Cartridge 102 is fired may be prevented. Because the Front Portion 119 of Pivoting Extractor 116 is engaged in the Extractor Groove 118 at the time of firing, groove deformation that could otherwise exclude engagement is prevented. In some embodiments, the Front Portion 119 may extend around a relatively greater proportion of the cartridge circumference than extractors used in traditional metal case firearms. In addition, an arc of the surface at the end of the Front Portion 119 may be configured to match a contour of an inner surface of the Extractor Groove 118. As the Bolt 110 rotates after firing of CT Cartridge 102, the Bolt Lugs 124 are disengaged and slip rearwards through matching cut outs between the Chamfered Static Front Chamber Portion Lugs 126.

FIG. 6*a* is a cross-sectional view of the firearm components of FIG. 1, rotated laterally 90 degrees from the view shown in FIG. 1. In FIG. 6*a*, the Bolt 110 is in the same position as shown in FIG. 6, with the CT Cartridge 102 pushed forward into the firing position within the split chamber, and with the split chamber radially supporting the CT Cartridge 102 along the full length of the CT Cartridge 102 prior to firing of CT Cartridge 102. FIG. 6*a* shows Dummy Extractor 1 130 and Dummy Extractor 2 140 engaged with the CT Cartridge 102. Specifically, as Bolt 110 moved forward to load CT Cartridge 102, Static Front Chamber Portion 112 put inward pressure on Cam Surface 137, causing Spring 131 to be overcome and Dummy Extractor 1 130 to pivot about Pivot Point 135 such that End 134 of Front Portion 133 became engaged with Extractor Groove 118 when CT Cartridge 102 reached the firing position within the split chamber. Similarly, also as Bolt 110 moved forward to load CT Cartridge 102, Static Front Chamber Portion 112 put inward pressure on Cam Surface 147, causing Spring 141 to be overcome and Dummy Extractor 2 140 to pivot about Pivot Point 135 such that End 134 of Front Portion 133 also became engaged with Extractor Groove 118 when CT Cartridge 102 reached the firing position within the split chamber.

By providing additional engagement with Extractor Groove 118 at the time of firing, dummy extractors such as Dummy Extractor 1 130 and Dummy Extractor 2 140 may prevent deformation of Extractor Groove 118 that could otherwise compromise extraction of CT Cartridge 102 from Static Front Chamber Portion 112 after firing. By filling some or all of the rest of the Extractor Groove 118, dummy extractors such as Dummy Extractor 1 130 and/or Dummy Extractor 2 140 may advantageously ensure symmetric stretching of the polymer case of CT Cartridge 102 during firing, so that the grip of Pivoting Extractor 116 on the CT Cartridge 102 is not compromised prior to extraction.

In some embodiments, like the arc of the surface at the end of the Front Portion 119 of Pivoting Extractor 116 in some embodiments, an arc of the surface at the End 134 of Front Portion 133 of Dummy Extractor 1 130 may be configured to match a contour of an inner surface of the Extractor Groove 118. Similarly, an arc of the surface at the End 144 of Front Portion 143 of Dummy Extractor 2 140 may also be configured to match the contour of an inner surface of the Extractor Groove 118.

After CT Cartridge 102 is fired, Dummy Extractor 1 130 and Dummy Extractor 2 140 are disengaged from CT Cartridge 102 at the time that the Dynamic Rear Chamber Portion 106 is withdrawn rearward and clears the Static Front Chamber Portion 112. At that time, as the CT Cartridge 102 is moved rearward of the Static Front Chamber Portion 112, the inward pressure from Static Front Chamber Portion 112 on Cam Surface 137 is removed when Cam Surface 137 clears the Static Front Chamber Portion 112, and Spring 131 causes Dummy Extractor 1 130 to pivot about Pivot Point 135 such that Front Portion 133 is moved out of contact with CT Cartridge 102. Similarly after firing of CT Cartridge 102, when Cam Surface 137 clears the Static Front Chamber Portion 112, the inward pressure from Static Front Chamber Portion 112 on Cam Surface 147 is removed, and Spring 141 causes Dummy Extractor 2 140 to pivot about Pivot Point 145 such that Front Portion 143 is moved out of contact with CT Cartridge 102. When both Dummy Extractor 1 130 and Dummy Extractor 2 140 are thus disengaged from CT Cartridge 102 after firing, CT Cartridge 102 can be ejected from Pocket 108 and completely disengaged from the Dynamic Rear Chamber Portion 106, allowing the CT Cartridge 102 to be ejected from an ejection position of the firearm (see FIGS. 7-11).

Figure 7:
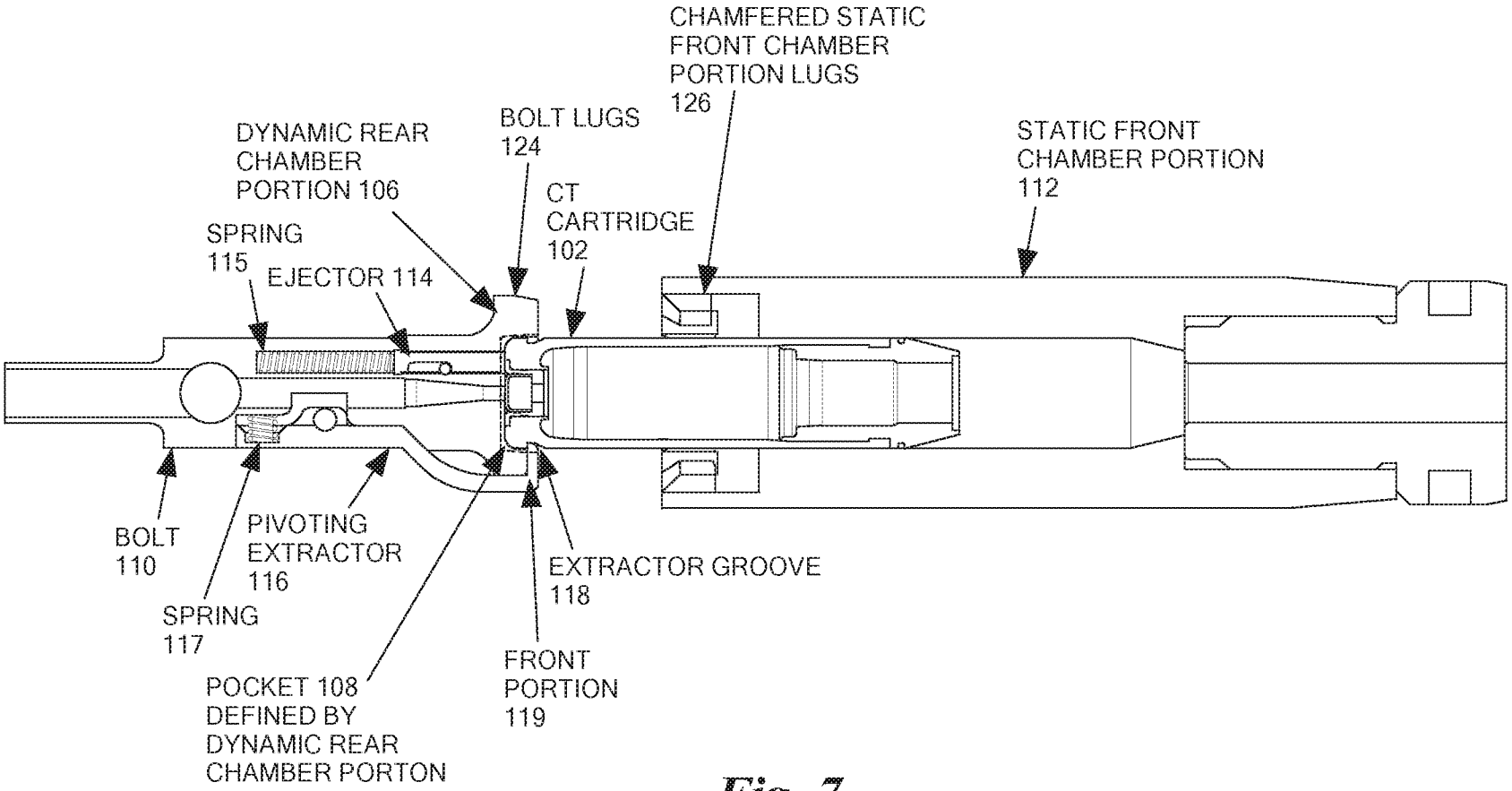
FIG. 7 is a cross-sectional top view of the firearm components of FIG. 1, showing the first example cartridge extraction mechanism, after firing of the CT cartridge, and showing the bolt having been unlocked from the static front chamber portion and beginning to move rearward during recoil, and showing the CT cartridge held in the pocket defined in the bolt face in order to extract the CT cartridge from the static front chamber portion.

FIG. 7 is another cross-sectional top view of the firearm components shown in FIG. 1, showing the first example cartridge extraction mechanism, after firing of the CT Cartridge 102, with the Bolt 110 having been unlocked and beginning to move rearward, e.g. during recoil. After firing, the CT Cartridge 102 is initially held in the Pocket 108 by the engagement of Front Portion 119 of Pivoting Extractor 116 with the Extractor Groove 118, at the time the Bolt 110 begins moving rearward during recoil. In this way CT Cartridge 102 may be pulled rearward out of the Static Front Chamber Portion 112 as the Bolt 110 begins moving rearward during recoil.

Figure 8:
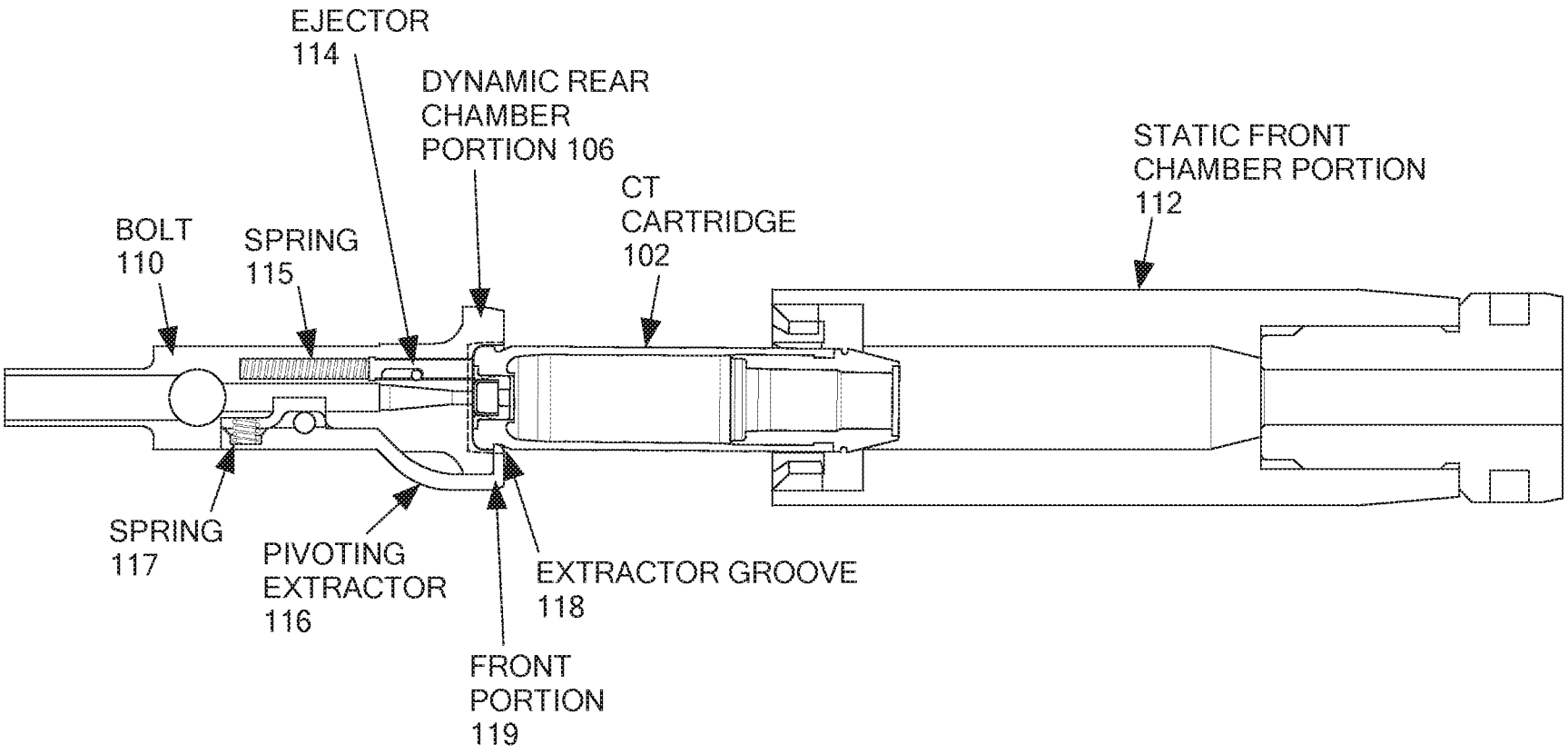
FIG. 8 is a cross-sectional top view of the firearm components of FIG. 1, showing the first example cartridge extraction mechanism, and showing the bolt continuing to move rearward, with the CT cartridge beginning to encounter radial clearance outside of the static front chamber portion, and showing the pivoting extractor still engaged with the extractor groove in the CT cartridge.

FIG. 8 is another cross-sectional top view of the firearm components shown in FIG. 1, showing the first example cartridge extraction mechanism, with the Bolt 110 continuing to move rearward during recoil. As CT Cartridge 102 is pulled out of Static Front Chamber Portion 112, CT Cartridge 102 begins to encounter radial clearance, and the Ejector 114 pushes against the rear side of CT Cartridge 102 in order to gradually cause CT Cartridge 102 to be ejected from Pocket 108.

Figure 9:
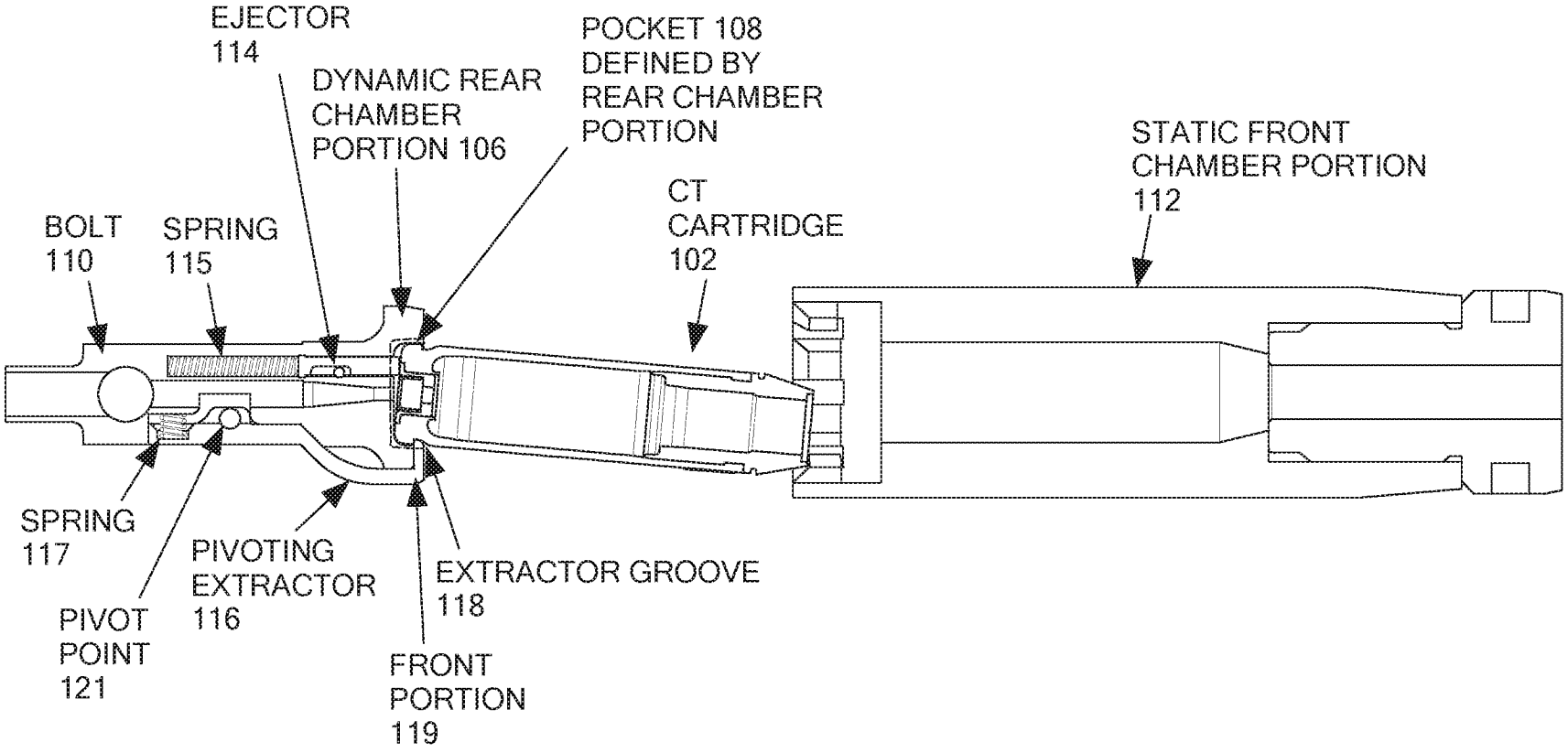
FIG. 9 is a cross-sectional top view of the firearm components of FIG. 1, showing the first example cartridge extraction mechanism, and showing the bolt continuing to move rearward, with the radial clearance of the CT cartridge continuing to increase, allowing the ejector to push the CT cartridge out of the pocket defined by the dynamic rear chamber portion, causing the CT cartridge to push the pivoting extractor out of the pocket.

FIG. 9 is another cross-sectional top view of the firearm components shown in FIG. 1, showing the first example cartridge extraction mechanism, with the Bolt 110 continuing to move rearward during recoil, and showing the radial clearance of the CT Cartridge 102 continuing to increase as CT Cartridge 102 is pulled out of the Static Front Chamber Portion 112. While the radial clearance of CT Cartridge 102 increases, Ejector 114 gradually pushes CT Cartridge 102 forward out of the Pocket 108, which causes CT Cartridge 102 to push Front Portion 119 of Pivoting Extractor 116 laterally out of the Pocket 108 as the Pivoting Extractor 116 pivots around the Pivot Point 121.

Figure 10:
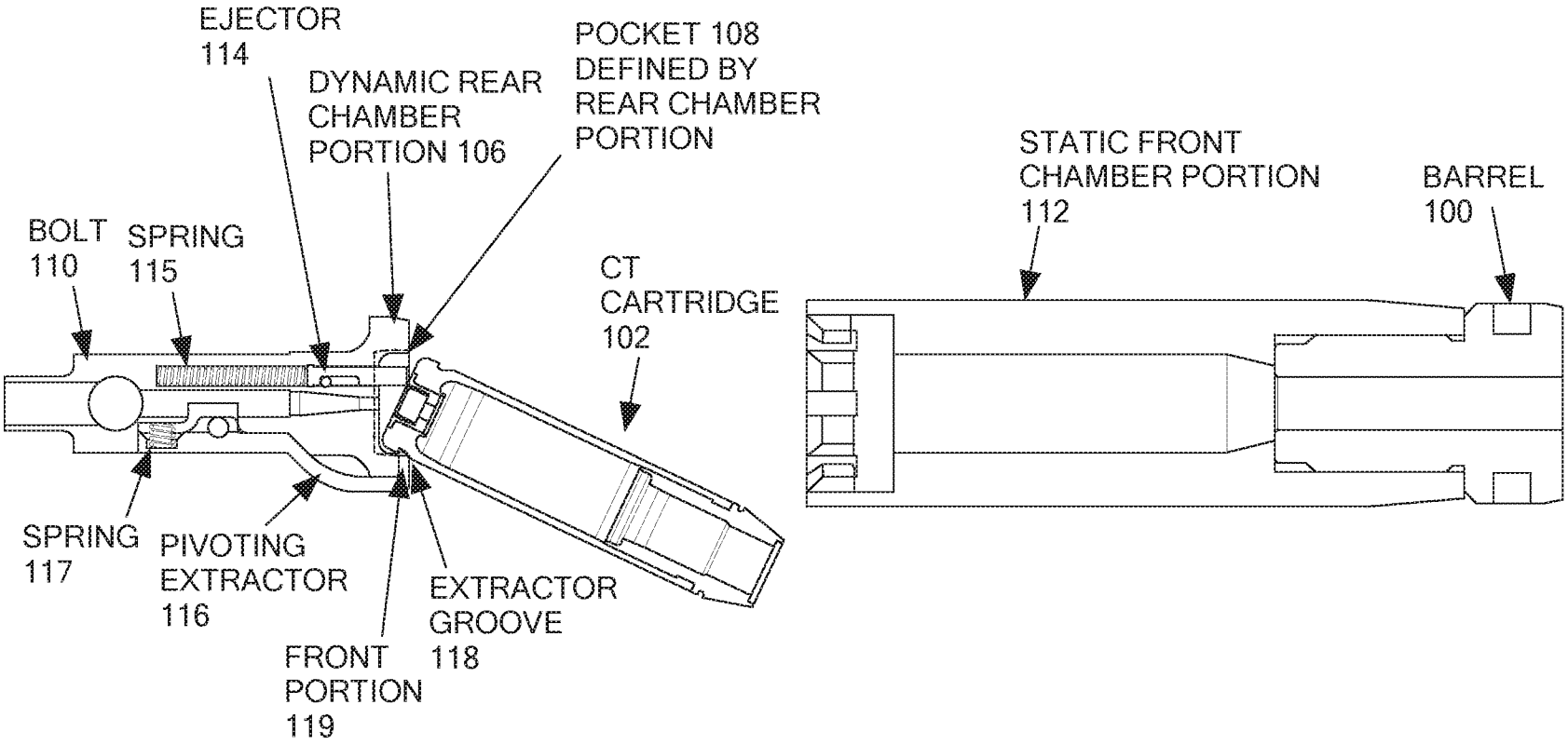
FIG. 10 is a cross-sectional top view of the firearm components of FIG. 1, showing the first example cartridge extraction mechanism, and showing the bolt continuing to move rearward, with the CT cartridge pulled rearward completely clear of the static front chamber portion, allowing the ejector to reach its full stroke, causing the pivoting extractor to be pushed completely out of the pocket.

FIG. 10 is another cross-sectional top view of the firearm components shown in FIG. 1, showing the first example cartridge extraction mechanism, with the Bolt 110 continuing to move rearward during recoil, and showing the CT Cartridge 102 pulled rearward completely clear of the Static Front Chamber Portion 112, thus allowing the Ejector 114 to reach its full stroke into the Pocket 108, which causes the CT Cartridge 102 to push the Front Portion 119 of Pivoting Extractor 116 completely out of the way of CT Cartridge 102, e.g. completely out of the Pocket 108.

Figure 11:
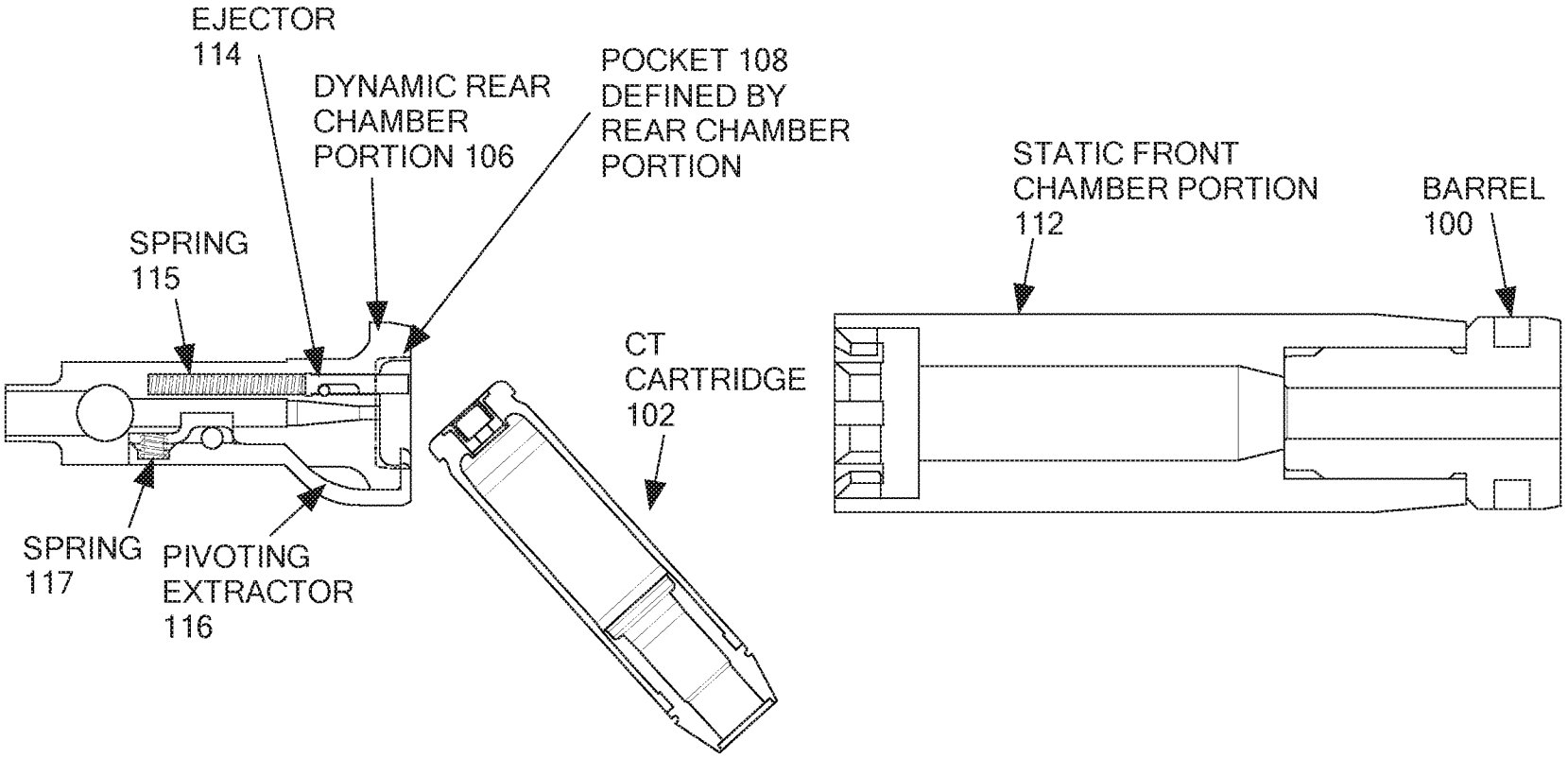
FIG. 11 is a cross-sectional top view of the firearm components of FIG. 1, showing the first example cartridge extraction mechanism, with the bolt continuing to move rearward, and showing the CT cartridge completely disengaged from the dynamic rear chamber portion, allowing the CT cartridge to be ejected from the firearm, and allowing the pivoting extractor to return to its initial position.

FIG. 11 is another cross-sectional top view of the firearm components shown in FIG. 1, showing the first example cartridge extraction mechanism, and showing the CT Cartridge 102 completely disengaged from the Dynamic Rear Chamber Portion 106, at which point the CT Cartridge 102 has reached an ejection position within the firearm. As further shown in FIG. 11, the CT Cartridge 102 has been ejected from the Pocket 108, thus allowing the CT Cartridge 102 to be ejected from the firearm, e.g. out of a lateral ejection port located at the ejection position of the firearm. In some embodiments, Ejector 114 may cause the CT Cartridge 102 to be ejected from both the Pocket 108 and from the firearm. In other embodiments, a second ejector mechanism may be used to eject the CT Cartridge 102 from the firearm after Ejector 114 has ejected the CT Cartridge 102 from Pocket 108. In FIG. 11, the Pivoting Extractor 116 is shown having returned to its initial position in preparation for loading another CT cartridge.

Figure 12:
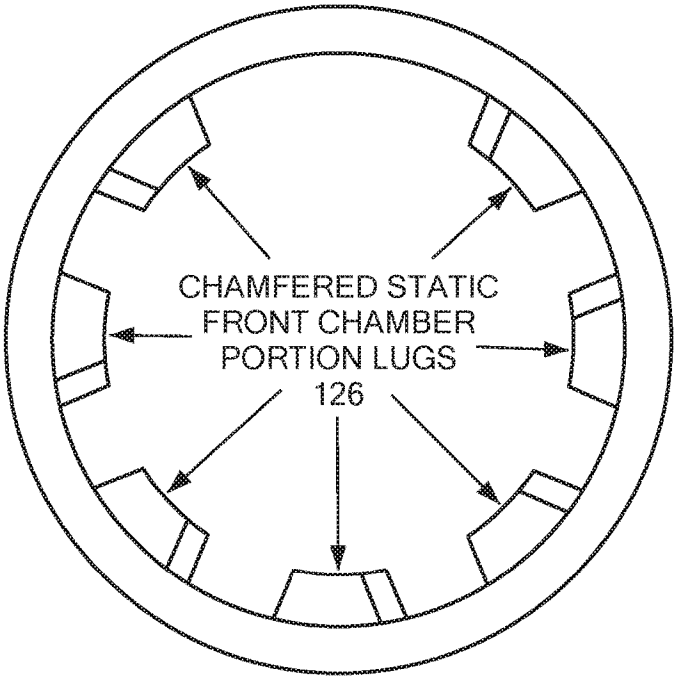
FIG. 12 shows an example of chamfered lugs that may be provided at the rear of the static front chamber portion of the split chamber to engage with the rotating bolt lugs located at the front of the dynamic front chamber portion of the split chamber.

FIG. 12 shows an example of Chamfered Static Front Chamber Lugs 126 that may be used in the rear of the Static Front Chamber Portion 112 to engage with Bolt Lugs 124 at the front of the Dynamic Rear Chamber Portion 106 as the bolt moves forward, rotates, and locks into the firing position prior to firing of the loaded CT cartridge. The Bolt Lugs 124 require the chamfered edges of Chamfered Static Front Chamber Lugs 12 to guide the CT cartridge forward as it rotates, so that the narrow window of clearance does not need to be maintained mechanically.

Figure 13:
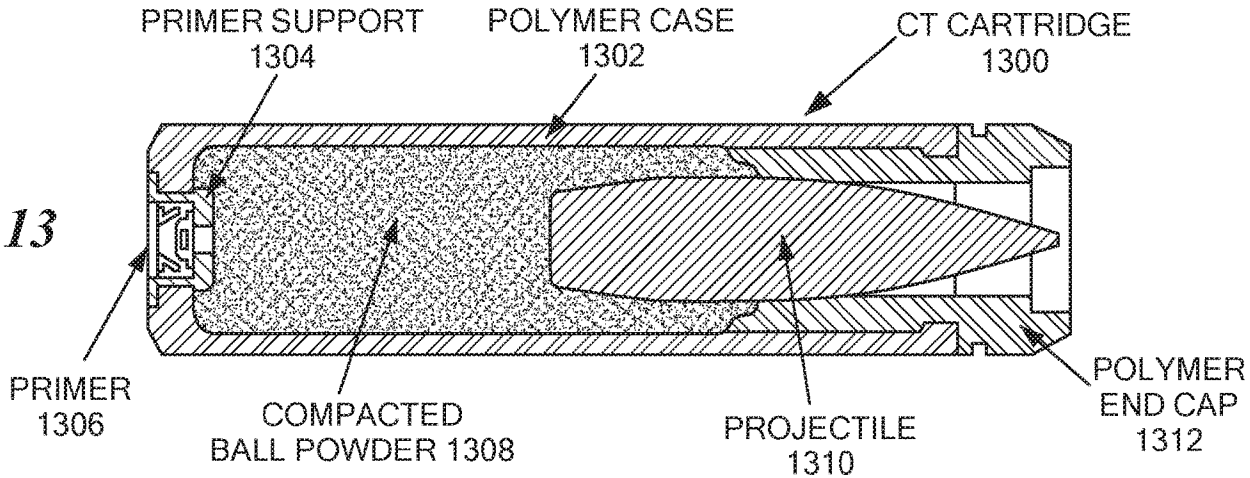
FIG. 13 shows a cross-sectional top view of a first example of a CT cartridge.

FIG. 13 shows a cross-sectional top view of a first example of a CT cartridge, e.g. CT Cartridge 1300. As shown in FIG. 13, the example CT Cartridge 1300 may include a Polymer Case 1302, Primer Support 1304, Primer 1306, Compacted Ball Powder 1308, a Projectile 1310, and a Polymer End Cap 1312.

Figure 14:
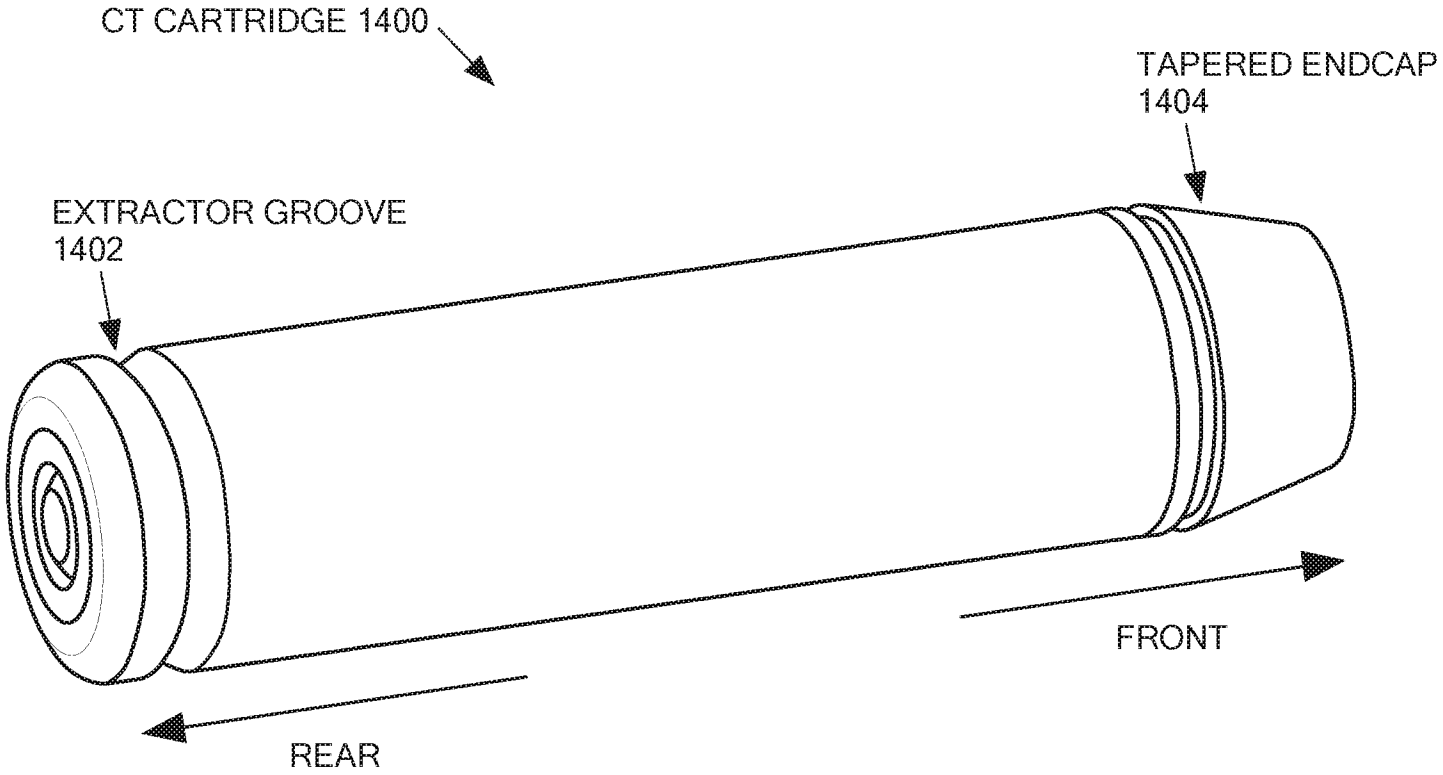
FIG. 14 shows a second example of a CT cartridge, in which the CT cartridge has an extractor groove and a tapered endcap.

FIG. 14 shows a second example of a CT cartridge. In the example of FIG. 14, CT Cartridge 1400 is shown additionally having an Extractor Groove 1402, and a Tapered Endcap 1404. In some embodiments, the thickness of the polymer case of CT Cartridge 1400 may be relatively greater towards the rear of CT Cartridge 1400, including a relatively higher thickness in a rearward portion of the polymer case that includes the Extractor Groove 1402.

Figure 15:
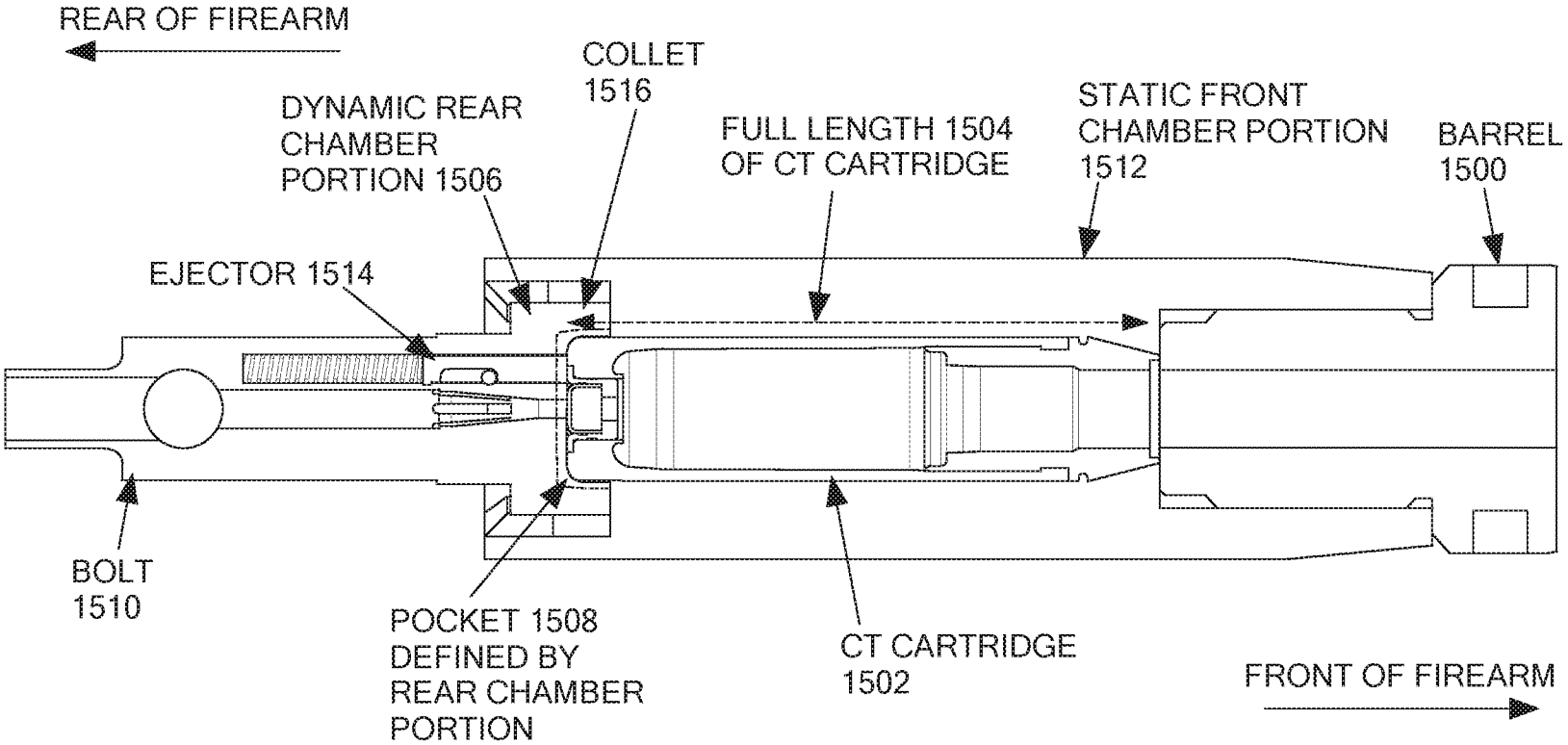
FIG. 15 is a cross-sectional top view of components in a firearm that is configured to fire cased telescoped (CT) ammunition cartridges and having a split chamber, showing a second example of a cartridge extraction mechanism, the second example of a cartridge extraction mechanism including a collet clamping mechanism, and also showing a CT cartridge in firing position.

FIG. 15 is a cross-sectional top view of components in a firearm that is configured to fire cased telescoped (CT) ammunition cartridges and having a split chamber, showing a second example of a cartridge extraction mechanism. The second example of a cartridge extraction mechanism includes a clamping mechanism that includes a Collet 1516. As further described below, in some embodiments, the collet clamping mechanism of the second example cartridge extraction mechanism may be actuated by a forcing cone or camming surface that would reduce the exterior diameter of the interface of Collet 1516 to CT Cartridge 1502 with forward motion (e.g. during counter recoil) of the Dynamic Rear Chamber Portion 1506. In such embodiments, rearward motion of the Dynamic Rear Chamber Portion 1506 (e.g. during recoil) would allow the collet clamping mechanism to expand in preparation for ejection of CT Cartridge 1502.

FIG. 15 shows a CT Cartridge 1502 in firing position within a split chamber. The split chamber shown in FIG. 15 is also configured to radially support CT Cartridge 1502 along a Full Length 1504 of CT Cartridge 1502 when CT Cartridge 1502 is fired. The split chamber in the example of FIG. 15 includes a Dynamic Rear Chamber Portion 1506 defining a Pocket 1508 in a bolt face of the Bolt 1510. The Bolt 1510 operates by moving forward in the firearm to load the CT Cartridge 1502 into the split chamber for firing, e.g. during counter recoil phase while performing gas-operated automatic reloading of the firearm. The Dynamic Rear Chamber Portion 1506 may consist of or include some front portion of the Bolt 1510, including for example a bolt face of the Bolt 1510, such that a Pocket 1508 is defined as a concave surface within the bolt face of Bolt 1510.

The split chamber in the example of FIG. 15 also includes a Static Front Chamber Portion 1512 that is integral to the Barrel 1500 of the firearm. The Static Front Chamber Portion 1512 is mechanically separate from the Bolt 1510, such that the Bolt 1510 moves independently from the Static Front Chamber Portion 1512 during recoil and counter recoil. The Static Front Chamber Potion 1512 may, for example, consist of or include a rear portion of the Barrel 1500, and/or a piece that is fixedly attached to the Barrel 1500.

As shown in FIG. 15, the second example CT cartridge extraction mechanism may include Collet 1516. As further shown in FIGS. 16-20 and further described below, Collet 1516 may be configured a) to engage the CT Cartridge 1502 prior to CT Cartridge 1502 being fired, and b) to hold the CT Cartridge 1502 in the Pocket 1508 of the bolt face of the Bolt 1510 after the CT Cartridge 1502 is fired, as the Bolt 1510 moves rearward (e.g. during recoil), in order to move the CT Cartridge 1502 rearward out of the Static Front Chamber Portion 1512 and into an ejection position. An Ejector 1514 may be configured to eject the CT Cartridge 1502 from the Pocket 1508 upon the CT Cartridge 1502 being moved into the ejection position, so that the CT Cartridge 1502 can be ejected from the firearm.

The Dynamic Rear Chamber Portion 1506 is configured to contain, within the Pocket 1508, the pressure generated within the split chamber when the CT Cartridge 1502 is fired. The Bolt 1510 may be further configured to move, after the Collet 1516 is engaged with the CT Cartridge 1502 while the CT Cartridge 1502 is located within the split chamber and prior to firing of the CT Cartridge 1502, to compress the CT Cartridge 1502 to a length that is less than an initial length of the CT Cartridge 1502. The initial length of CT Cartridge 1502 is a length of CT Cartridge 1502 when CT Cartridge 1502 is initially loaded into the split chamber. The Collet 1516 is further operable to release the CT Cartridge 1502 upon the CT Cartridge 1502 being moved rearward into an ejection position, e.g. to allow the Ejector 1514 to push the CT Cartridge 1502 out of the Pocket 1508, and in some embodiments out of the firearm.

Figure 16:
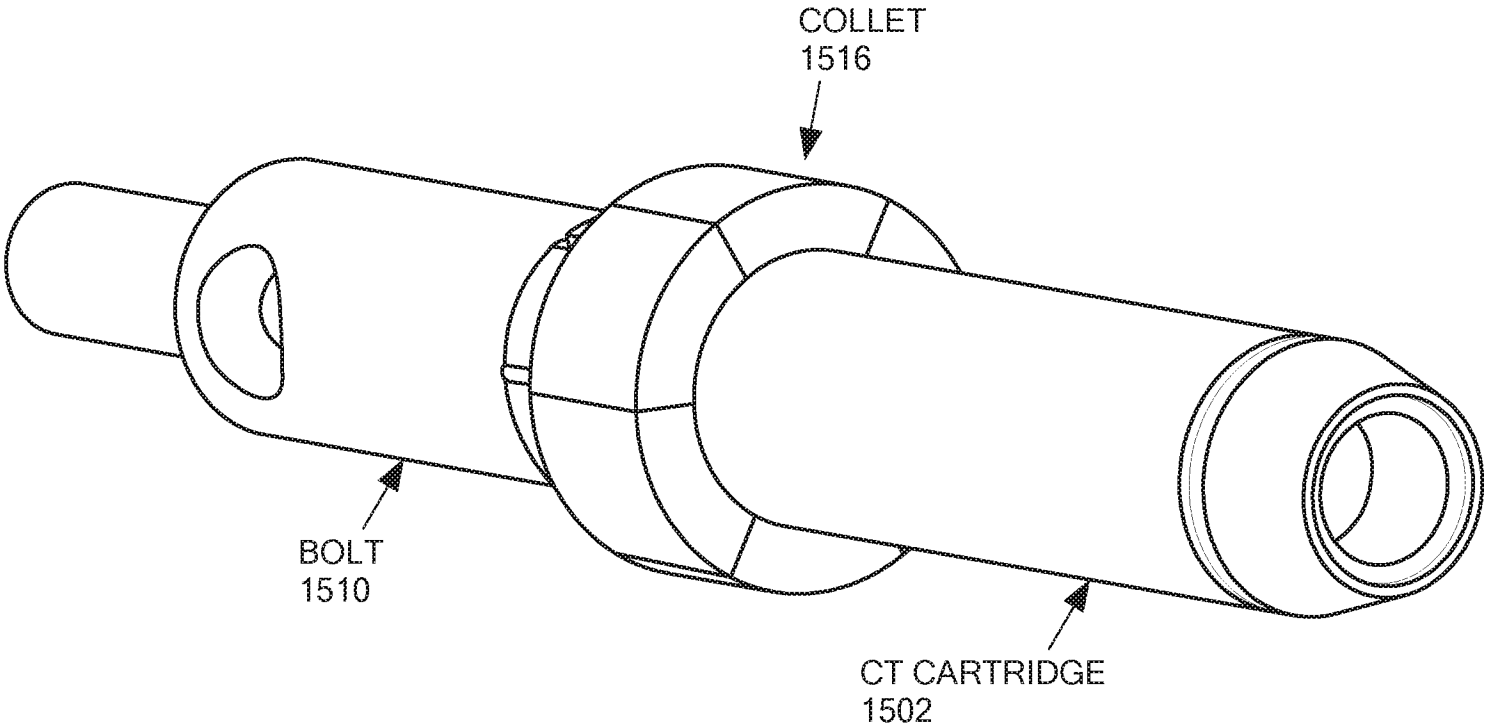
FIG. 16 shows an example of a collet clamping mechanism clamped down onto a CT cartridge.

FIG. 16 shows an example of a collet clamping mechanism clamped down on a CT cartridge. As shown in FIG. 16, Collet 1516 is part of a forward portion of Bolt 1510 (e.g. part of Dynamic Rear Chamber Portion 1506 shown in FIG. 17), and is shown closed on CT Cartridge 1502. The engagement of Collet 1516 with the CT Cartridge 1502 shown in FIG. 16 may be initiated when CT Cartridge 1502 is loaded into the firing position, and maintained while CT Cartridge 1502 is fired. The engagement of Collet 1516 with CT Cartridge 1502 shown in FIG. 16 holds CT Cartridge 1502 in the Pocket 1508 while the CT Cartridge 1502 is pulled rearward to extract the CT Cartridge 1502 from the Static Front Chamber Portion 1512, e.g. during recoil.

Figure 17:
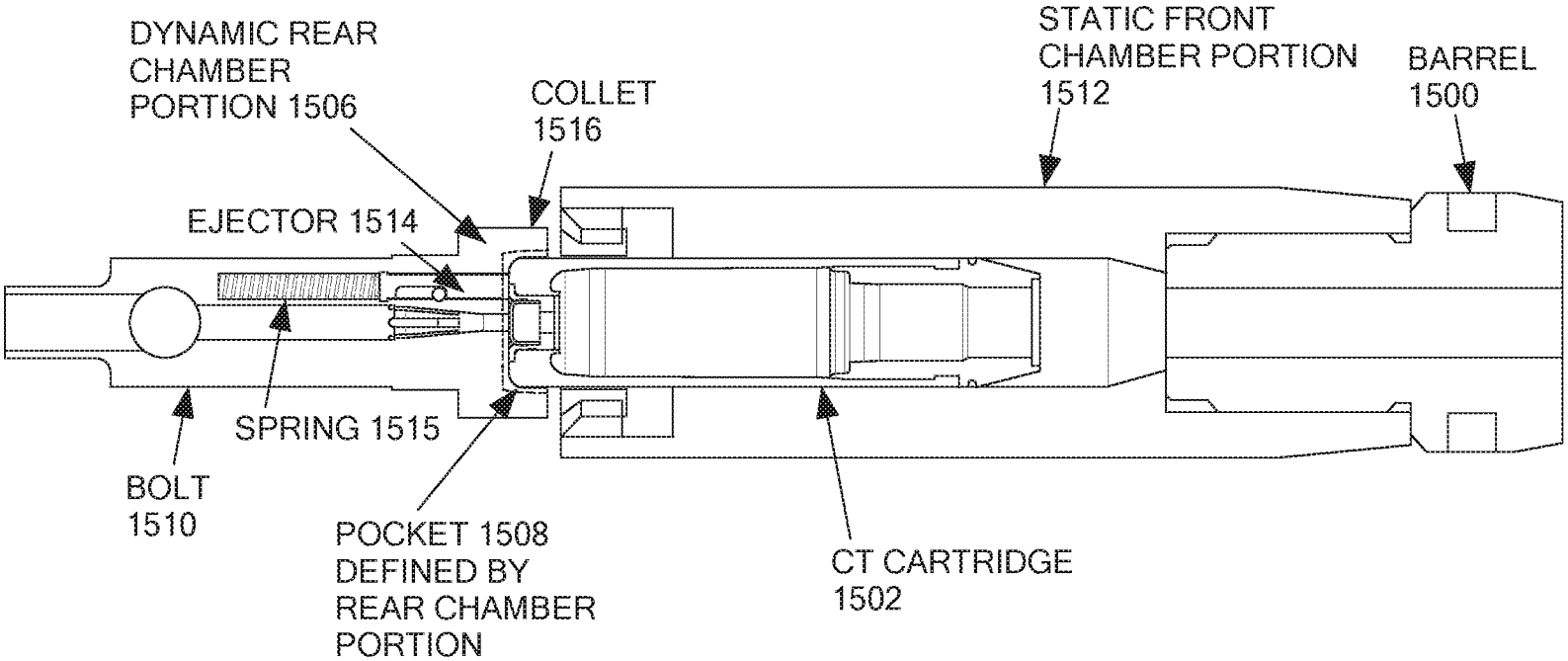
FIG. 17 is a cross-sectional top view of the firearm components of FIG. 15, after firing of the CT cartridge, with the bolt having been unlocked and beginning to move rearward during recoil with the CT cartridge held in the pocket defined in the bolt face in order to extract the CT cartridge from the static front chamber portion.

FIG. 17 is a cross-sectional top view of the firearm components shown in FIG. 15, after firing of the CT Cartridge 1502, with the Bolt 1510 having been unlocked and beginning to move rearward during recoil, and showing the CT Cartridge 1502 held in the Pocket 1508 by the Collet 1516 as the CT Cartridge 1502 is pulled rearward out of the Static Front Chamber Portion 1512.

Figure 18:
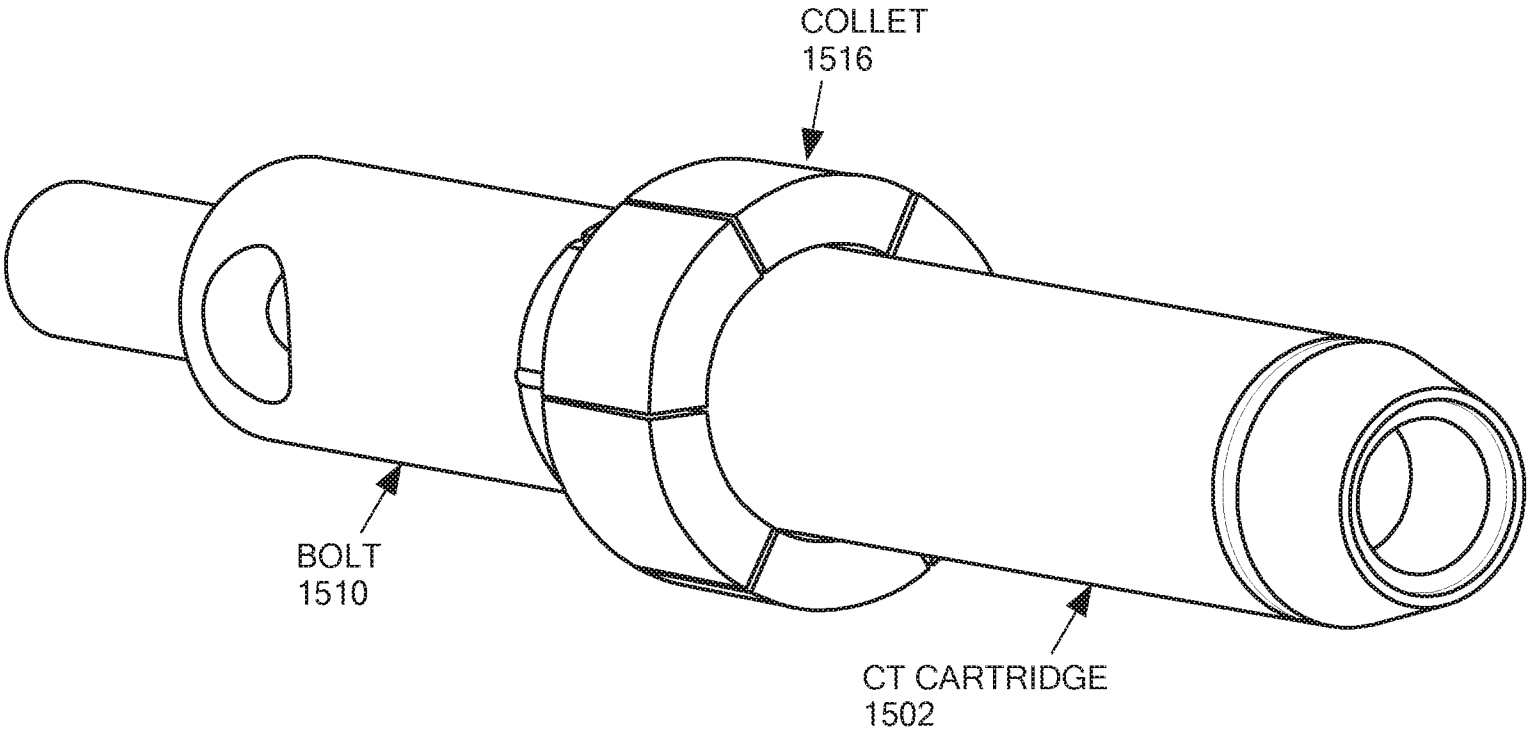
FIG. 18 shows an example of a collet clamping mechanism unclamping from the CT cartridge.

FIG. 18 shows an example showing the Collet 1516 unclamping from the CT Cartridge 1502. For example, Collet 1516 may disengage from CT Cartridge 1502 by unclamping as the Bolt 1510 moves rearward during recoil, e.g. in order to release the CT Cartridge 1502 when the CT Cartridge 1502 has been pulled rearward out of the Static Front Chamber Portion 1512 and into an ejection position within the firearm so that the CT Cartridge 1502 can be ejected.

Figure 19:
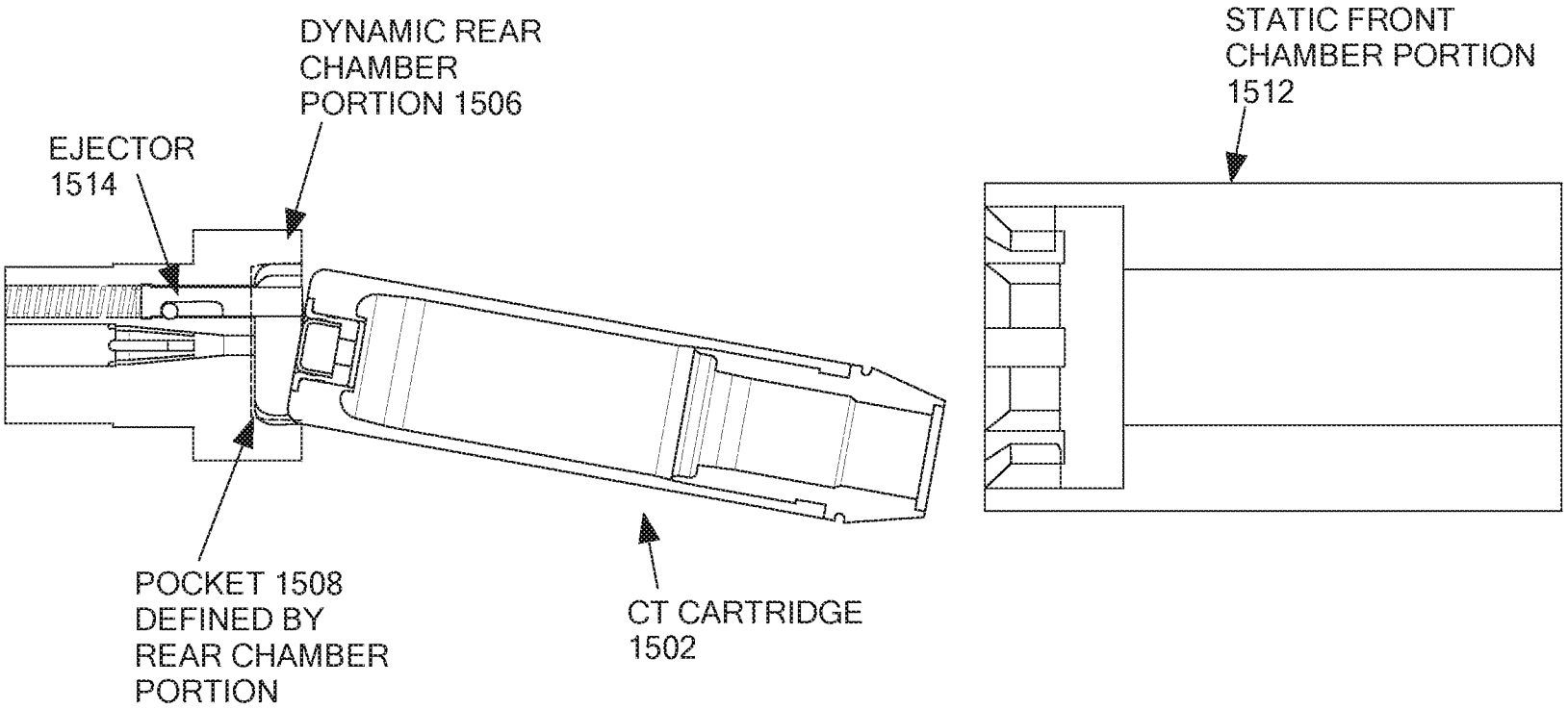
FIG. 19 is a cross-sectional view of the firearm components of FIG. 15, showing an example in which an ejector pin is ejecting the CT cartridge from the pocket defined in the bolt face when the collet clamping mechanism is unclamped.

FIG. 19 is a cross-sectional view of the firearm components shown in FIG. 15, showing an example in which the Ejector 1514 is ejecting the CT cartridge from the Pocket 1508 after the collet clamping mechanism holding the CT Cartridge 1502 in the Pocket 1508 has unclamped from the CT Cartridge 1502.

Figure 20:
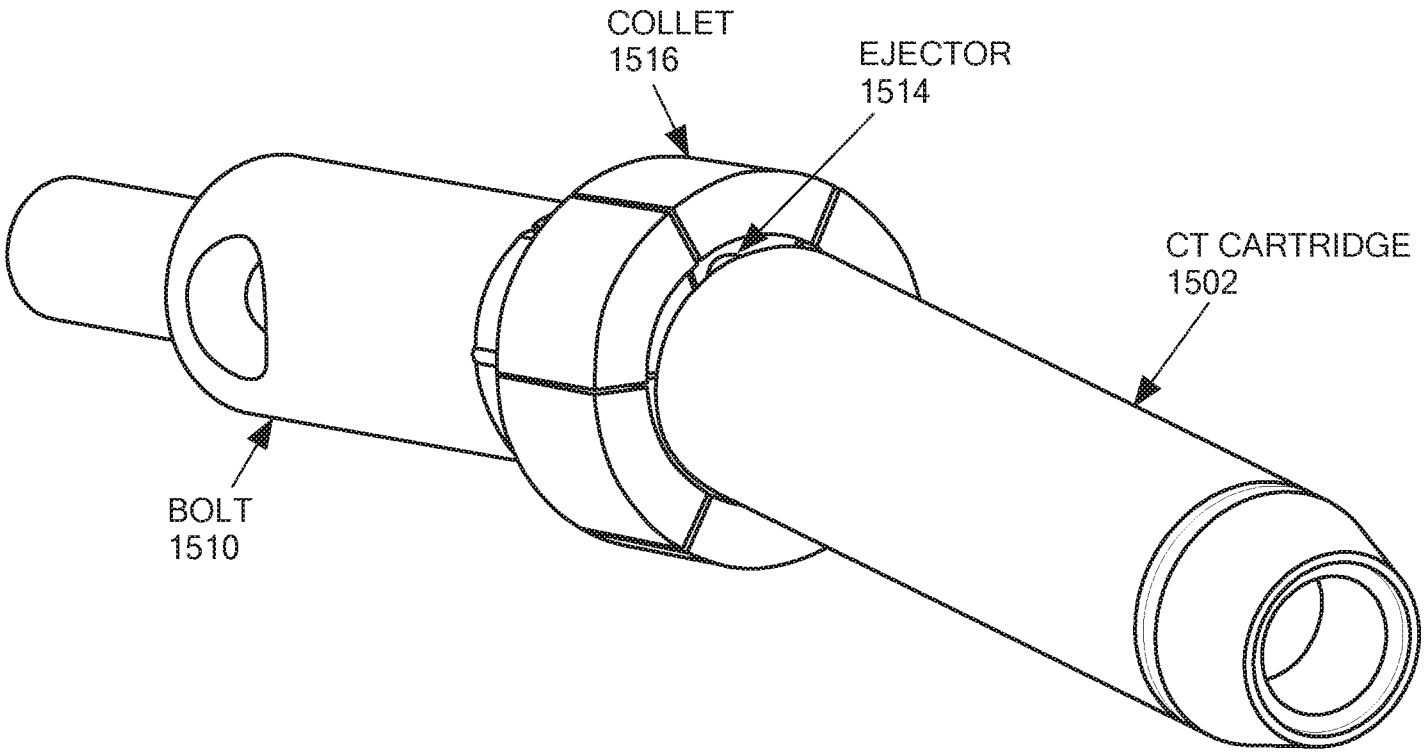
FIG. 20 shows an example of a collet clamping mechanism unclamping from the CT cartridge and an ejector pin ejecting the CT cartridge from the pocket defined in the bolt face when the collet clamping mechanism is unclamped.

FIG. 20 shows an example of the Collet 1516 unclamping from the CT Cartridge 1502, and also showing Ejector 1514 ejecting the CT Cartridge 1502 from the Pocket 1508 defined in the face of Bolt 1510 when the Collet 1516 is unclamped.

Figure 21:
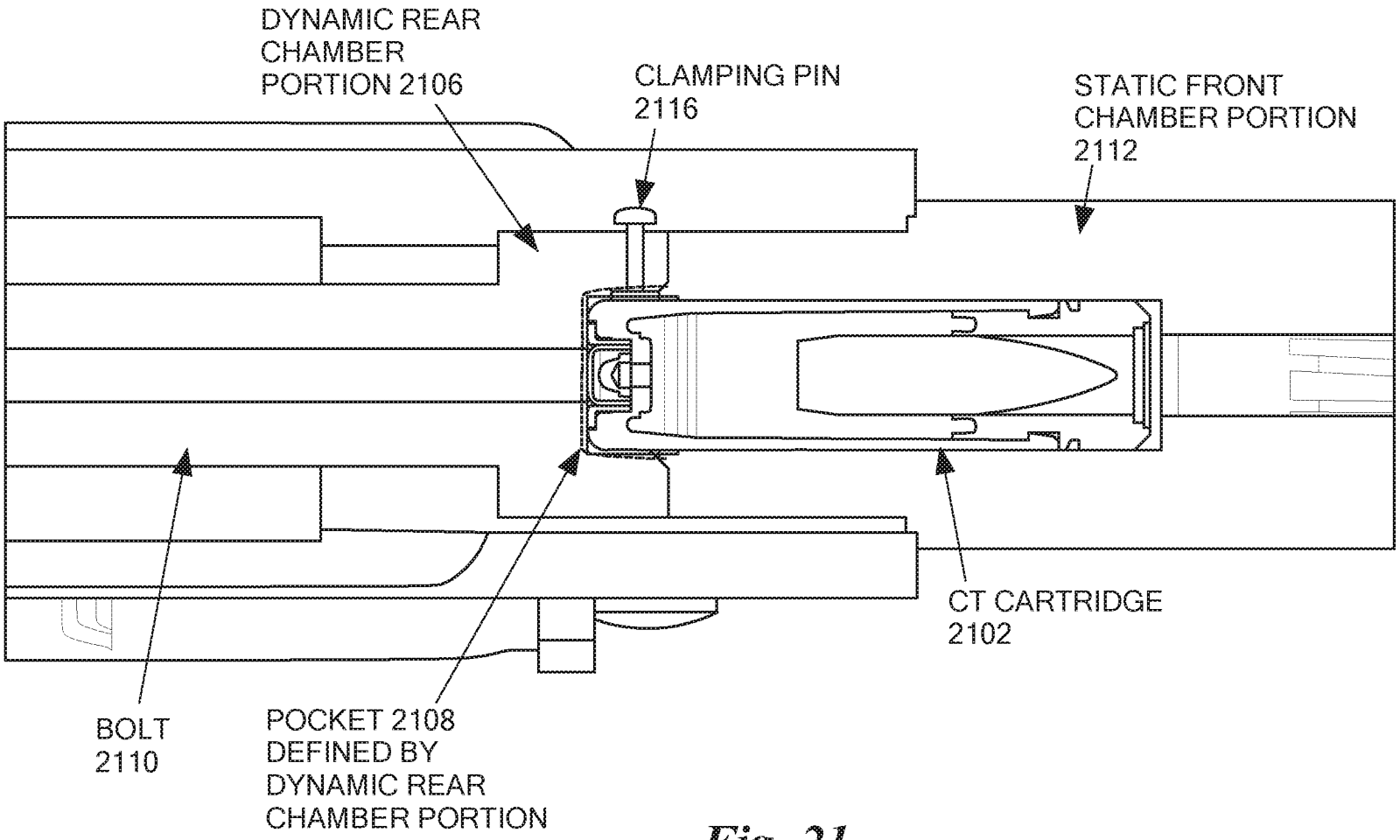
FIG. 21 is a cross-sectional top view of components in a firearm having a split chamber and configured to fire cased telescoped (CT) ammunition cartridges, showing a third example of a cartridge extraction mechanism, the third example of a cartridge extraction mechanism including a pin clamping mechanism, and showing a CT cartridge in firing position.

FIG. 21 is a cross-sectional top view of components in a firearm having a split chamber and configured to fire cased telescoped (CT) ammunition cartridges, showing a third example of a cartridge extraction mechanism. The third example of a cartridge extraction mechanism includes a clamping mechanism that includes a Clamping Pin 2116. FIG. 21 shows a CT Cartridge 2102 in a firing position, loaded into a split chamber made up of Dynamic Rear Chamber Portion 2106 and Static Front Chamber Portion 2112.

The split chamber shown in FIG. 21 is configured to radially support CT Cartridge 2102 along a full length of CT Cartridge 2102 when CT Cartridge 2102 is fired. The split chamber in the example of FIG. 21 includes a Dynamic Rear Chamber Portion 2106 defining a Pocket 2108 in a bolt face of the firearm's Bolt 2110. The Bolt 2110 operates by moving forward in the firearm to load the CT Cartridge 2102 into the split chamber for firing, e.g. during counter recoil phase while performing gas-operated automatic reloading of the firearm or the like. The Dynamic Rear Chamber Portion 2106 may consist of or include some front portion of the Bolt 2110, including for example a bolt face of the Bolt 2110, such that a Pocket 2108 is defined as a concave surface within the bolt face of Bolt 2110.

The split chamber in the example of FIG. 21 also includes a Static Front Chamber Portion 2112 that is integral to the barrel of the firearm. The Static Front Chamber Portion 2112 is mechanically separate from the Bolt 2110, such that the Bolt 2110 moves independently from the Static Front Chamber Portion 2112 during recoil and counter recoil. As shown in FIG. 21, the third example CT cartridge extraction mechanism may include a Clamping Pin 2116. As further shown in FIGS. 21-25 and further described below, Clamping Pin 2116 may be configured a) to engage the CT Cartridge 2102 prior to CT Cartridge 2102 being fired, and b) to hold the CT Cartridge 2102 in the Pocket 2108 of the bolt face of the Bolt 2110 after the CT Cartridge 2102 is fired, as the Bolt 2110 moves rearward (e.g. during recoil), in order to move the CT Cartridge 2102 rearward out of the Static Front Chamber Portion 2112 and into an ejection position. An ejector (not shown) may be configured to eject the CT Cartridge 2102 from the Pocket 2108 upon the CT Cartridge 2102 being moved into the ejection position, so that the CT Cartridge 2102 can be ejected from the firearm.

The Dynamic Rear Chamber Portion 2106 is configured to contain, within the Pocket 2108, the pressure generated within the split chamber when the CT Cartridge 2102 is fired. The Bolt 2110 may be further configured to move, e.g. before or after the Clamping Pin 2116 is extended towards CT Cartridge 2102 to engage with CT Cartridge 2102 while the CT Cartridge 2102 is located within the split chamber, and prior to firing of the CT Cartridge 2102, to compress the CT Cartridge 2102 to a length that is less than an initial length of the CT Cartridge 2102. The initial length of CT Cartridge 2102 is a length of CT Cartridge 2102 at the time when the CT Cartridge 2102 is initially loaded into the split chamber. The Clamping Pin 2116 may be operable to release the CT Cartridge 2102 upon the CT Cartridge 2102 being moved into an ejection position, in order to allow an ejector to push the CT Cartridge 2102 out of the Pocket 2108.

Figure 22:
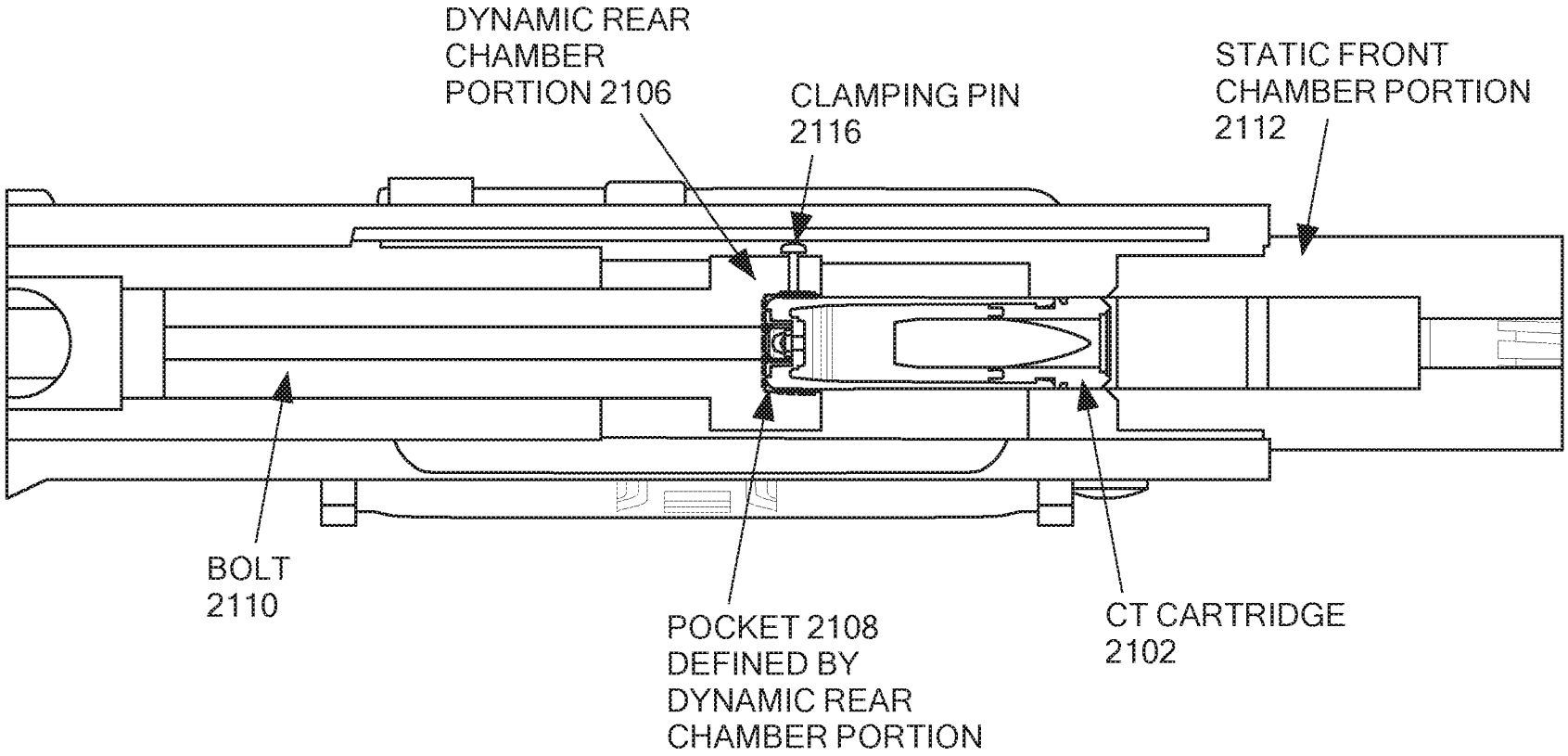
FIG. 22 is a cross-sectional top view of the firearm components of FIG. 21, showing the third example of a cartridge extraction mechanism, after firing of the CT cartridge, with the bolt having been unlocked and beginning to move rearward during recoil with the CT cartridge held in the pocket defined in the bolt face in order to extract the CT cartridge from the static front chamber portion.

FIG. 22 is another cross-sectional top view of the firearm components shown in FIG. 21, showing the third example cartridge extraction mechanism, with the Bolt 2110 having been unlocked after firing of CT Cartridge 2102 and having moved rearward (e.g. during recoil), with CT Cartridge 2102 held in Pocket 2108 by Clamping Pin 2116. FIG. 22 shows the CT Cartridge 2102 pulled rearward completely clear of the Static Front Chamber Portion 2112. The Clamping Pin 2116 may then be withdrawn from CT Cartridge 2102 upon the CT Cartridge 2102 reaching an ejection position within the firearm, thus allowing an ejector (not shown) to push CT Cartridge 2102 forward out of the Pocket 2108, and potentially out of the firearm.

Figure 23:
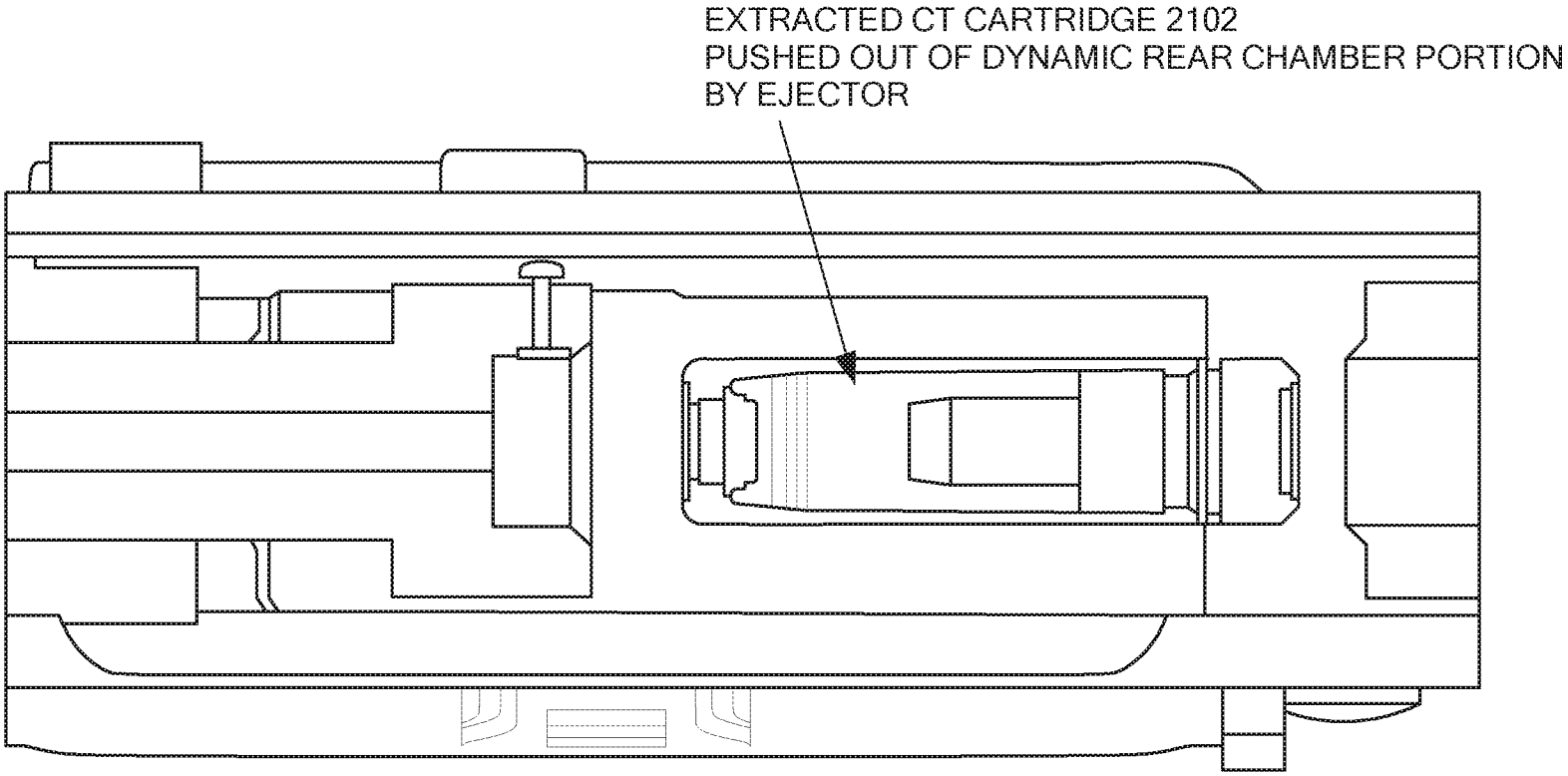
FIG. 23 is a cross-sectional top view of the firearm components of FIG. 21, showing the extracted CT cartridge pushed out of the dynamic rear chamber portion of the split chamber for ejection from the firearm.

FIG. 23 is a cross-sectional top view of the firearm components shown in FIG. 21, showing the extracted CT Cartridge 2102 pushed out of the pocket in the dynamic rear chamber portion for ejection from the firearm.

Figure 24:
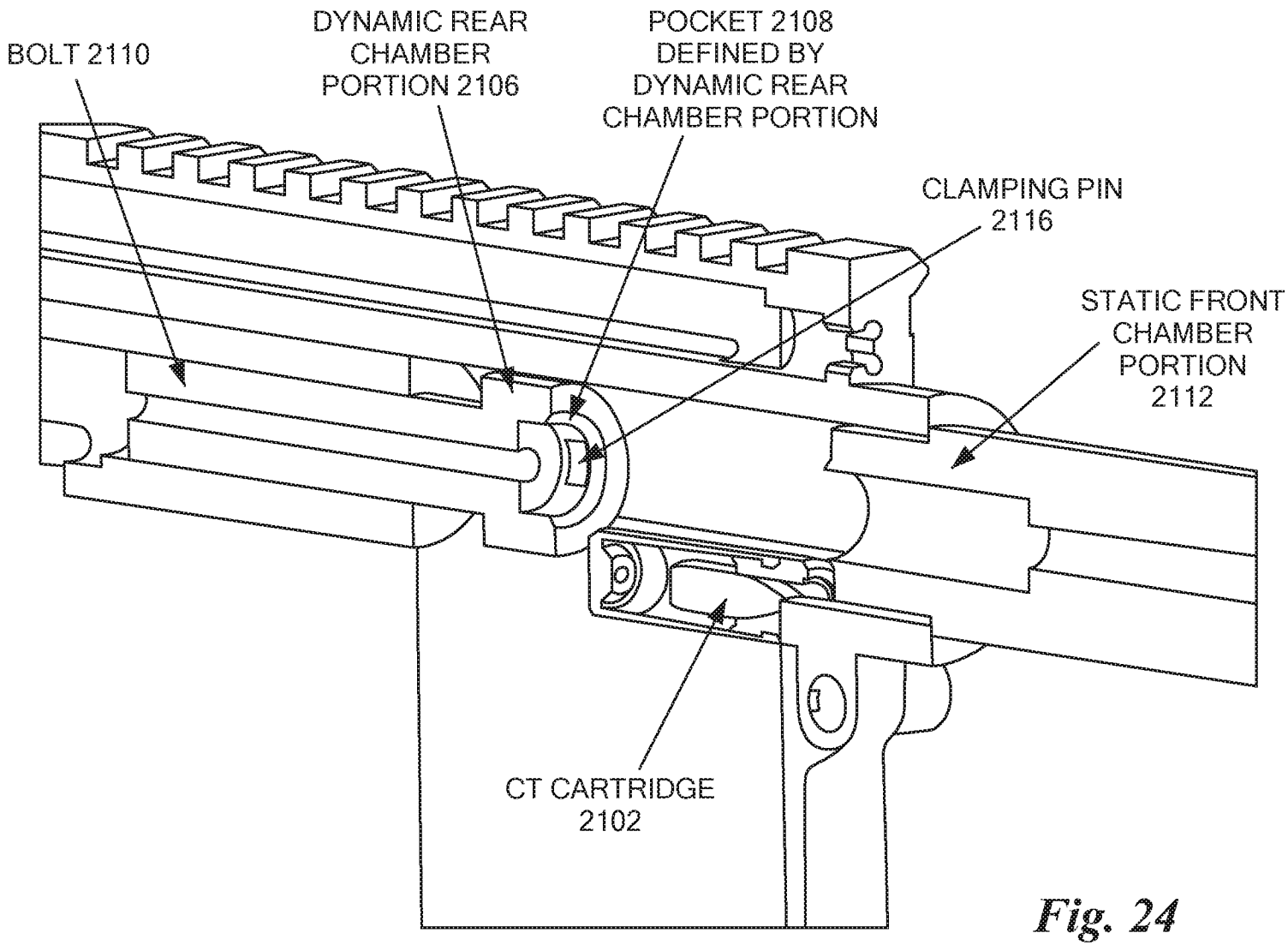
FIG. 24 is a cross-sectional side view of components in a firearm configured to fire cased telescoped (CT) ammunition cartridges, further illustrating the third example of a cartridge extraction mechanism.

FIG. 24 is a cross-sectional side view of the components in a firearm configured to fire cased telescoped (CT) ammunition cartridges, further illustrating the third example of a cartridge extraction mechanism. As shown in FIG. 24, the Dynamic Rear Chamber Portion 2106 located at the front of the Bolt 2110 defines a Pocket 2108 into which may be extended a Clamping Pin 2116 in order to engage with a CT cartridge to hold the CT cartridge in the Pocket 2108. In FIG. 24, the Bolt 2110 is moved rearward such that a CT Cartridge 2102 can be fed upward between the Dynamic Rear Chamber Portion 2106 and the Static Front Chamber Portion 2112, and then loaded into the split chamber for firing when the Bolt 2110 moves forward.

Figure 25:
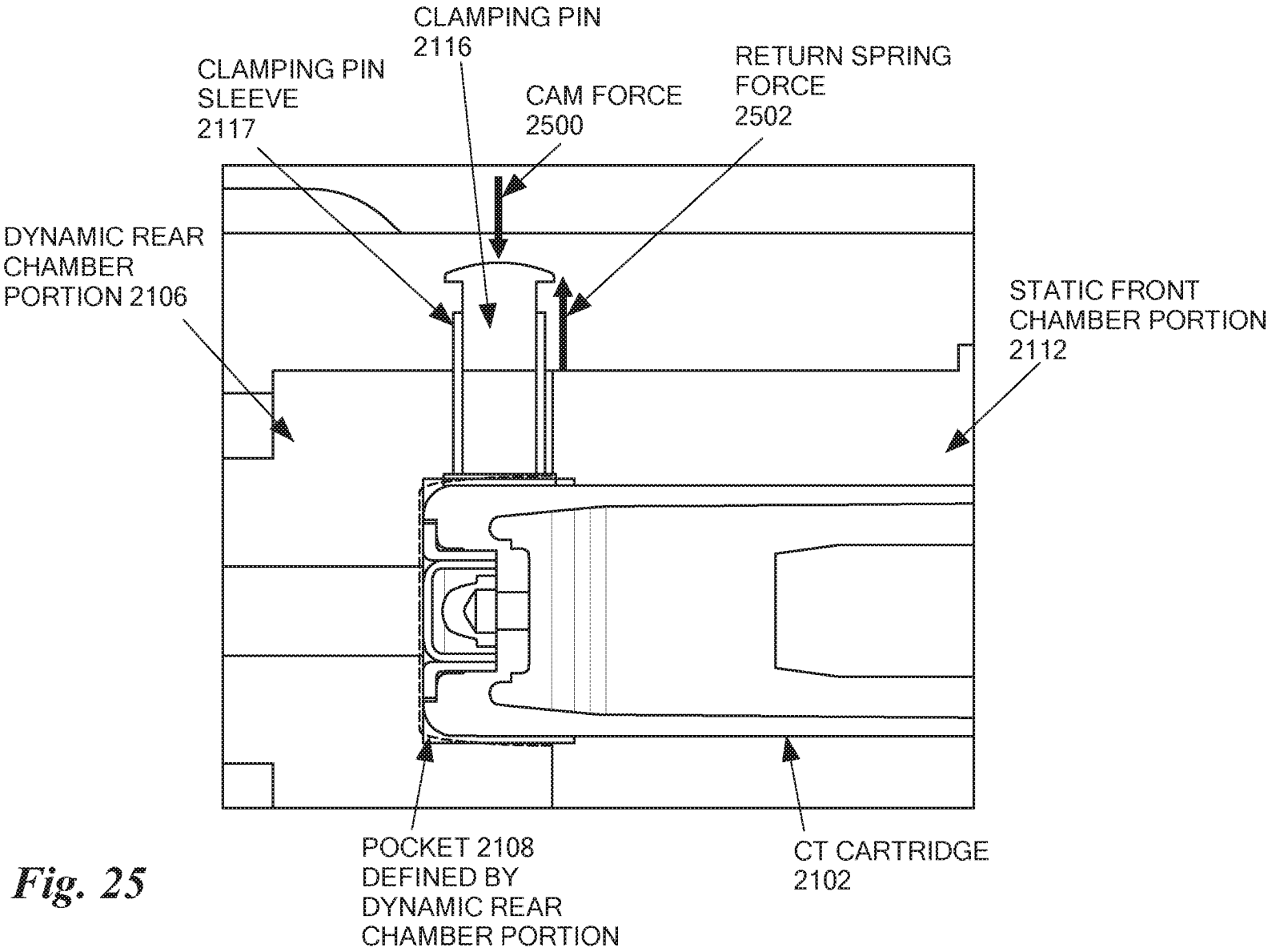
FIG. 25 is a cross-sectional side view of components in a firearm configured to fire cased telescoped (CT) ammunition cartridges, showing the third example cartridge extraction mechanism, and further illustrating the clamping pin mechanism.

FIG. 25 is a cross-sectional side view of components in a firearm configured to fire cased telescoped (CT) ammunition cartridges, having a split chamber, and further illustrating an example of a clamping pin mechanism. As shown in FIG. 25, the Clamping Pin 2116 may extend toward and withdraw away from CT Cartridge 2102 within a Clamping Pin Sleeve 2117. In some embodiments, a Cam Force 2500 may press on the Clamping Pin 2116 to cause the Clamping Pin 2116 to extend towards and engage with a side of the CT Cartridge 2102 as the bolt moves forward to load CT Cartridge 2102 into the split chamber for firing. A Return Spring Force 2502 may push against the Cam Force 2500 to cause the Clamping Pin 2116 to withdraw away from the side of the CT Cartridge 2102, as the bolt moves rearward (e.g. during recoil) when the CT Cartridge 2102 is withdrawn rearward out of the Static Front Chamber Portion 2112 for ejection after firing. Those skilled in the art will recognize that other specific types of force may alternatively be used to cause the Clamping Pin 2116 to extend towards the CT Cartridge 2102 to engage the CT Cartridge 2102 as the bolt moves forward when the CT Cartridge 2102 is loaded into the split chamber, and/or to cause the Clamping Pin 2116 to withdraw away from the CT Cartridge 2102 to disengage and release the CT Cartridge 2102 as the bolt moves rearward after the CT Cartridge 2102 is fired.

Figure 26:
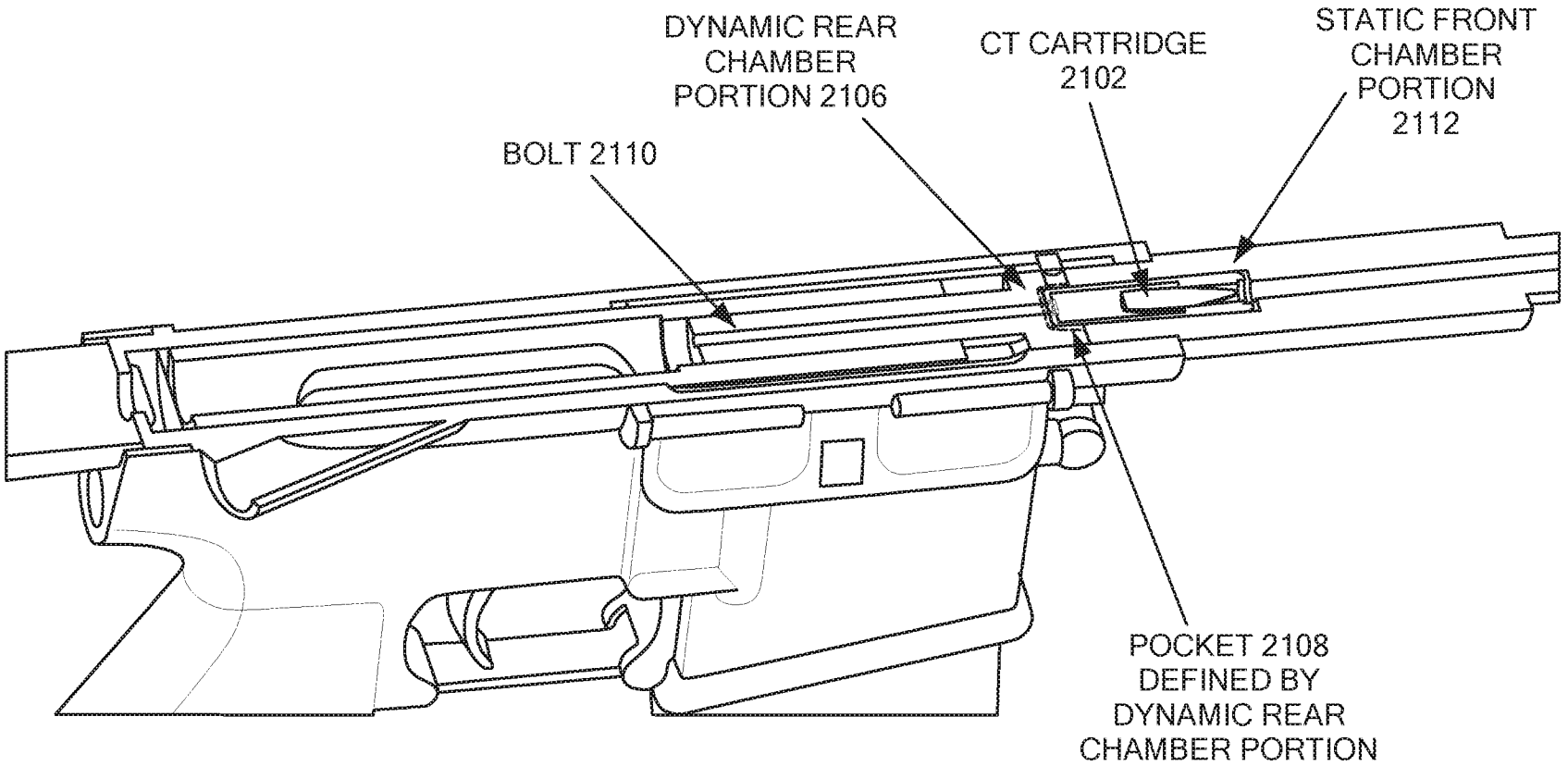
FIG. 26 is a cross-sectional side view of a firearm configured to fire cased telescoped (CT) ammunition cartridges and having a split chamber, showing a CT cartridge in the firing position.

FIG. 26 is a cross-sectional side view of components in a firearm configured to fire cased telescoped (CT) ammunition cartridges, having a split chamber, and showing a CT Cartridge 2102 in the firing position. As shown in FIG. 26, the Bolt 2110 has moved forward to load the CT Cartridge 2102 into the split chamber. While FIG. 26 shows an embodiment of the third example cartridge extraction mechanism, any one of the example cartridge extraction mechanisms disclosed herein may be used in the firearm shown in FIG. 26, in order to engage with the CT Cartridge 2102 while the CT Cartridge 2102 is located in the split chamber, e.g. prior to or subsequent to firing, and to then hold the CT Cartridge 2102 in the Pocket 2108 while the Bolt 2110 moves reward (e.g. during recoil), so that the CT Cartridge 2102 can be pulled out of the Static Front Chamber Portion 2112 for ejection from the firearm.

Figure 27:
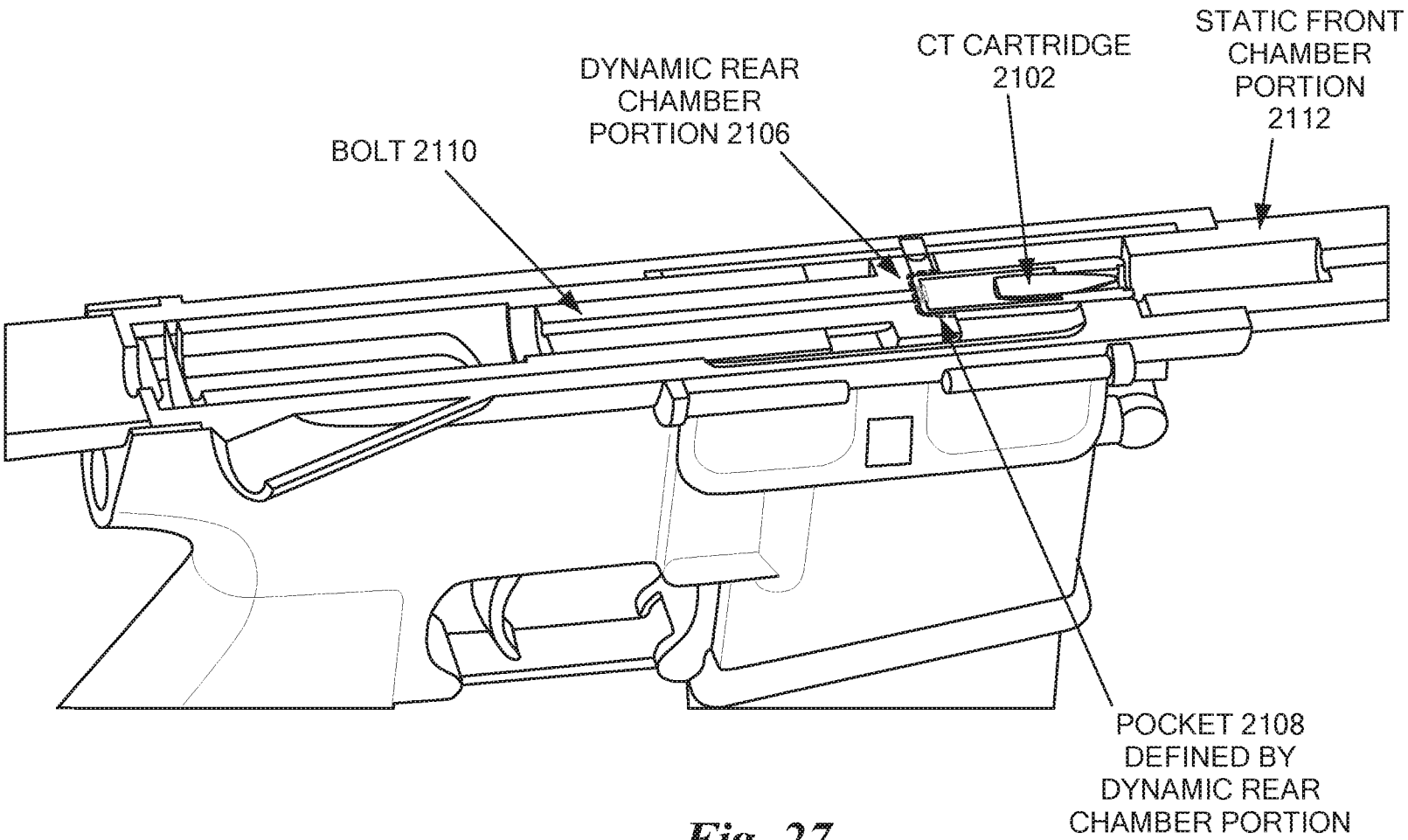
FIG. 27 is another cross-sectional side view of the firearm of FIG. 26, after firing of the CT cartridge, and showing the CT cartridge having been pulled rearward out of the static front chamber portion of the split chamber during recoil and into an ejection position within the firearm.

FIG. 27 is another cross-sectional side view of the firearm shown in FIG. 26, showing the firearm after firing of the CT Cartridge 2102, and showing the CT Cartridge 2102 having been pulled rearward out of the Static Front Chamber Portion 2112 of the split chamber during recoil, and into an ejection position for ejection from the firearm.

Figure 28:
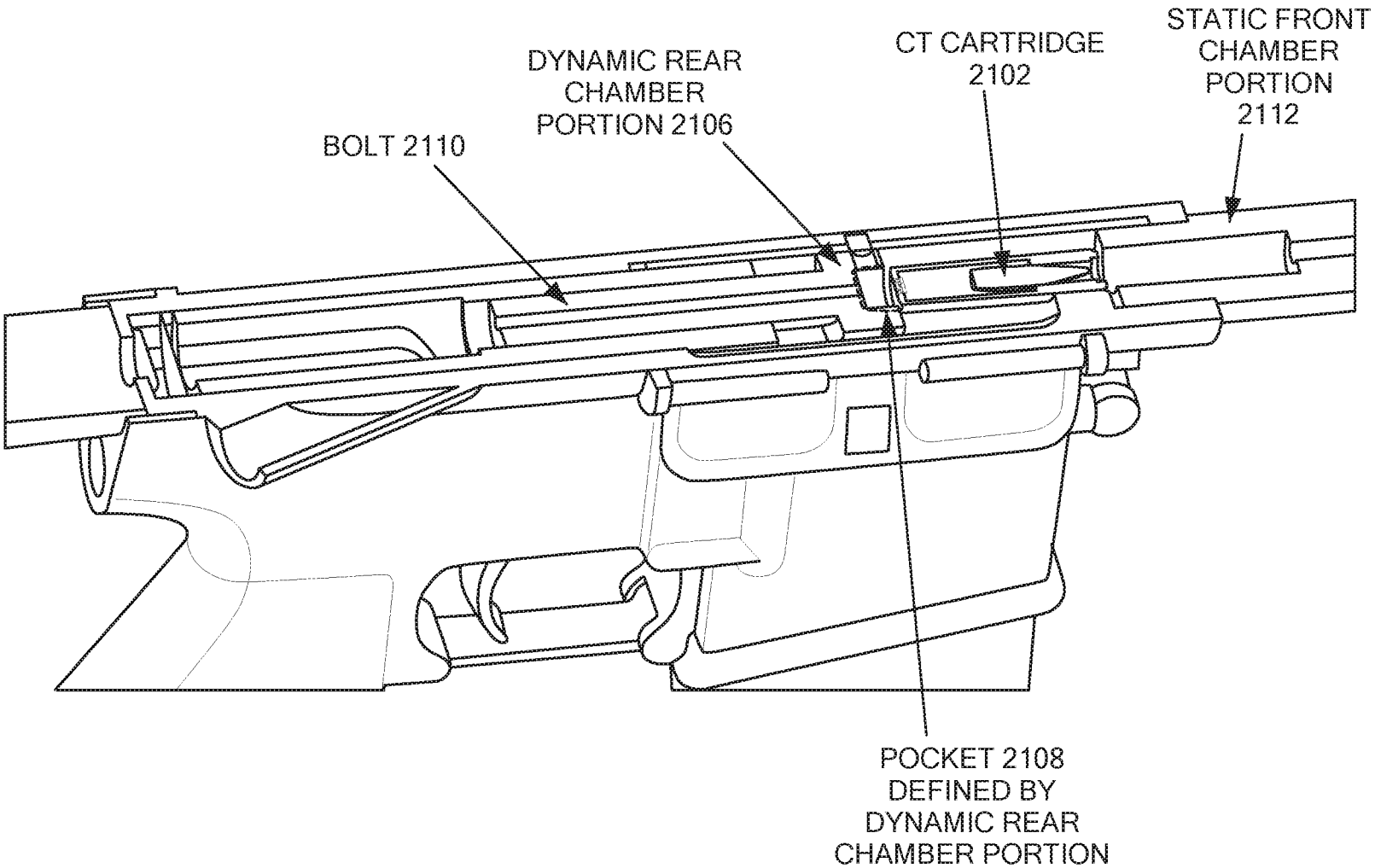
FIG. 28 is another cross-sectional side view of the firearm of FIG. 26, showing the CT cartridge having been pulled rearward out of the static front chamber portion of the split chamber into an ejection position, and also showing the CT cartridge having been pushed out of the pocket defined by the dynamic rear portion of the split chamber by an ejector mechanism.

FIG. 28 is another cross-sectional side view of the firearm shown in FIG. 26, and showing the CT Cartridge 2102 having been pulled rearward out of the Static Front Chamber Portion 2112 into an ejection position, and also showing the CT Cartridge 2102 having been pushed out of the Pocket 2108 defined by Dynamic Rear Chamber Portion 2106 by an ejector mechanism (not shown).

Figure 29:
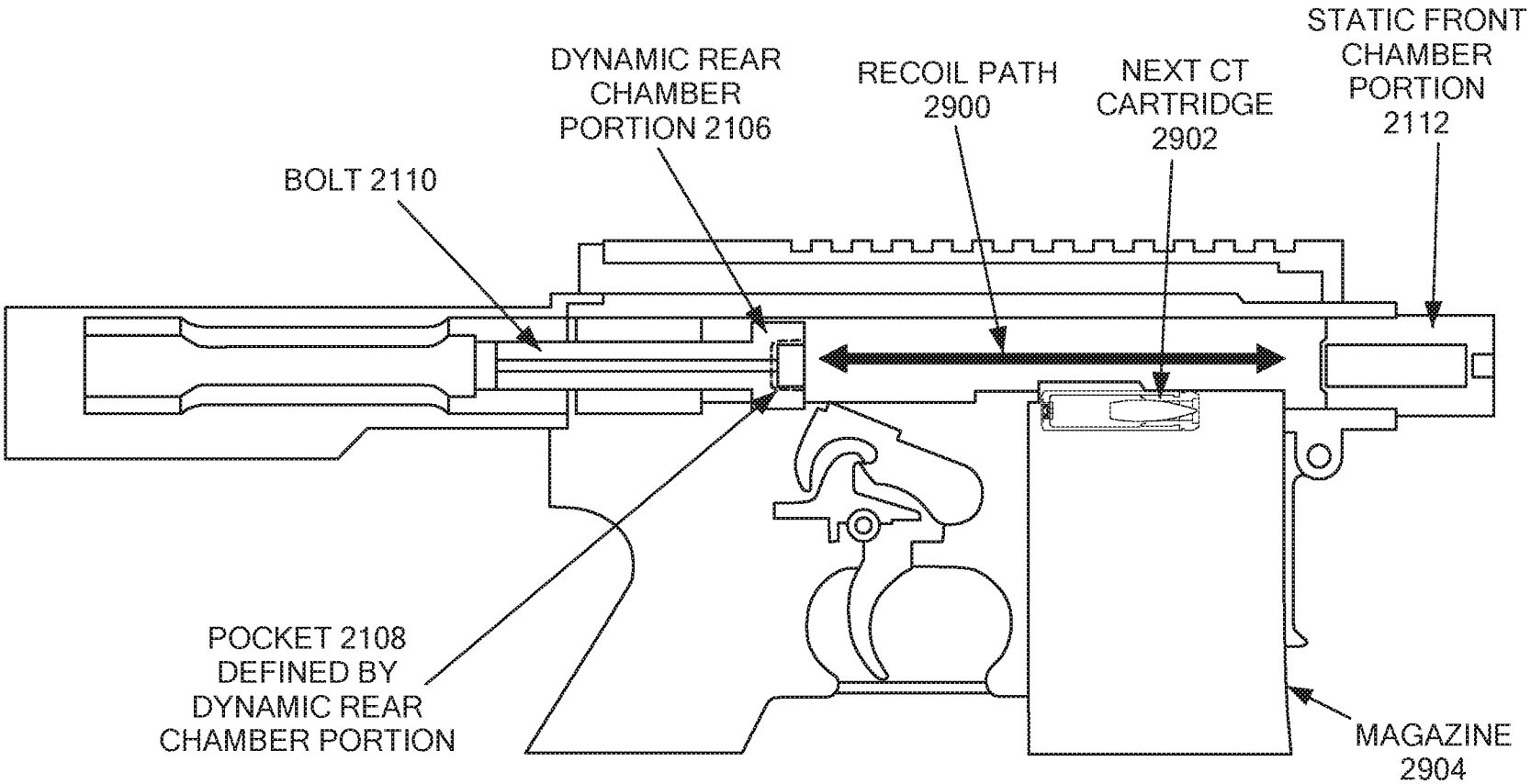
FIG. 29 is a cross-sectional side view of the firearm of FIG. 26, showing a path traveled by a bolt during recoil and counter recoil during automatic loading performed when a CT cartridge is fired.

FIG. 29 is another cross-sectional side view of the firearm shown in FIG. 26, and showing a Recoil Path 2900 traveled by the Bolt 2110 after a CT cartridge is fired while performing gas-operated automatic loading of CT cartridges for firing by the firearm shown in FIG. 26. For example, the Bolt 2110 may move rearward along Recoil Path 2900 during recoil to extract a spent CT cartridge, and then forward along Recoil Path 2900 during counter recoil to load a Next CT Cartridge 2902 that is fed upwards from Magazine 2904 into the split chamber for firing.

Figure 30:
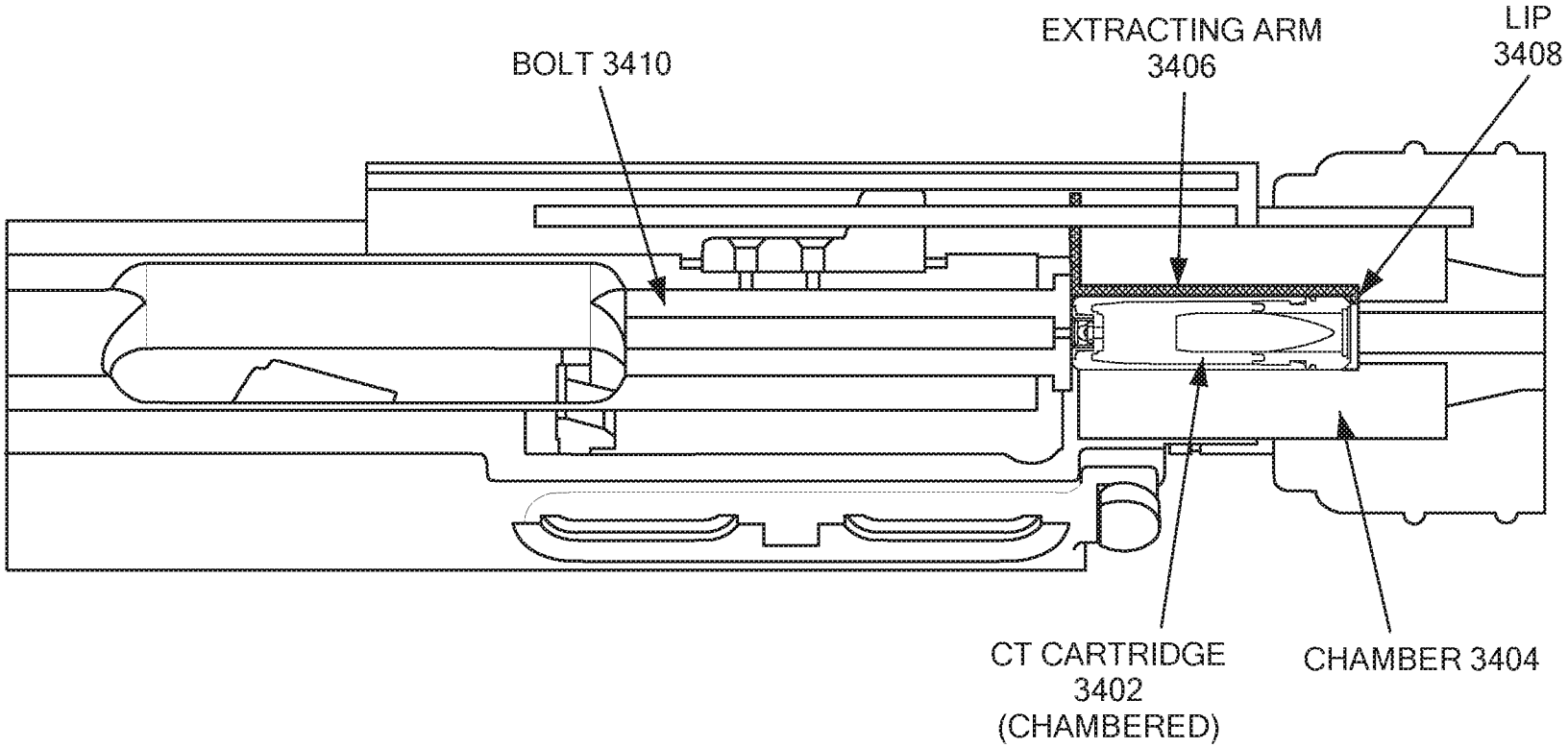
FIG. 30 is a cross-sectional side view of components in a firearm configured to fire CT cartridges and showing a fourth example of a cartridge extraction mechanism, where the fourth example of a cartridge extraction mechanism is operable to pull a CT cartridge from a chamber using an extracting arm.

FIG. 30 is a cross-sectional side view of components in a firearm configured to fire CT cartridges and showing a fourth example of a cartridge extraction mechanism. The fourth example of a cartridge extraction mechanism is operable to pull a CT Cartridge 3402 rearwards from a Chamber 3404 using an Extracting Arm 3406. When the Bolt 3410 moves rearward (e.g. during recoil), the Bolt 3410 pulls Extracting Arm 3406 rearward, and a Lip 3408 on Extracting Arm 3406 engages with CT Cartridge 3402 to pull the CT Cartridge 3402 rearward out of the Chamber 3404.

Figure 31:
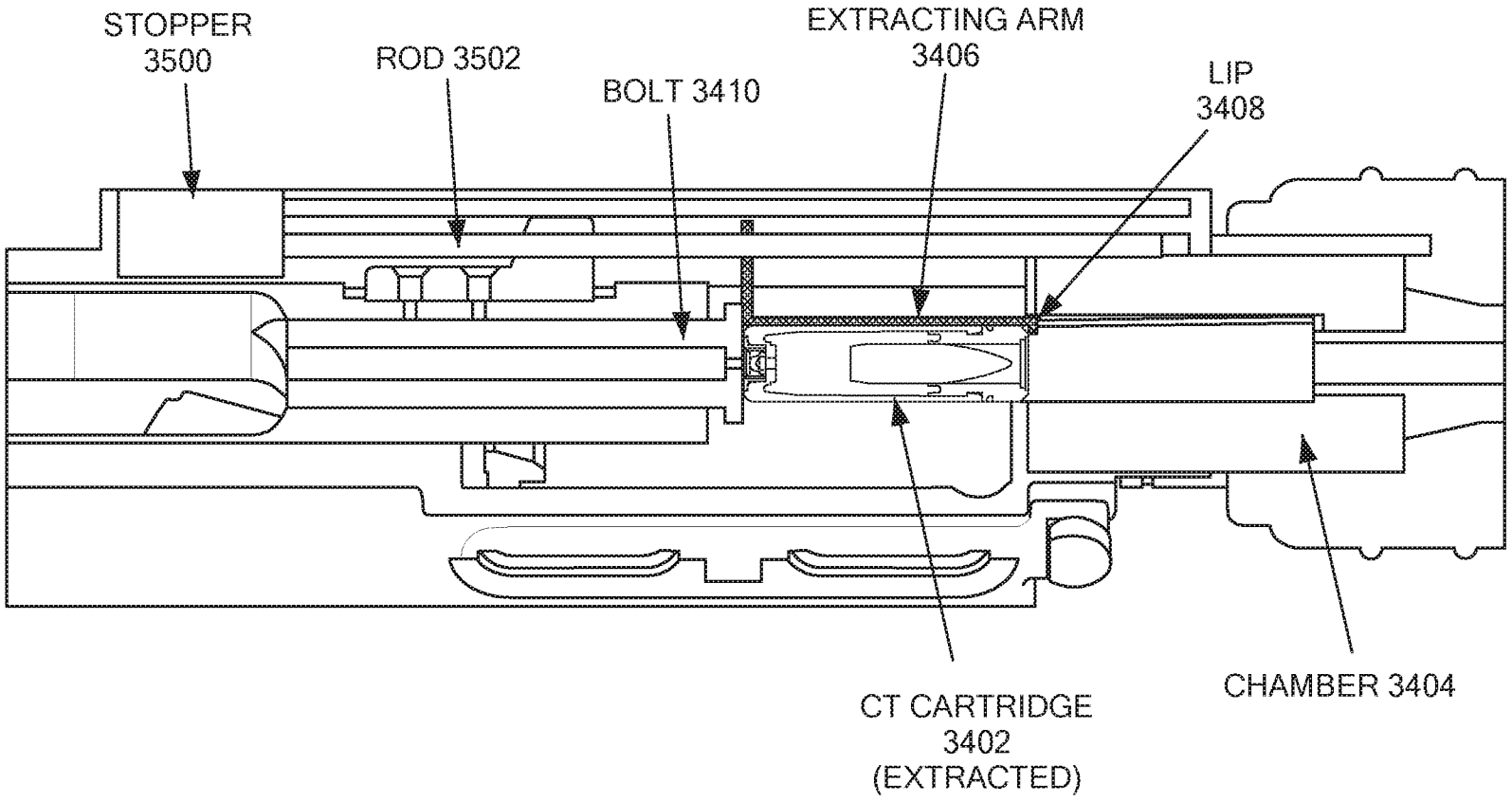
FIG. 31 is a cross-sectional side view of the firearm components of FIG. 30, showing components in the fourth example of cartridge extraction mechanism, with the cartridge pulled rearwards out of the chamber during recoil.
Figure 35:
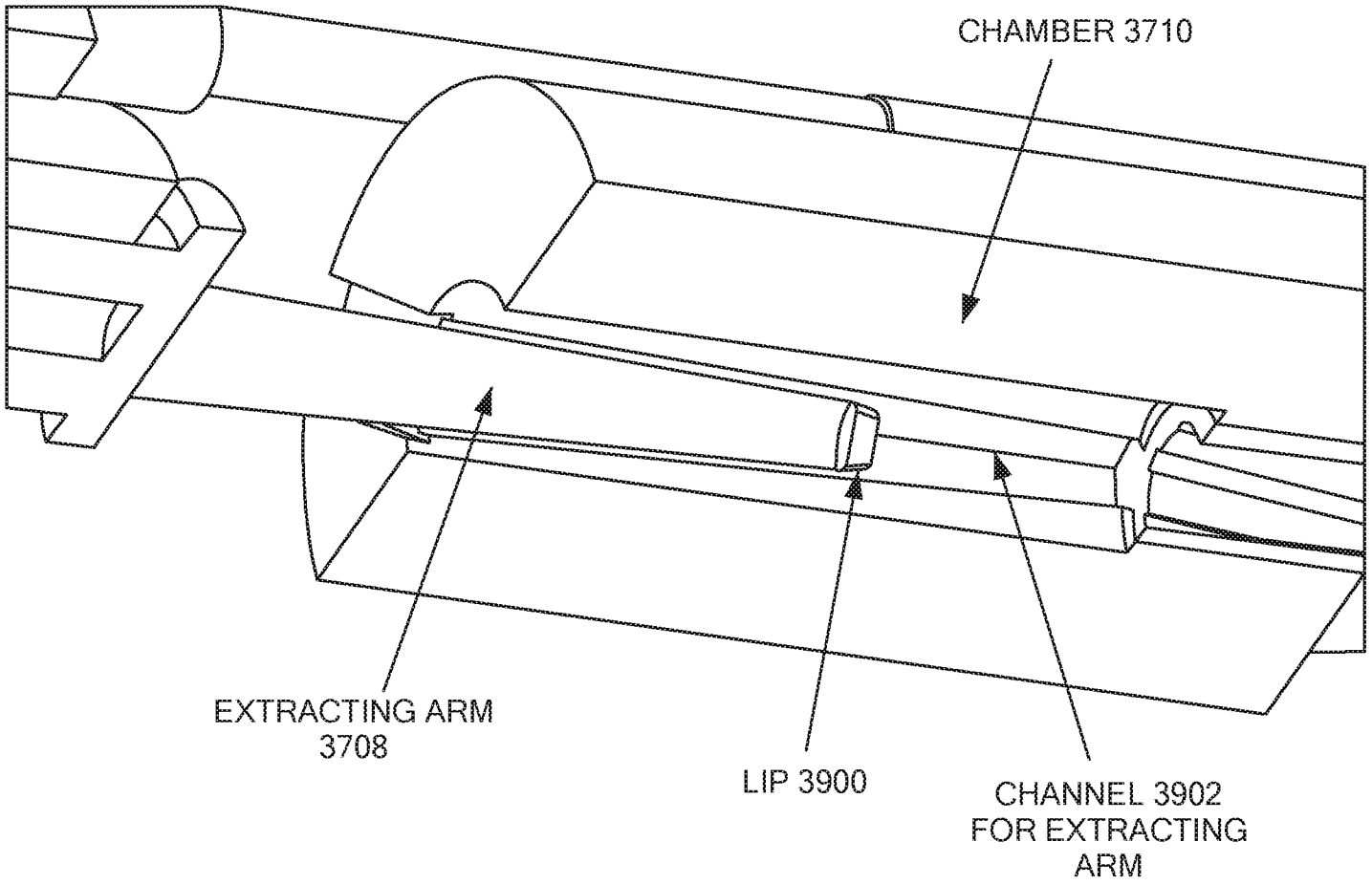
FIG. 35 is a cross-sectional bottom view of a firearm showing components in the fourth example of a cartridge extraction mechanism.

FIG. 31 is a cross-sectional side view of the firearm components of FIG. 30, showing components in the fourth example cartridge extraction mechanism, and showing the CT Cartridge 3404 pulled rearwards out of the Chamber 3404. In the example of FIG. 35, a Rod 3502 coupled to Extracting Arm 3406 has hit a Stopper 3500 while the Bolt 3410 moves rearward in the firearm (e.g. during recoil). When the Rod 3502 hits Stopper 3500, the Bolt 3410 continues to travel rearwards, but the Extracting Arm 3406 stops moving rearwards. As a result, the CT Cartridge 3402 remains at an ejection position within the firearm to which it was pulled by Extracting Arm 3406, while the Bolt 3410 continues to travel rearwards.

Figure 32:
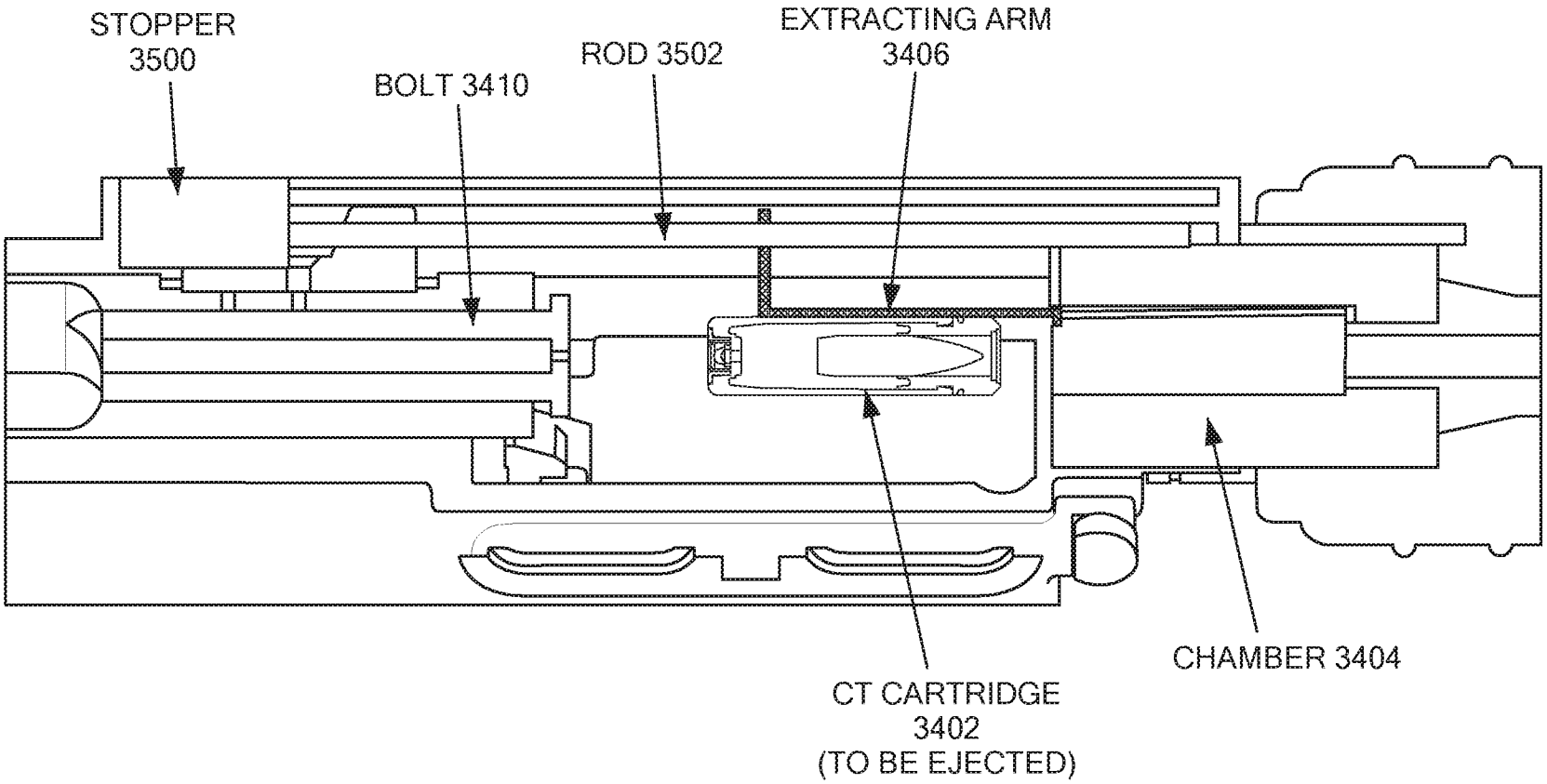
FIG. 32 is a cross-sectional side view of the firearm components of FIG. 30, showing components in the fourth example of a cartridge extraction mechanism, with the bolt moved rearwards away from the extracted cartridge during recoil.

FIG. 32 is a cross-sectional side view of the firearm components of FIG. 30, showing components in the fourth example of a cartridge extraction mechanism. In FIG. 32, the Bolt 3410 has continued to travel rearwards after the Rod 3502 has hit Stopper 3500. As a result, the Bolt 3410 has continued to move rearwards and away from the extracted CT Cartridge 3402. As the Bolt 3410 continues moving rearward, the CT Cartridge 3402 may be ejected laterally from the ejection position in the firearm, e.g. via an ejection mechanism that is activated by movement of a bolt carrier coupled to the Bolt 3410.

Figure 33:
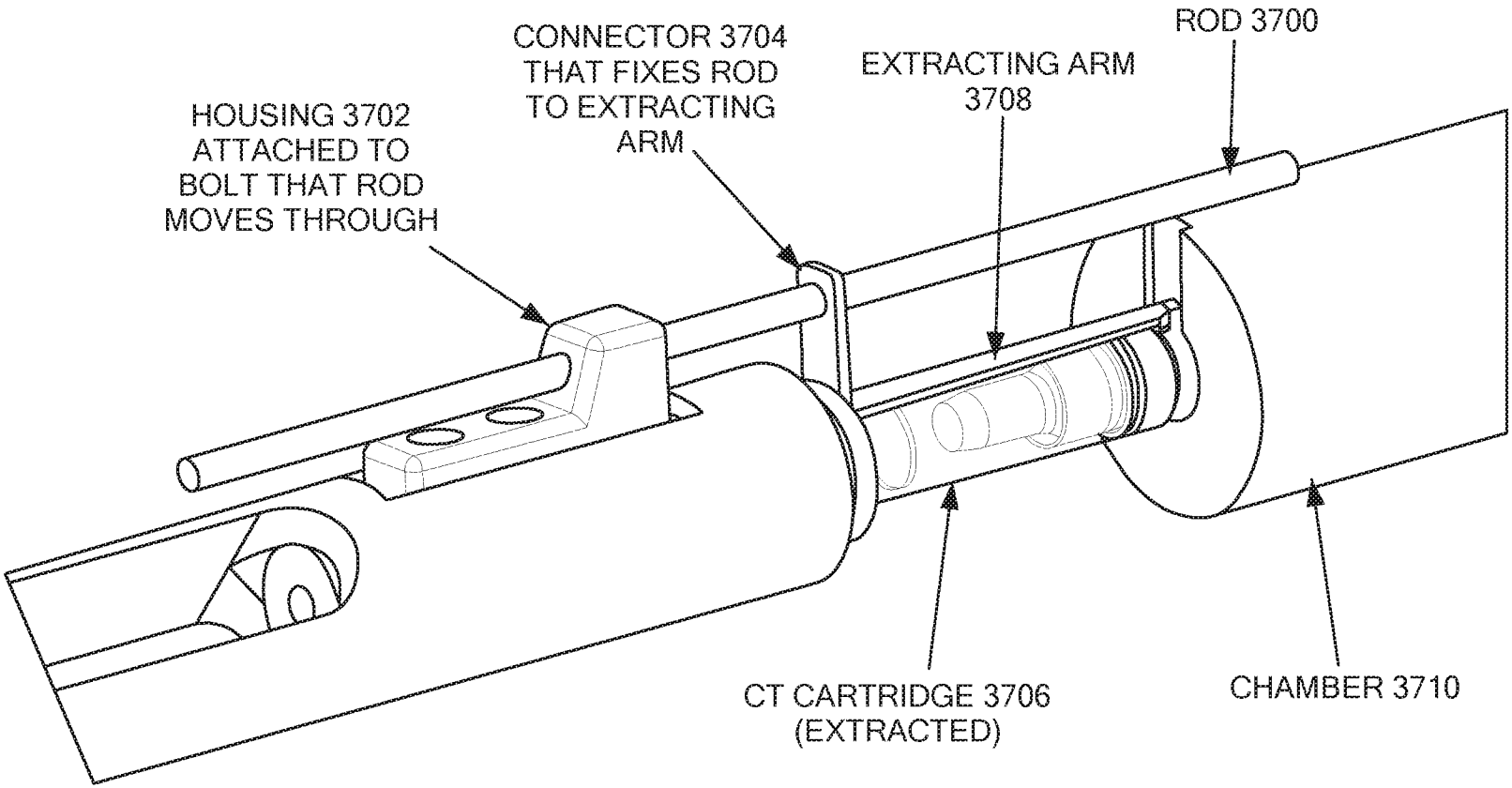
FIG. 33 shows an example of firearm components in an embodiment of the fourth example of a cartridge extraction mechanism.
Figure 37:
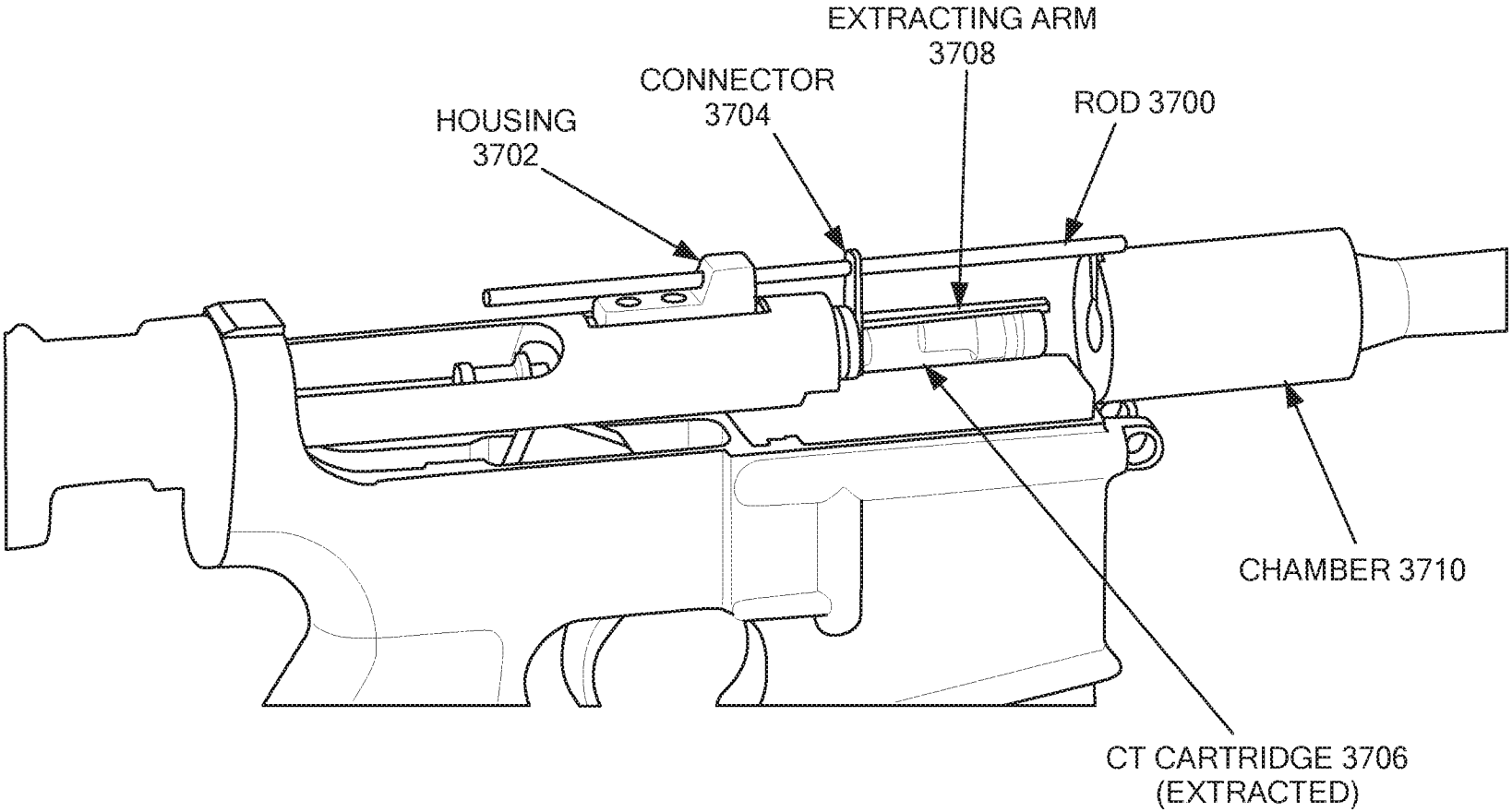
FIG. 37 is another view of components in an embodiment of the fourth example of a cartridge extraction mechanism, and showing the CT cartridge extracted from the chamber.

FIG. 33 shows an example of firearm components in an embodiment of the fourth example cartridge extraction mechanism. As shown in FIG. 37, a Housing 3702 is provided with a bushing that Rod 3700 moves through. A Connector 3704 fixes the Rod 3700 to the Extracting Arm 3708. After firing, the bolt becomes unlocked and moves the Extracting Arm 3708 rearward, causing the Extracting Arm 3708 to pull the CT Cartridge 3706 out of the Chamber 3710 from the front of CT Cartridge 3706, e.g. by way of a lip at the end of Extracting Arm 3708. Once the CT Cartridge 3706 is clear of Chamber 3710, and in an ejection position, the Extracting Arm 3708 stops moving rearward, but the bolt continues to move rearward so that the CT Cartridge 3706 can be ejected from the firearm. Alternatively, the Extracting Arm 3708 may move laterally out of the way, so that the CT Cartridge 3706 can be ejected from the firearm. On the return stroke (counter-recoil), the bolt may move forward to pick up a new CT cartridge which is then stopped by the Extracting Arm 3708. The bolt continues to move forward holding the new CT cartridge in place until the new CT cartridge is loaded into Chamber 3710 for firing.

Figure 34:
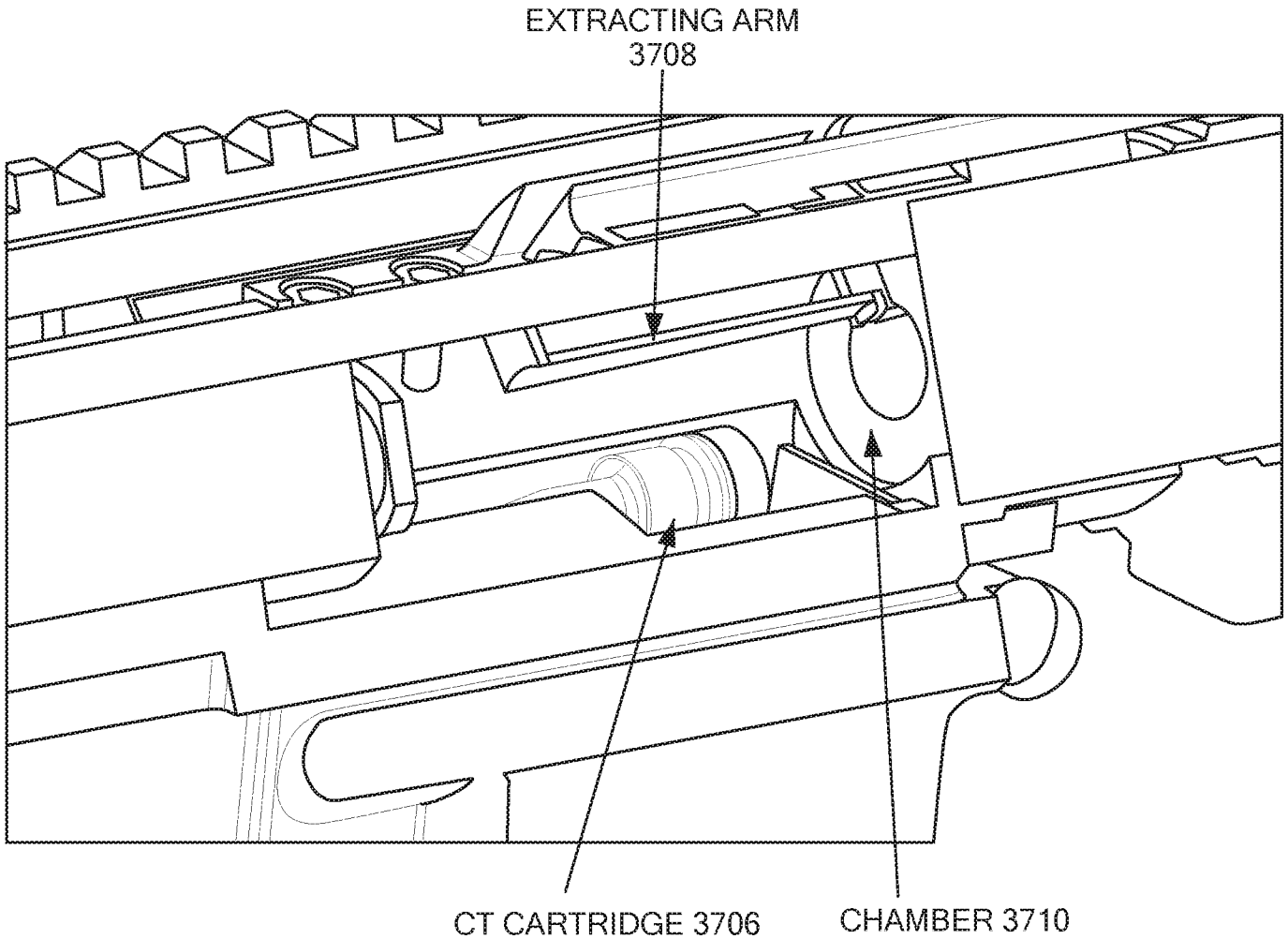
FIG. 34 is a cross-sectional side view of a firearm showing components in the fourth example of a cartridge extraction mechanism.

FIG. 34 is a cross-sectional side view of a firearm showing the components in the fourth example of a cartridge extraction mechanism, showing the CT Cartridge 3706 prior to being loaded into the Chamber 3710.

FIG. 35 is a cross-sectional bottom view of a firearm showing components in the fourth example of a cartridge extraction mechanism, including a Lip 3900 on the Extracting Arm 3708, and a Channel 3902 within the Chamber 3710 for the Extracting Arm 3708 to travel through.

Figure 36:
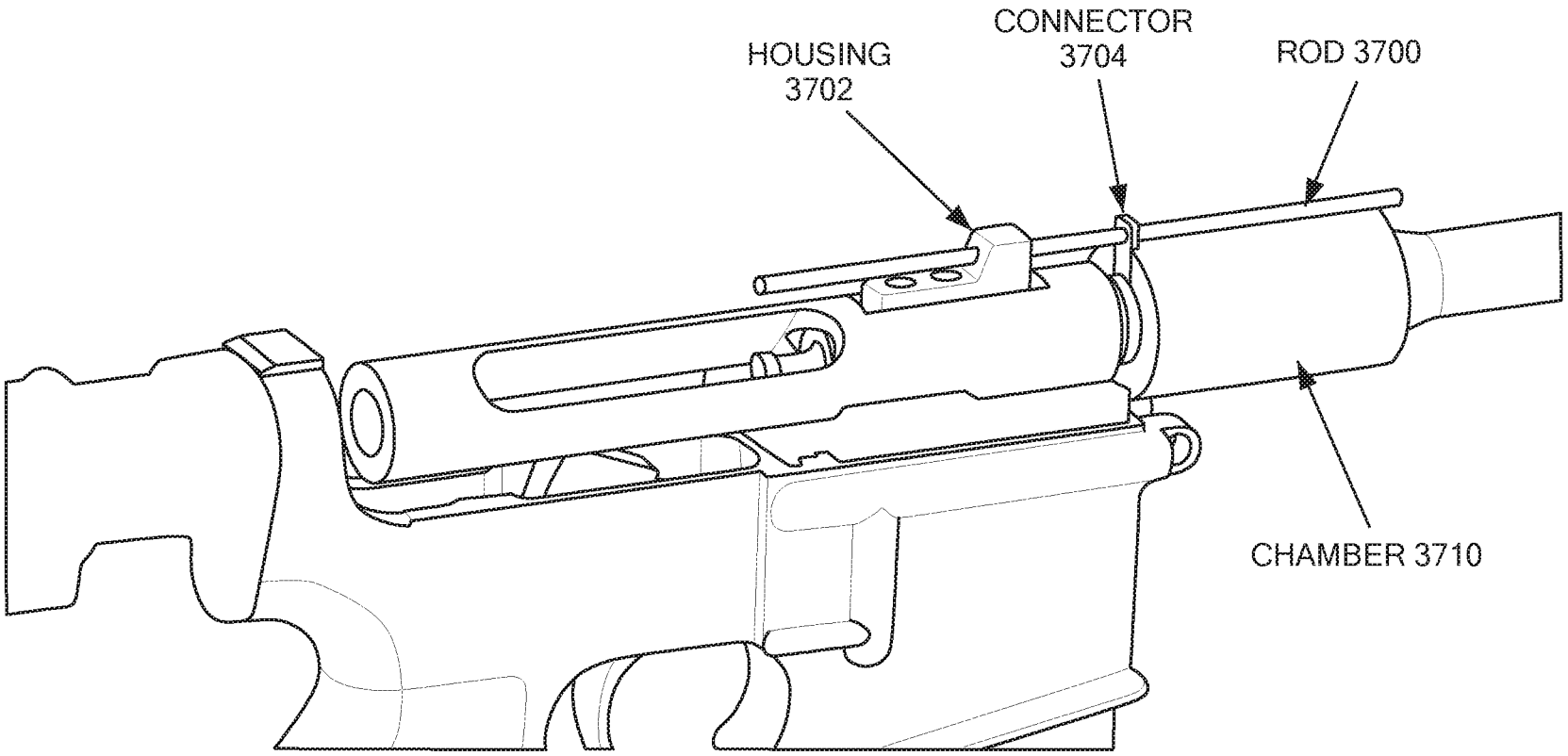
FIG. 36 is another view of components in an embodiment of the fourth example of a cartridge extraction mechanism, and showing the CT cartridge loaded into the chamber.

FIG. 36 is another view of components in an embodiment of the fourth example of a cartridge extraction mechanism, showing an embodiment of the fourth example cartridge extraction mechanism at a point in time when the CT cartridge is loaded in the Chamber 3710. The Extracting Arm 3708 (FIG. 35) must match the contours of the inside wall of Chamber 3710 when Chamber 3710 is closed to ensure that the CT cartridge is fully supported.

FIG. 37 a is another view of components in an embodiment of the fourth example of a cartridge extraction mechanism, at a point in time when the CT Cartridge 3706 has been extracted rearward from the Chamber 3710.

Figure 38:
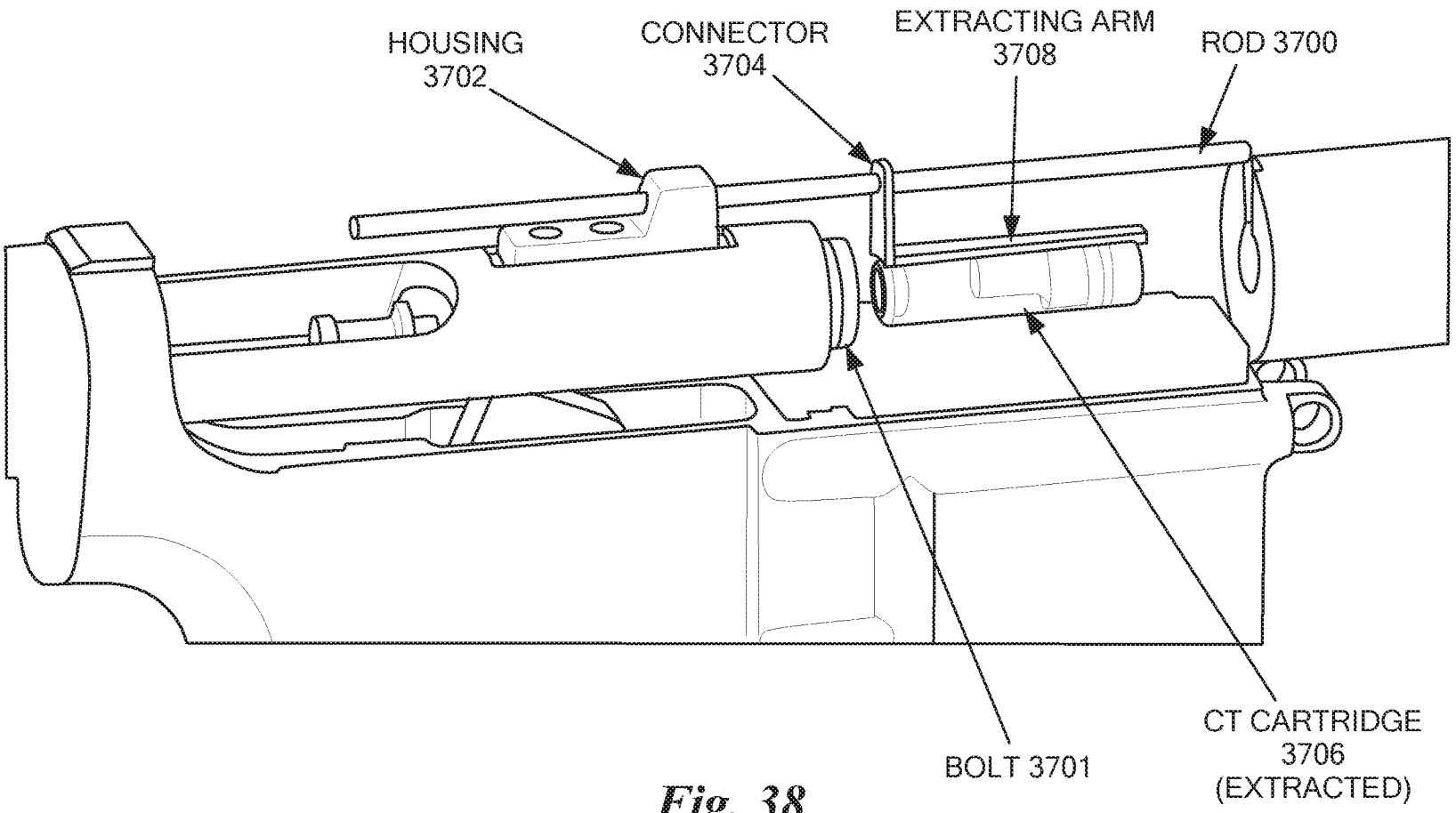
FIG. 38 is another view of components in an embodiment of the fourth example of a cartridge extraction mechanism, and showing the bolt withdrawn rearwards from the extracted CT cartridge.

FIG. 38 is a is another view of components in an embodiment of the fourth example of a cartridge extraction mechanism, at a point in time when the Bolt 3701 has been withdrawn rearward and away from the extracted CT Cartridge 3706.

While the fourth example cartridge extraction mechanism may be embodied such that the Extracting Arm 3708 travels through a channel in the Chamber 3710, a fifth example cartridge extraction mechanism may be embodied to extract a cartridge by pushing the cartridge rearwards from the front of the chamber, in a way that does not require a channel in the chamber. Such a fifth example cartridge extraction mechanism may include a connector arm that is attached to the bolt, and that reaches around the outside of the chamber, to a point in front of the chamber where the connector arm is attached to a pusher arm that extends inwards towards the barrel. The pusher arm is connected to one or more pushers that are operable to contact a cartridge from the front of the chamber. When the bolt is activated to rotate and then retreat from the chamber, the connector arm (which may be stationary during bolt rotation via a cut out in the bolt side wall) is pulled rearwards with the bolt. A delay slot may be provided in the connector arm to allow the bolt to retract some predetermined distance before pins in the pusher arm located within the delay slot engage and pull the pusher arm rearwards, causing the pusher(s) to push the CT cartridge rearwards out of the chamber via contact with a front face of the CT cartridge. As with the second, third, and fourth example cartridge extraction mechanisms, the fifth example cartridge extraction mechanism does not require an extractor groove in the CT cartridge.

While some of the above description regarding CT cartridge extraction may refer to pulling a CT cartridge rearward and into an ejection position in the case where the CT cartridge is a spent CT cartridge that is being pulled rearward during recoil after a successful firing of the CT cartridge, the disclosed CT cartridge extraction examples may also be applied when an unfired CT cartridge is being pulled rearward into the ejection position in the case of a misfire, when clearing the firearm.

Figure 39:
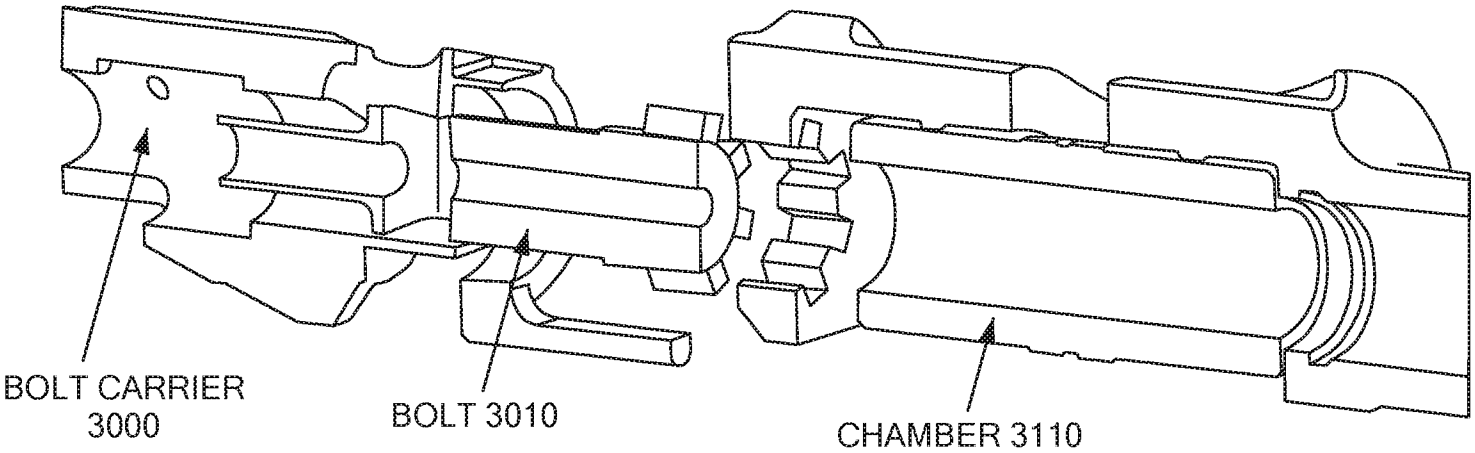
FIG. 39 is a cross-sectional side view of components in a firearm configured to fire CT cartridges, and to compress a CT cartridge located within a fixed chamber prior to firing.

FIG. 39 is a cross-sectional side view of components in a firearm configured to fire CT cartridges, in which a CT cartridge located within a chamber is compressed prior to firing. As shown in FIG. 30, a Bolt 3010 is moving forward within the firearm towards a Chamber 3110 during automatic loading of a CT cartridge (not shown) into the Chamber 3110.

Figure 40:
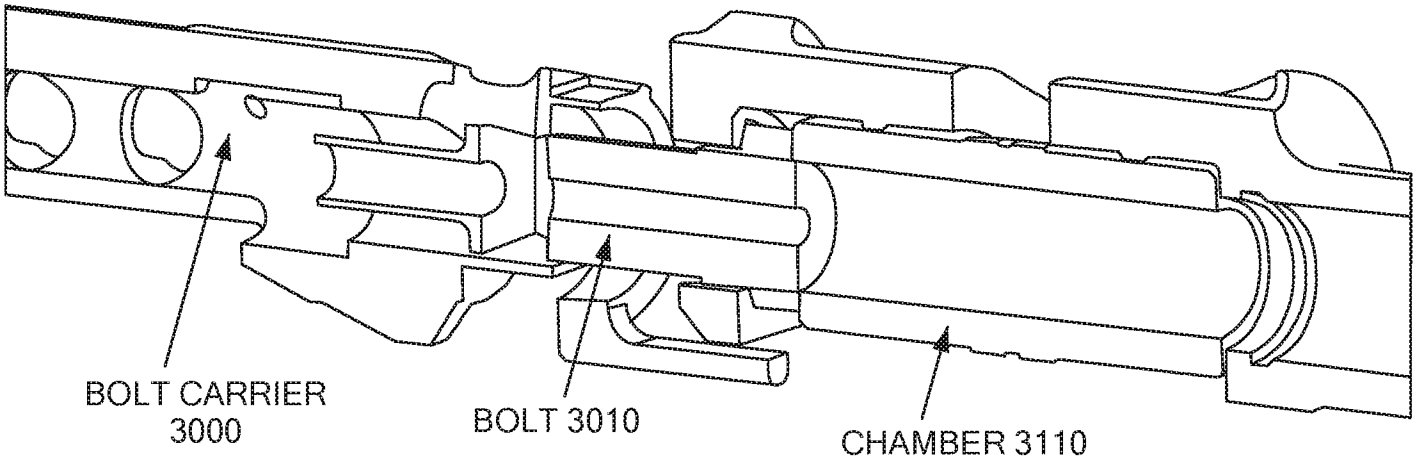
FIG. 40 is a cross-sectional side view of the firearm components of FIG. 39, showing the bolt moving forward into the chamber.
Figure 41:
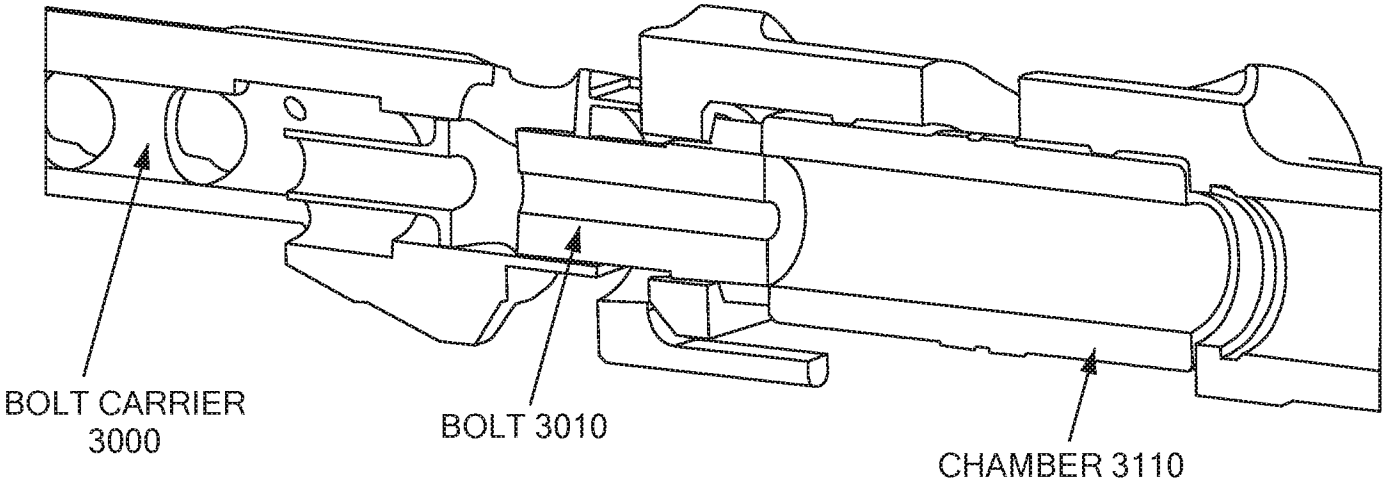
FIG. 41 is a cross-sectional side view of the firearm components of FIG. 39, showing the bolt moved into the chamber.
Figure 42:
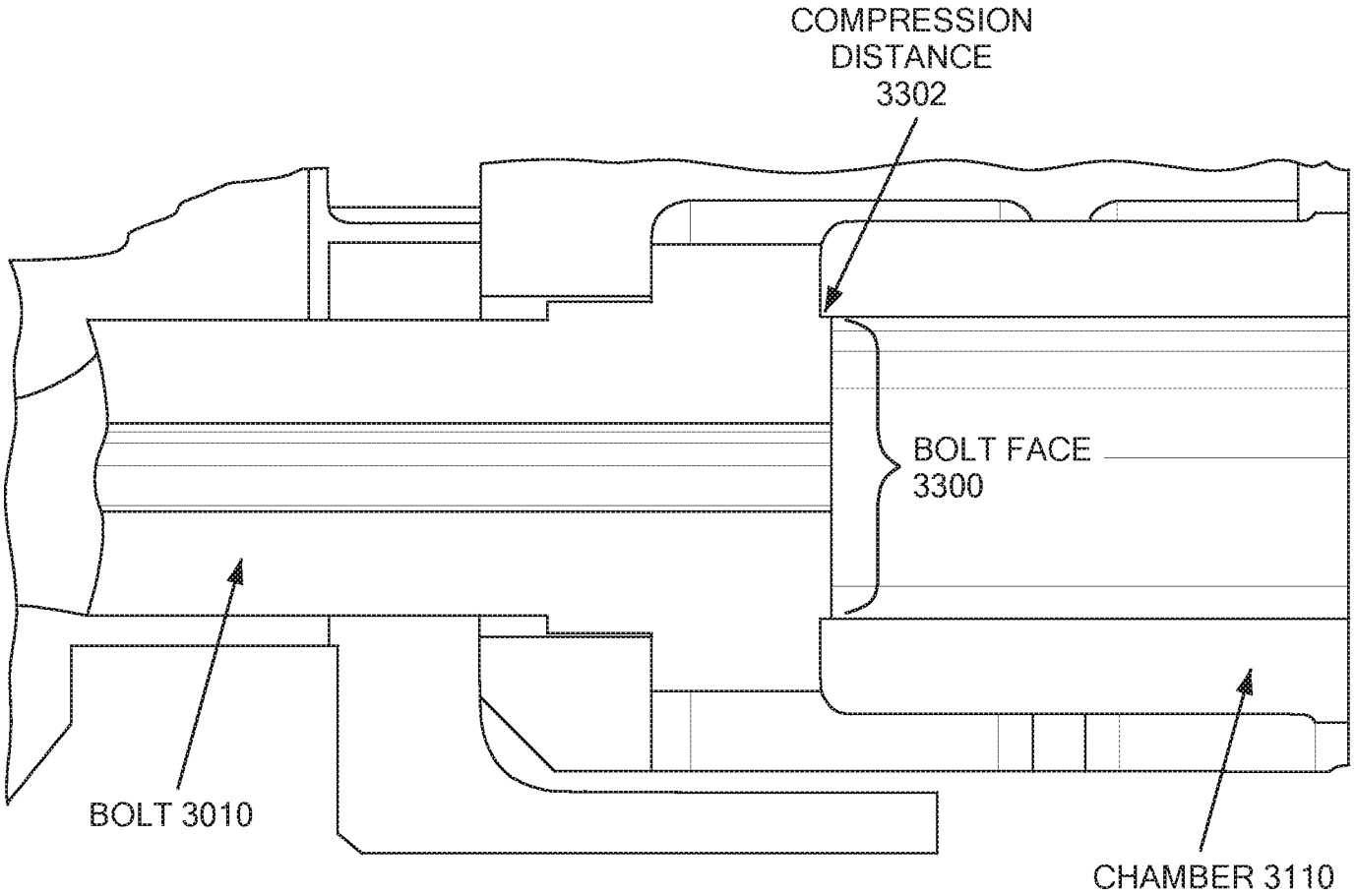
FIG. 42 is cross-sectional side view of the firearm components of FIG. 39, showing the bolt moved into the chamber and showing an example of an amount that the bolt face extends within the chamber to compress a CT cartridge that is loaded in the chamber prior to firing.

FIG. 40 is a cross-sectional side view of the firearm components shown in FIG. 39, showing the Bolt 3010 moving forward such that bolt lugs come into engagement with the chamber lugs of Chamber 3110, and FIG. 41 shows the Bolt 3010 moved further into the Chamber 3110, such that Bolt 3010 is locked, e.g. at a time a CT cartridge (not shown) loaded in the Chamber 3110 is fired. FIG. 42 is a cross-sectional side view showing the Bolt 3010 moved into the Chamber 3110, and showing an example of a Compression Distance 3302 that is an amount that the Bolt Face 3300 extends within the Chamber 3110 to compress a CT cartridge (not shown) that is located in the Chamber 3110, prior to firing the CT cartridge, in order to reduce and/or eliminate headspace to minimize extrusion of a polymer endcap and/or case of the CT cartridge during firing.

While the invention is described through the above exemplary embodiments, it will be understood by those of ordinary skill in the art that modification to and variation of the illustrated embodiments may be made without departing from the inventive concepts herein disclosed. For example, the disclosed techniques may be applied to and/or embodied in various specific types of firearms, including semi-automatic and/or automatic firearms such as rifles, carbines, machine guns, submachine guns, handguns, etc. In another example, the firearms to which the disclosed techniques may be applied to and/or embodied in may include firearms that use either closed bolt and/or open bolt designs.

What is claimed is:

1. A firearm configured to fire cased telescoped (CT) ammunition cartridges, the firearm comprising:

a barrel;

a split chamber configured to radially support a CT cartridge along a full length of the CT cartridge at the time that the CT cartridge is fired, the split chamber including i) a dynamic rear chamber portion defining a pocket in a bolt face of a bolt, the bolt operable to load the CT cartridge into the split chamber for firing, and ii) a static front chamber portion that is integral to the barrel and separate from the bolt;

a cartridge extraction mechanism including a pivoting extractor and at least one dummy extractor that are each configured to a) engage the CT cartridge prior to the CT cartridge being fired, and b) hold the CT cartridge in the pocket defined in the bolt face of the bolt after the CT cartridge is fired as the bolt moves rearward to pull the CT cartridge rearward out of the static front chamber portion;

wherein the pivoting extractor is configured to engage a first portion of an extractor groove in the CT cartridge;

wherein the at least one dummy extractor is configured to engage a second portion of the extractor groove of the CT cartridge, wherein the second portion of the extractor groove of the CT cartridge is not engaged by the pivoting extractor; and wherein an end of a front portion of the at least one dummy extractor is configured to engage with the extractor groove in the CT cartridge along all of a circumference of the CT cartridge in which the extractor groove is not engaged by the pivoting extractor.

2. The firearm of claim 1, further comprising:

wherein the pivoting extractor is configured to engage a first portion of the CT cartridge; and wherein the at least one dummy extractor is configured to engage a second portion of the CT cartridge, wherein the second portion of the CT cartridge is not engaged by the pivoting extractor.

3. The firearm of claim 1, further comprising:

wherein the pivoting extractor is configured to pivot about a first pivot point in the bolt; and wherein the at least one dummy extractor is configured to pivot about at least one second pivot point in the bolt.

4. The firearm of claim 1, further comprising:

wherein the at least one dummy extractor is configured to pivot about the at least one second pivot point in the bolt such that a front portion of the at least one dummy extractor is pivoted outward from the CT cartridge prior to the bolt being moved forward into the static front chamber portion while loading the CT cartridge.

5. The firearm of claim 4, further comprising:

wherein the at least one dummy extractor is configured to pivot about the at least one second pivot point in the bolt such that the front portion of the dummy extractor is pivoted inward towards the CT cartridge as the bolt is moved forward into the static front chamber portion.

6. The firearm of claim 5, further comprising:

an ejector configured to eject the CT cartridge from the pocket defined in the bolt face of the bolt upon the CT cartridge being pulled rearward into an ejection position; and wherein the at least one dummy extractor is configured to pivot outward from the CT cartridge when the bolt moves rearward after firing of the CT cartridge to move the CT cartridge into the ejection position, to allow the CT cartridge to be ejected from the pocket defined in the bolt face of the bolt by the ejector.

7. The firearm of claim 1, further comprising:

wherein an end of a front portion of the at least one dummy extractor has an arcuate surface that matches a contour of an inner surface of the extractor groove of the CT cartridge; and wherein the at least one dummy extractor engages with the CT cartridge prior to firing of the CT cartridge by engagement of the arcuate surface of the end of the front portion of the at least one dummy extractor with the inner surface of the extractor groove of the CT cartridge.

8. The firearm of claim 1, wherein the at least one dummy extractor comprises a pair of opposing dummy extractors.

9. The firearm of claim 8, wherein the pair of opposing dummy extractors are each independently spring loaded to pivot the dummy extractors outward from the CT cartridge until the bolt is moved forward and locked into the static front chamber portion.

10. The firearm of claim 8, wherein the pair of opposing dummy extractors are oriented 90 degrees from the pivoting extractor.

11. The firearm of claim 1, further comprising:

wherein moving the bolt to load the CT cartridge into the split chamber also causes the pivoting extractor to engage the extractor groove in the CT cartridge prior to firing of the CT cartridge.

* * * * *